US007241563B2

(12) United States Patent
Sakurazawa et al.

(10) Patent No.: US 7,241,563 B2
(45) Date of Patent: Jul. 10, 2007

(54) SILVER HALIDE COLOR PHOTOGRAPHIC LIGHT-SENSITIVE MATERIAL

(75) Inventors: Mamoru Sakurazawa, Minami-ashigara (JP); Jun Arakawa, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 10/982,832

(22) Filed: Nov. 8, 2004

(65) Prior Publication Data

US 2005/0100835 A1 May 12, 2005

(30) Foreign Application Priority Data

Nov. 10, 2003 (JP) ..... 2003-380343
Mar. 15, 2004 (JP) ..... 2004-071901

(51) Int. Cl.

| | |
|---|---|
| ***G03C 1/46*** | (2006.01) |
| ***G03C 7/32*** | (2006.01) |
| ***G03C 1/08*** | (2006.01) |
| ***G03C 7/26*** | (2006.01) |

(52) U.S. Cl. ..... 430/502; 430/503; 430/504; 430/505; 430/506; 430/541; 430/543; 430/567; 430/569; 430/551; 430/607

(58) Field of Classification Search ..... 430/502–506, 430/541, 543, 567, 569, 551, 607
See application file for complete search history.

(56) References Cited

U.S. PATENT DOCUMENTS

| | | | | |
|---|---|---|---|---|
| 2,546,400 A | | 3/1951 | Murray | |
| 4,746,600 A | * | 5/1988 | Watanabe et al. | 430/505 |
| 5,272,049 A | | 12/1993 | Sakanoue et al. | |
| 5,474,886 A | | 12/1995 | Nakazyo et al. | |
| 5,576,159 A | | 11/1996 | Sato et al. | |
| 5,631,123 A | | 5/1997 | Abe | |
| 6,048,673 A | | 4/2000 | Kuramitsu et al. | |
| 6,268,116 B1 | | 7/2001 | Roberts et al. | |
| 6,413,706 B1 | | 7/2002 | Nakanishi et al. | |

FOREIGN PATENT DOCUMENTS

| | | |
|---|---|---|
| DE | 100 63 212 A1 | 6/2001 |
| EP | 0 467 327 A1 | 1/1992 |
| EP | 0 481 427 A1 | 4/1992 |
| EP | 0 600 377 A1 | 6/1994 |
| EP | 0 733 947 A1 | 9/1996 |
| EP | 0 854 383 A1 | 7/1998 |
| EP | 0 898 200 A1 | 2/1999 |
| EP | 0 943 962 A1 | 9/1999 |
| FR | 2 370 305 | 6/1978 |
| GB | 818233 | 8/1959 |
| JP | 0 062 202 A1 | 10/1982 |
| JP | 60-164742 | 8/1985 |
| JP | 63-236034 | 9/1988 |
| JP | 4-75055 | 3/1992 |
| JP | 4-110844 | 4/1992 |

* cited by examiner

*Primary Examiner*—Geraldina Visconti
(74) *Attorney, Agent, or Firm*—Sughrue Mion, PLLC

(57) ABSTRACT

A silver halide color photographic light-sensitive material having a silver halide emulsion layer, and (1) a substantially light-insensitive dye-forming-coupler-containing layer, and (2) at least one layer selected from a non-color-forming intermediate layer containing a color-mixing inhibitor and a non-color-forming intermediate layer substantially free of color-mixing inhibitor, wherein i) when the light-insensitive dye-forming-coupler-containing layer is included, the layer is positioned adjacent to the silver halide emulsion layer, and ii) when the non-color-forming intermediate layer containing a color-mixing inhibitor and the non-color-forming intermediate layer substantially free of color-mixing inhibitor are included, these layers are positioned adjacent to each other.

33 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material that can provide satisfactory images with ultra-rapid processing. The present invention relates to a silver halide color photographic light-sensitive material that can provide satisfactory image densities even when it has low coating amount of silver. Further, the invention concerns a silver halide color photographic light-sensitive material that can provide stable images of high quality with low-replenishment, ultra-rapid processing.

BACKGROUND OF THE INVENTION

Recently, digitalization has been remarkably widespread in the field of a color print using a color photographic printing paper. For example, a digital exposure system in which laser scanning exposure is used, has been rapidly spreading.

On the other hand, as a color print process other than one using a color photographic printing paper, technologies such as an ink jet process, a sublimation process, and a color xerography are advanced, and products applying these technologies are wide-spreading. Among these color print processes, a digital color print process using a color photographic paper is characterized in a high image quality, a high productivity, and a high fastness property of the image.

Particularly, in the remarkable widespread of the digital camera, if it were possible to receive digital camera recording media at a shop counter, and finish high-quality printing in a short period of time of about several minutes at a low cast, the superiority of color printing using color photographic printing paper would doubtlessly increase. Therefore, it is important to raise the rapid processing suitability of color-printing paper by using a printing apparatus, which is smaller in size and lower in costs while having high productivity.

To enhance the suitability of color photographic printing paper for rapid processing, various proposals have been made from the viewpoints of reducing each of exposure time, the time from the end of exposure to the beginning of processing, the time from processing to drying, and the like. Of these, reducing the time from processing to drying contributes the most to the rapid processing suitability. Decreasing the coating amount of silver and the thicknesses of coatings, though effective in achieving such reduction, results in the developed color densities being lowered. As such, this problem has awaited solution. Decreasing the thickness of a coating or the coating amount of a hydrophilic binder can lead to a condition in which the reach of oxidation products of a developing agent is beyond the thickness of a swollen color-forming layer, causing a drop in efficiency of dye-forming reaction with dye-forming couplers (hereinafter also referred to as couplers). Further, the oxidation products of a developing agent are consumed by color-mixing inhibitors in non-color-forming intermediate layers, and their concentration gradients become great; as a result, the proportion of oxidized developing agents that form no dyes in color-forming layers, is increased.

In a silver halide color photographic light-sensitive material, a non-color-forming intermediate layer containing a color-mixing inhibitor is generally disposed between emulsion layers having different color sensitivities, to prevent color impurity. The oxidized color-developing agent produced during development from emulsion grains present in the vicinity of the boundary surface between the emulsion layer and the intermediate layer has a high probability of being consumed by the neighboring color-mixing inhibitor, which is a contributing factor to reduced reaction efficiency of dye-forming couplers. In addition, it is known that migration of color-mixing inhibitors to other layers in advance of processing causes various detrimental effects, including decreased dye formation efficiency. Interlayer migration of color-mixing inhibitors is accelerated during storage under high humidity conditions, in particular, and the detrimental effects caused thereby become considerably serious when the coating amounts of hydrophilic binder and silver are reduced. Remedial steps to cope with these difficulties have therefore been desired.

Therefore, the idea of placing a spacer layer (a hydrophilic colloid layer containing neither a color-mixing inhibitor nor a silver halide emulsion) between a color-mixing-inhibitor-containing layer and a silver halide emulsion layer was conceived, and methods to incorporate a dye-forming coupler into a spacer layer, and convert the spacer layer into a light-insensitive, dye-forming layer, have been proposed. Known methods to increase reaction efficiency of an oxidized developing agent, by designing a color-forming layer to have a multilayer form, include the method of providing a color-enhancing layer between an emulsion layer and a color-mixing-inhibiting layer (see, e.g., U.S. Pat. No. 5,576,159); the method of providing a coupler-containing layer and a silver halide emulsion layer independently, with these layers being adjacent to each other (see, e.g., JP-A-4-75055 ("JP-A" means unexamined published Japanese patent application) and European Patent No. 0062202); and the method of combining light-sensitive layers and non-light-sensitive dye-forming layers without interposing color-mixing-inhibiting layers among them (see, e.g., U.S. Pat. No. 6,268,116).

A known method to design an intermediate layer, to inhibit color-mixing, to have a multilayer form, on the other hand, is to provide light-insensitive intermediate layers that are different in color-mixing inhibiting property from each other (see, e.g., JP-A-4-110844). However, the above references have no mention of color-mixing-inhibitor-free, non-color-forming intermediate layers.

However, these methods cannot always produce satisfactory effects on ultra-rapid processing. As such, further improvements have been needed in developed-color changes during storage under high humidity, in silver removal characteristics, and in drying characteristics.

As a measure to lessen the loss of oxidized developing agent due to migration from an emulsion layer to an intermediate layer, reduction in size of emulsion grains is also effective. This is because reduction in the reach of an oxidized developing agent can be achieved by adoption of fine-grain emulsions, and can lead to improved reaction efficiency of dye-forming couplers.

Further, it is known (by T. H. James, *THE THEORY OF THE PHOTOGRAPHIC PROCESS*, 4th. ed., p. 350) that the reaction speeds of dye-forming couplers can be increased, to some extent, by reducing particle sizes of oil-in-water dispersions (emulsified dispersions) containing the dye-forming couplers, to increase surface areas of the particles.

As an emulsifying method, agitation with a dissolver, milling with a colloid mill, and the like are generally adopted. In addition, there is the method of making emulsion grains fine, by making a fluid flow collides with a wall or by making fluid flows collide with each other, to generate impact and shear forces, as in the case of using a Monton- Gaulin homogenizer. However, these methods have the problem of failing to achieve reduction of grain sizes to a value below 0.1 μm.

On the other hand, JP-A-2001-27795 discloses a dispersing method of preparing emulsion grains having sizes of 0.1 μm or below, by use of an ultrahigh-pressure homogenizer.

The methods as mentioned above can produce some effect of improving developed-color densities of silver halide color photographic light-sensitive materials of the type that are reduced in coating amount of silver, but the effect produced is still insufficient. Moreover, it has been revealed that photographic light-sensitive materials having a reduced coating amount of silver had a new problem of developing unevenness of images when they were processed with replenisher-depleted processing solutions after aging. To aim at systems designed with attention to environmental conservation, the replenishment rates of processing solutions are important. As such, there has been a need to solve this new problem.

SUMMARY OF THE INVENTION

The present invention is a silver halide color photographic light-sensitive material, which comprises at least one silver halide emulsion layer, and:

(1) at least one substantially light-insensitive dye-forming-coupler-containing layer, and (2) at least one kind selected from the group consisting of at least one non-color-forming intermediate layer, containing a color-mixing inhibitor and at least one non-color-forming intermediate layer substantially free of color-mixing inhibitor, wherein i) when the light-insensitive dye-forming-coupler-containing layer is contained, the light-insensitive dye-forming-coupler-containing layer is positioned adjacent to the silver halide emulsion layer, and ii) when the non-color-forming intermediate layer containing a color-mixing inhibitor and the non-color-forming intermediate layer substantially free of color-mixing inhibitor are contained, the non-color-forming intermediate layer containing a color-mixing inhibitor is positioned adjacent to the non-color-forming intermediate layer substantially free of color-mixing inhibitor.

Other and further features and advantages of the invention will appear more fully from the following description.

DETAILED DESCRIPTION OF THE INVENTION

The present silver halide color photographic light-sensitive material overcomes the foregoing problems, by taking measures to inhibit the oxidation products of a color-developing agent, which oxidation products are expected to react with dye-forming couplers in silver halide emulsion layers, from moving out by diffusion without participating in the reaction. More specifically, the first of such measures consists of disposing a substantially light-insensitive dye-forming-coupler-containing layer, so as to adjoin a silver halide emulsion layer. The second measure consists of disposing a color-mixing-inhibitor-containing, non-color-forming intermediate layer on a silver halide emulsion layer, via a non-color-forming intermediate layer substantially free of color-mixing inhibitor.

According to the present invention, there are provided the following means:

(1) A silver halide color photographic light-sensitive material comprising at least one silver halide emulsion layer, and <1> at least one substantially light-insensitive dye-forming-coupler-containing layer, and <2> at least one kind selected from the group consisting of at least one non-color-forming intermediate layer containing a color-mixing inhibitor and at least one non-color-forming intermediate layer substantially free of color-mixing inhibitor, wherein i) when the light-insensitive dye-forming-coupler-containing layer is included, the layer is positioned adjacent to the silver halide emulsion layer, and ii) when the non-color-forming intermediate layer containing a color-mixing inhibitor and the non-color-forming intermediate layer substantially free of color-mixing inhibitor are included, the non-color-forming intermediate layer containing a color-mixing inhibitor is positioned adjacent to the non-color-forming intermediate layer substantially free of color-mixing inhibitor.

(2) The silver halide color photographic light-sensitive material as described in the above (1), comprising:

the at least one silver halide emulsion layer, the at least one substantially light-insensitive dye-forming-coupler-containing layer, the at least one non-color-forming intermediate layer containing a color-mixing inhibitor, and the at least one non-color-forming intermediate layer substantially free of color-mixing inhibitor, wherein the light-insensitive dye-forming-coupler-containing layer is positioned adjacent to the silver halide emulsion layer, and the non-color-forming intermediate layer containing a color-mixing inhibitor is positioned adjacent to the non-color-forming intermediate layer substantially free of color-mixing inhibitor.

(3) The silver halide color photographic light-sensitive material as described in the above (1), comprising:

the at least one silver halide emulsion layer, the at least one substantially light-insensitive dye-forming-coupler-containing layer, and the at least one non-color-forming intermediate layer containing a color-mixing inhibitor, wherein the light-insensitive dye-forming-coupler-containing layer is positioned adjacent to the silver halide emulsion layer, and a total coating amount of silver in the silver halide color photographic light-sensitive material is 0.5 $g/m^2$ or below.

(4) The silver halide color photographic light-sensitive material as described in the above (1), comprising:

the at least one silver halide emulsion layer, the at least one non-color-forming intermediate layer containing a color-mixing inhibitor, and the at least one non-color-forming intermediate layer substantially free of color-mixing inhibitor, wherein the non-color-forming intermediate layer containing a color-mixing inhibitor is positioned adjacent to the non-color-forming intermediate layer substantially free of color-mixing inhibitor, and a total coating amount of silver in the silver halide color photographic light-sensitive material is 0.5 $g/m^2$ or below.

(5) The silver halide color photographic light-sensitive material as described in the above (1), comprising:

the at least one silver halide emulsion layer, and the at least one substantially light-insensitive dye-forming-coupler-containing layer, wherein the light-insensitive dye-forming-coupler-containing layer is positioned adjacent to the silver halide emulsion layer, and the silver halide emulsion layer has a coating amount of silver of 0.2 g/m$^2$ or below and has a silver/hydrophilic binder ratio of 0.2 or above on a coating mass basis.

(6) The silver halide color photographic light-sensitive material as described in the above (1), comprising:

the at least one silver halide emulsion layer, and the at least one substantially light-insensitive dye-forming-coupler-containing layer, wherein the light-insensitive dye-forming-coupler-containing layer is positioned adjacent to the silver halide emulsion layer, and a total coating amount of a hydrophilic binder in the silver halide color photographic light-sensitive material is 6.0 g/m$^2$ or below, and a content of a color-mixing inhibitor is $5\times10^{-5}$ mol/m$^2$ or above.

(7) The silver halide color photographic light-sensitive material as described in the above (1), comprising:

the at least one silver halide emulsion layer, and the at least one substantially light-insensitive dye-forming-coupler-containing layer, wherein the light-insensitive dye-forming-coupler-containing layer is positioned adjacent to the silver halide emulsion layer, and the silver halide emulsion layer has a hydrophilic binder coating amount of 0.6 g/m$^2$ or below, and a ratio of a hydrophilic binder coating amount in the light-insensitive dye-forming-coupler-containing layer to the hydrophilic binder coating amount in the silver halide emulsion layer is 1.0 or above.

(8) The silver halide color photographic light-sensitive material as described in the above (1), comprising:

the at least one silver halide emulsion layer, the at least one non-color-forming intermediate layer containing a color-mixing inhibitor, and the at least one non-color-forming intermediate layer substantially free of color-mixing inhibitor, wherein the non-color-forming intermediate layer containing a color-mixing inhibitor is positioned adjacent to the non-color-forming intermediate layer substantially free of color-mixing inhibitor, and a total hydrophilic-binder coating amount in the silver halide color photographic light-sensitive material is 6.0 g/m$^2$ or below.

(9) The silver halide color photographic light-sensitive material as described in the above (1), comprising:

the at least one silver halide emulsion layer, the at least one substantially light-insensitive dye-forming-coupler-containing layer, the at least one non-color-forming intermediate layer containing a color-mixing inhibitor, and the at least one non-color-forming intermediate layer substantially free of color-mixing inhibitor, wherein the light-insensitive dye-forming-coupler-containing layer is positioned adjacent to the silver halide emulsion layer, and the non-color-forming intermediate layer containing a color-mixing inhibitor is positioned adjacent to the non-color-forming intermediate layer substantially free of color-mixing inhibitor, and wherein the silver halide color photographic light-sensitive material has a total coating amount of silver of 0.5 g/m$^2$ or below, and a total hydrophilic-binder coating amount of 6.0 g/m$^2$ or below.

(10) The silver halide color photographic light-sensitive material as described in the above (9), wherein the silver halide emulsion layer, which is positioned adjacent to the light-insensitive dye-forming-coupler-containing layer, has a coating amount of silver of 0.2 g/m$^2$ or below and has a silver/hydrophilic binder ratio of 0.2 or above on a coating mass basis.

(11) The silver halide color photographic light-sensitive material as described in the above (9) or (10), wherein a total coating amount of a color-mixing inhibitor in the silver halide color photographic light-sensitive material is $5\times10^{-5}$ mol/m$^2$ or above.

(12) The silver halide color photographic light-sensitive material as described in any one of the above (9) to (11), wherein the silver halide emulsion layer, which is positioned adjacent to the light-insensitive dye-forming-coupler-containing layer, has a hydrophilic binder coating amount of 0.6 g/m$^2$ or below, and a ratio of a hydrophilic binder coating amount in the light-insensitive dye-forming-coupler-containing layer to the hydrophilic binder coating amount in the silver halide emulsion layer is 1.0 or above.

(13) The silver halide color photographic light-sensitive material as described in any one of the above (2) to (5), and (7), wherein a total hydrophilic-binder coating amount in the silver halide color photographic light-sensitive material is 6.0 g/m$^2$ or less.

(14) The silver halide color photographic light-sensitive material as described in any one of the above (2), (5), (7), and (8), wherein a total coating amount of silver in the silver halide color photographic light-sensitive material is 0.5 g/m$^2$ or below.

(15) The silver halide color photographic light-sensitive material as described in any one of the above (3), (4), and (9) to (14), wherein a total coating amount of silver in the silver halide color photographic light-sensitive material is 0.4 g/m$^2$ or below.

(16) The silver halide color photographic light-sensitive material as described in any one of the above (2), (3), (5) to (7), and (9) to (15), wherein the substantially light-insensitive dye-forming coupler-containing layers are positioned adjacent to both upper and lower sides of the silver halide emulsion layer.

(17) The silver halide color photographic light-sensitive material as described in any of (2), (4), (8) and (9) to (16), wherein the non-color-forming intermediate layers substantially free of color-mixing inhibitor are positioned adjacent to both upper and lower sides of the non-color-forming intermediate layer containing a color-mixing inhibitor.

(18) The silver halide color photographic light-sensitive material as described in any one of the above (2), (4), (8), and (9) to (17), wherein the non-color-forming intermediate layer free of color-mixing inhibitor is positioned adjacent to a non-color-forming intermediate layer free of color-mixing inhibitor.

(19) The silver halide color photographic light-sensitive material as described in any one of the above (2), (3), (5) to (7), and (9) to (18), wherein the silver halide emulsion layer, which is positioned adjacent to the light-insensitive dye-forming-coupler-containing layer, has a coating amount of silver of 0.1 g/m$^2$ or below.

(20) The silver halide color photographic light-sensitive material as described in any one of the above (2), (3), (5) to (7), and (9) to (19), wherein the silver halide emulsion layer, which is positioned adjacent to the light-insensitive dye-forming-coupler-containing layer, has a silver/hydrophilic binder ratio of 0.25 or above on a coating mass basis.

(21) The silver halide color photographic light-sensitive material as described in the above (7), wherein the silver halide emulsion layer, which is positioned adjacent to the light-insensitive dye-forming-coupler-containing layer, has a hydrophilic binder coating amount of 0.4 $g/m^2$ or above.

(22) The silver halide color photographic light-sensitive material as described in any one of the above (2), (3), (5) to (7), and (9) to (21), wherein a ratio of the hydrophilic binder coating amount in the light-insensitive dye-forming-coupler-containing layer to the hydrophilic binder coating amount in the silver halide emulsion layer, which is positioned adjacent to the light-insensitive dye-forming-coupler-containing layer, is 1.4 or above.

(23) The silver halide color photographic light-sensitive material as described in any one of the above (2) to (5), (7) to (10), and (12) to (22), wherein a total content of a color-mixing inhibitor is $1\times10^{-5}$ $mol/m^2$ or above.

(24) The silver halide color photographic light-sensitive material as described in any one of the above (2) to (23), wherein a total content of a color-mixing inhibitor is $1\times10^{-4}$ $mol/m^2$ or above.

(25) The silver halide color photographic light-sensitive material as described in any one of the above (2) to (24), wherein the silver halide emulsion layer contains a silver halide emulsion having a silver chloride content of 90 mol % or more.

(Herein, the silver halide color photographic light-sensitive materials as described in the above items (1) to (25) are collectively referred to as a first embodiment of the present invention.)

(26) The silver halide color photographic light-sensitive material as described in the above (1), comprising:

the at least one silver halide emulsion layer, the at least one non-color-forming intermediate layer containing a color-mixing inhibitor, and the at least one non-color-forming intermediate layer substantially free of color-mixing inhibitor, wherein the non-color-forming intermediate layer substantially free of color-mixing inhibitor is adjacently disposed between the non-color-forming intermediate layer containing a color-mixing inhibitor and the silver halide emulsion layer, and at least one of the following conditions 1) and 2) is satisfied:

1) the silver halide emulsion layer contains silver halide grains having an average grain size of 0.50 μm or below, and 2) at least one aqueous dispersion of a water-insoluble photographically-useful compound is incorporated in the silver halide color photographic light-sensitive material and the dispersion has an average particle size of 100 nm or below.

(27) The silver halide color photographic light-sensitive material as described in the above (1), comprising:

the at least one silver halide emulsion layer, and the at least one substantially light-insensitive dye-forming-coupler-containing layer, wherein the at least one silver halide layer contains a dye-forming coupler, wherein the at least one substantially light-insensitive dye-forming-coupler-containing layer is positioned adjacent to the silver halide emulsion layer, and wherein at least one of the following conditions 1A) and 2) is satisfied:

1A) the silver halide emulsion layer contains silver halide grains having an average grain size of 0.35 μm or below, and 2) an aqueous dispersion of a water-insoluble photographically-useful compound is incorporated in the silver halide color photographic light-sensitive material and the dispersion has an average particle size of 100 nm or below.

(28) The silver halide color photographic light-sensitive material as described in the above (1), comprising:

the at least one silver halide emulsion layer, and at least two non-color-forming intermediate layers, wherein the non-color-forming intermediate layers are positioned adjacent to each other; one of the non-color-forming intermediate layers is substantially free of color-mixing inhibitor, and the other non-color-forming intermediate layer contains a color-mixing inhibitor; and at least one of the following conditions 1B) and 2) is satisfied:

1B) the silver halide emulsion layer contains silver halide grains having an average grain size of 0.45 μm or below, and 2) an aqueous dispersion of a water-insoluble photographically-useful compound is incorporated in the silver halide color photographic light-sensitive material and the dispersion has an average particle size of 100 nm or below.

(29) The silver halide color photographic light-sensitive material as described in the above (26) or (27), wherein the average grain size of the silver halide grains is 0.35 μm or below.

(30) The silver halide color photographic light-sensitive material as described in any one of the above (26) to (28), wherein the average particle size of the aqueous dispersion is 70 nm or less.

(31) The silver halide color photographic light-sensitive material as described in any one of the above (26) to (28), wherein the aqueous dispersion is dispersed under a pressure of at least 200 MPa by use of an ultrahigh-pressure homogenizer.

(32) The silver halide color photographic light-sensitive material as described in any one of the above (26) to (28), wherein the aqueous dispersion is dispersed under a pressure of at least 240 MPa by use of an ultrahigh-pressure homogenizer.

(33) The silver halide color photographic light-sensitive material as described in any one of the above (26) to (28), wherein both the conditions 1) and 2) are satisfied.

(34) The silver halide color photographic light-sensitive material as described in any one of the above (26) to (28), wherein the aqueous dispersion contains a dye-forming coupler.

(35) The silver halide color photographic light-sensitive material as described in the above (1), comprising:

the at least one silver halide emulsion layer, the at least one substantially light-insensitive dye-forming-coupler-containing layer, and at least two non-color-forming intermediate layers, wherein the at least one silver halide emulsion layer contains a dye-forming coupler, wherein the at least one substantially light-insensitive dye-forming-coupler-containing layer is positioned adjacent to the silver halide emulsion layer; the at least two non-color-forming intermediate layers are positioned adjacent to each other, one of the non-color-forming intermediate layers is substantially free of color-mixing inhibitor, and the other non-color-forming intermediate layer contains a color-mixing inhibitor; and at least one of the following conditions 1C) and 2) is satisfied:

1C) the silver halide emulsion layer contains silver halide grains having an average grain size of 0.40 μm or below, and 2) an aqueous dispersion of a water-insoluble photographically-useful compound is incorporated in the silver halide color photographic light-sensitive material and the dispersion has an average particle size of 100 nm or below.

(36) The silver halide color photographic light-sensitive material as described in any one of the above (26) to (28), wherein at least one of the following conditions a) and b) is further satisfied:

a) the silver halide color photographic light-sensitive material has a total coating amount of silver of 0.5 $g/m^2$ or below, b) the silver halide color photographic light-sensitive material has a total hydrophilic-binder coating amount of 6.0 $g/m^2$ or below.

(37) The silver halide color photographic light-sensitive material as described in any one of the above (27) or (35), wherein at least one condition selected from the following a) to d) is further satisfied:

a) the silver halide color photographic light-sensitive material has a total coating amount of silver of 0.5 $g/m^2$ or below, b) the silver halide color photographic light-sensitive material has a total hydrophilic-binder coating amount of 6.0 $g/m^2$ or below, c) the silver halide emulsion layer, which is positioned adjacent to the at least one substantially light-insensitive dye-forming-coupler-containing layer, has a coating amount of silver of 0.2 $g/m^2$ or below and a silver/hydrophilic binder ratio of 0.2 or above on a coating mass basis, and d) the silver halide emulsion layer, which is positioned adjacent to the at least one substantially light-insensitive dye-forming-coupler-containing layer, has a hydrophilic-binder coating amount of 0.6 $g/m^2$ or below and a ratio of hydrophilic-binder coating amount of the at least one substantially light-insensitive dye-forming-coupler-containing layer and adjoining the silver halide emulsion layer to the hydrophilic-binder coating amount of the silver halide emulsion layer is 1.0 or above.

(Herein, the silver halide color photographic light-sensitive materials as described in the above items (1), and (26) to (37) are collectively referred to as a second embodiment of the present invention.)

Herein, the present invention means to include both the first embodiment and the second embodiment, unless otherwise specified.

The present invention is described in detail below.

In the present specification, the word "to" placed between two numerical values is used in the sense of including these numerical values as lower and upper limits.

Preferably, the present silver halide color photographic light-sensitive material has at least three silver halide emulsion layers different in spectral sensitivity from one another. Specifically, it is appropriate for the three silver halide emulsion layers to be a red-sensitive silver halide emulsion layer, a green-sensitive silver halide emulsion layer, and a blue-sensitive silver halide emulsion layer. Alternatively, the three silver halide emulsion layers can have mutually different spectral sensitivities in the region extending to the infrared portion.

The present invention has no particular restriction as to the arrangement order of these silver halide emulsion layers. Specifically, the present silver halide emulsion layers may have a standard configuration, in which the blue-sensitive emulsion layer is positioned adjacent to a support, or they may have another configuration, in which the red-sensitive emulsion layer or the green-sensitive emulsion layer is positioned adjacent to a support. In addition, the light-sensitive emulsion layer most distant from a support may be not only the red-sensitive emulsion layer but also the green-sensitive emulsion layer or the blue-sensitive emulsion layer.

The silver halide color photographic light-sensitive material of the present invention preferably has at least one substantially light-insensitive layer containing a dye-forming coupler. The substantially light-insensitive layer containing a dye-forming coupler according to the present invention is entirely free of silver halide emulsions; or, when it contains any silver halide emulsions, an appropriate content of silver halide is generally 0.1 mole or below, preferably 0.01 mole or below, per mole of coupler.

The light-insensitive layer containing a dye-forming coupler according to the present invention is positioned adjacent to at least one silver halide emulsion layer. When the silver halide emulsion layer is positioned adjacent to a support, preferably, one light-insensitive layer containing a dye-forming coupler adjoins the silver halide emulsion layer on the side distant from the support. When the silver halide emulsion layer does not adjoin the support, at least one light-insensitive layer containing a dye-forming coupler adjoins the emulsion layer; or, preferably, two light-insensitive layers respectively containing a dye-forming coupler adjoin the emulsion layer on both sides, respectively.

Dye-forming couplers are contained in silver halide emulsion layers, as well as, in dye-forming-coupler-containing light-insensitive layers. For instance, a red-sensitive silver halide emulsion layer contains a cyan dye-forming coupler, and a dye-forming-coupler-containing light-insensitive layer adjacent thereto also contains a cyan dye-forming coupler. The dye-forming couplers contained in a silver halide emulsion layer, and a dye-forming-coupler-containing light-insensitive layer adjacent thereto, may be the same or different in kind, but they are preferably the same in kind. Likewise, a green-sensitive silver halide emulsion layer, and a dye-forming-coupler-containing light-insensitive layer adjacent thereto, respectively contain a magenta dye-forming coupler; and a blue-sensitive silver halide emulsion layer, and a dye-forming-coupler-containing light-insensitive layer adjacent thereto, respectively contain a yellow dye-forming coupler.

In the present invention, when at least one silver halide emulsion layer contains a dye-forming coupler, the content of the coupler, though depends on the kind of the coupler, is preferably from 0.5 to 5.0 moles, more preferably from 0.7 to 3.0 moles, per mole of silver halide.

In the present invention, the total content of dye-forming couplers contained in a silver halide emulsion layer and a dye-forming-coupler-containing light-insensitive layer be preferably from 2.0 to 5.0 moles, more preferably from 2.0 to 3.5 moles, per mole of silver halide in the silver halide emulsion layer.

Further, it is preferable that the coupler content in a dye-forming-coupler-containing light-insensitive layer constitutes on a mole basis at least 50%, preferably at least 60%, of the total coupler content in a silver halide emulsion layer and the dye-forming-coupler-containing light-insensitive layer adjacent thereto.

The expression "a dye-forming-coupler-containing light-insensitive layer is positioned adjacent to (or adjoins) a silver halide emulsion layer" is intended to include not only a case where those layers are coated as distinctly separate layers but also a case where, though a mixed solution is coated in a single layer, its separation occurs after coating and results in concentration of silver halide emulsion grains.

The coating amount of silver of the silver halide emulsion layer adjacent to a dye-forming-coupler-containing light-insensitive layer is preferably 0.2 g/m$^2$ or below, more preferably 0.15 g/m$^2$ or below, particularly preferably from 0.05 g/m$^2$ to 0.1 g/m$^2$. The silver/hydrophilic binder ratio in the silver halide emulsion layer on a mass basis is preferably at least 0.2, more preferably at least 0.25, particularly preferably from 0.3 to 1.0. The hydrophilic-binder coating amount in the silver halide emulsion layer is at most 0.6 g/m$^2$, more preferably at most 0.4 g/m$^2$, particularly preferably from 0.05 g/m$^2$ to 0.3 g/m$^2$. The ratio of hydrophilic-binder coating amount of the dye-forming-coupler-containing light-insensitive layer to that of the silver halide emulsion layer is preferably at least 1.0, more preferably at least 1.4, particularly preferably from 1.8 to 5.0. When two dye-forming-coupler-containing light-insensitive layers are present in one color-forming unit, the hydrophilic binder coating amount adopted in specifying the above ratio values is the total coating amount of hydrophilic binders in the two light-insensitive layers.

The silver halide color photographic light-sensitive material of the present invention preferably has at least one non-color-forming intermediate layer containing a color-mixing inhibitor and/or at least one non-color-forming intermediate layer substantially free of color-mixing inhibitor. When the silver halide color photographic light-sensitive material has both of a non-color-forming intermediate layer containing a color-mixing inhibitor and a non-color-forming intermediate layer substantially free of color-mixing inhibitor, it is preferred that the non-color-forming intermediate layer containing a dye-forming coupler adjoins the non-color-forming intermediate layer substantially free of color-mixing inhibitor.

A unit, in which the non-color-forming intermediate layer containing a color-mixing inhibitor (hereinafter symbolized by MCS) and the non-color-forming intermediate layer substantially free of color-mixing inhibitor (hereinafter symbolized by MCN) in an adjacent state, is preferably placed between two silver halide emulsion layers (wherein MCN is preferably arranged at a position closer to either silver halide emulsion layer). It is preferred that this non-color-forming intermediate layer unit having MCN and MCS, has a triple-layer structure made up of two MCNs and one MCS, and the MCS is positioned adjacent to both upper and lower MCNs. It is much preferred that the non-color-forming intermediate layer unit having at least two constituent layers is present in each of two spaces formed by three silver halide emulsion layers generally included in a color photographic light-sensitive material. In the present invention, the MCNs relieve concentration gradients of the oxidation products of a developing agent produced in the emulsion layers, and thus, they have the function of increasing proportions of the oxidized developing agents remaining in the emulsion layers, without diffusing into other layers.

Incidentally, the term "intermediate layer" in the phrase "non-color-forming intermediate layer" generally refers to the layer provided at any location in the space between two silver halide emulsion layers, and never refers to a silver halide emulsion layer containing a color-developing-dye-forming coupler.

Color-mixing inhibitors usable in the invention are known color-mixing inhibitors, with examples including reducing agents such as 2,5-di-t-octylhydroquinone and other hydroquinone compounds, resorcinol compounds, catechol compounds, pyrogallol compounds, aminophenol compounds, phenylenediamines, ascorbic acids, reductones, phenidones, hydrazines or hydrazides, and white couplers.

For example, high molecular weight redox compounds described in JP-A-5-333501; phenidone- or hydrazine-series compounds as described in, for example, WO 98/33760 and U.S. Pat. No. 4,923,787; and white couplers as described in, for example, JP-A-5-249637, JP-A-10-282615, and German Patent No. 19629142 A1, may be used. Particularly, in order to accelerate developing speed by increasing the pH of a developing solution, redox compounds described in, for example, German Patent No. 19,618,786 A1, European Patent Nos. 839,623 A1 and 842,975 A1, German Patent No. 19,806,846 A1 and French Patent No. 2,760,460 A1, are also preferably used.

The expression "substantially free of color-mixing inhibitor" in the MCN that can be used in the present invention means that the per-layer coating amount of a color-mixing inhibitor is not greater than $1\times10^{-5}$ mole/m$^2$.

The content of color-mixing inhibitor in the present color photographic light-sensitive material is preferably at least $5\times10^{-5}$ mole/m$^2$, more preferably from $1\times10^{-4}$ mole/m$^2$ to $5\times10^{-3}$ mole/m$^2$.

The per-layer coating amount of hydrophilic binder in the non-color-forming intermediate layer MCS or MCN is preferably at most 0.7 g/m$^2$, more preferably at most 0.5 g/m$^2$, further preferably from 0.05 g/m$^2$ to 0.4 g/m$^2$. The total coating amount of hydrophilic binder for the non-color-forming intermediate layer having two or more constituent layers is at most 1.5 g/m$^2$, preferably from 0.2 g/m$^2$ to 1.2 g/m$^2$ (when the present photographic light-sensitive material has such an intermediate layer in two places, the foregoing total coating amount translates into the coating amount of total hydrophilic binders present in the two places). When three layers are coated in two places each, for instance, the total coating amount of hydrophilic binder is a sum of the coating amounts of hydrophilic binders in the six layers. The coating amount of hydrophilic binder for the non-color-forming intermediate layer MCN is preferably at least 0.05 g/m$^2$ more preferably from 0.1 g/m$^2$ to 0.4 g/m$^2$, further preferably from 0.2 g/m$^2$ to 0.3 g/m$^2$.

The total coating amount of the hydrophilic binder in the present light-sensitive material is preferably 6.0 g/m$^2$ or less, and more preferably 5.5 g/m$^2$ or less, and further more preferably from 3.0 g/m$^2$ or more to 5.0 g/m$^2$ or less.

In the silver halide color photographic light-sensitive material of the present invention, gelatin is generally used as the hydrophilic binder, but hydrophilic colloids, for example, other gelatin derivatives, graft polymers between gelatin and other polymers, proteins other than gelatin, sugar derivatives, cellulose derivatives, and synthetic hydrophilic polymeric materials such as homopolymers or copolymers, can also be used in combination with gelatin, if necessary.

Gelatin to be used in the light-sensitive material of the present invention may be either lime-treated or acid-treated gelatin, or may be gelatin produced from any of cow bone, cowhide, pig skin, or the like, as the raw material, preferably lime-treated gelatin produced from cow bone or pig skin as the raw material.

The silver coating amount in the light-sensitive material of the present invention is preferably 0.5 g/m$^2$ or less, more preferably 0.4 g/m$^2$ or less, and further more preferably 0.35 g/m$^2$ or less (from 0.2 g/m$^2$ or more to 0.35 g/m$^2$ or less).

It is preferred for the present light-sensitive material to have a structure, which has at least one color-forming layer unit having a silver halide emulsion layer and its neighboring light-insensitive dye-forming-coupler-containing layer(s), and has at least one non-color-forming intermediate layer unit including MCS and its neighboring MCN(s). It is more preferred that the color-forming layer unit having the multilayer structure as mentioned above be adjacent to the non-color-forming intermediate layer unit having the multilayer structure as mentioned above.

In the following, examples of the layer constitution of the light-sensitive material of the present invention are shown, but the present invention is not limited to these.

[1] Support/BL/YL/MCS/ML/GL/ML/MCS/CL/RL/CL/UV/PC
[2] Support/BL/YL/MCS/GL/MCS/RL/UV/PC
[3] Support/BL/MCS/ML/GL/ML/MCS/RL/UV/PC
[4] Support/BL/MCS/GL/MCS/CL/RL/CL/UV/PC
[5] Support/BL/YL/MCN/MCS/MCN/ML/GL/ML/MCN/MCS/MCN/CL/RL/CL/UV/PC
[6] Support/BL/MCN/MCS/MCN/ML/GL/ML/MCN/MCS/MCN/RL/UV/PC
[7] Support/BL/MCN/MCS/ML/GL/ML/MCS/MCN/RL/UV/PC
[8] Support/BL/MCN/MCS/MCN/ML/GL/ML/MCS/RL/UV/PC
[9] Support/BL/YL/MCS/CL/RL/CL/MCS/ML/GL/ML/UV/PC
[10] Support/BL/YL/MCS/RL/MCS/GL/UV/PC
[11] Support/BL/MCS/ML/RL/ML/MCS/GL/UV/PC
[12] Support/BL/MCS/RL/MCS/ML/GL/ML/UV/PC
[13] Support/BL/YL/MCN/MCS/MCN/CL/RL/CL/MCN/MCS/MCN/ML/GL/ML/UV/PC
[14] Support/BL/MCN/MCS/MCN/CL/RL/CL/MCN/MCS/MCN/GL/UV/PC
[15] Support/BL/MCN/MCS/CL/RL/CL/MCS/MCN/GL/UV/PC
[16] Support/BL/MCN/MCS/MCN/CL/RL/CL/MCS/GL/UV/PC In the above, each layer has the following meaning.

BL: Blue-sensitive silver halide emulsion layer
GL: Green-sensitive silver halide emulsion layer
RL: Red-sensitive silver halide emulsion layer
YL: Light-insensitive layer containing a yellow-dye-forming coupler
ML: Light-insensitive layer containing a magenta-dye-forming coupler
CL: Light-insensitive layer containing a cyan-dye-forming coupler
MCS: Non-color-forming intermediate layer containing a color-mixing inhibitor
MCN: Non-color-forming intermediate layer substantially free of color-mixing inhibitor
UV: Ultraviolet absorbing layer
PC: Protective layer In the present invention, preferably in the second embodiment of the present invention, the grain size of a silver halide grain may be specified as a side length of a cube having the same volume as an individual silver halide grain. In the present invention, preferably in the second embodiment of the present invention, the average grain size is defined as a number average of the above grain size (volume equivalent-cubic side length) among silver halide grains. In this time, however, the average grain size must be calculated using solely silver halide grains capable of substantially contributing to dye formation resulting from a reaction with a coupler upon development. Accordingly, a fine grain emulsion having substantially no sensitivity must be neglected from calculation of the average grain size.

In the present invention, preferably in the second embodiment of the present invention, the average grain size of silver halide grains in a light-sensitive silver halide emulsion layer is preferably 0.50 μm or less, more preferably 0.45 μm or less, further preferably 0.40 μm or less, and most preferably 0.35 μm or less.

In the present invention, preferably in the second embodiment of the present invention, the lower limit of the grain size of silver halide grains in a yellow-color-forming light-sensitive silver halide emulsion layer is not set in particular. However, if the grain size is too small, there is a possibility to invite insufficiency of sensitivity and stain on the white ground resulting from an increase in a coating amount of a sensitizing dye. So long as the above-mentioned problem does not arise, the lower limit of the grain size may be set arbitrarily. Said lower limit is preferably 0.15 μm, more preferably 0.20 μm.

In the present invention, preferably in the second embodiment of the present invention, the lower limit of the average grain size of silver halide grains in a magenta-color-forming light-sensitive silver halide emulsion layer and a cyan-color-forming light-sensitive silver halide emulsion layer is not particularly limited, and the average grain size is preferably 0.10 μm or more.

It is preferable that the grain size distribution of silver halide grains for use in the present invention, preferably in the second embodiment of the present invention, is homogeneous. The grain size distribution is preferably a state of so-called "mono-dispersion" having coefficient of variation (the value obtained by dividing a standard deviation of grain size distribution by an average grain size) of generally 20% or less, preferably 15% or less, more preferably 10% or less. Further in order to attain wide latitude, two or more kinds of the above-mentioned mono-dispersion emulsions may be blended in the same layer.

In the present invention, preferably in the second embodiment of the present invention, any known method for measuring silver halide grain size can be used. Of these methods, preferred is a method of measuring a size of each of grains observed by an electron microscope.

The aqueous dispersion of a water-insoluble photographically-useful compound that can be used in the present invention, preferably in the second embodiment of the present invention, is described below in detail.

The term "water-insoluble" as used in this specification means that, in adding a required amount of photographically useful compound to a photographic element, the photographically useful compound cannot be dissolved in a coating composition, as an aqueous solution in the entire amount, due to lack of solubility in water even when the composition is diluted to the lowest concentration within its coatable range. In general such a term is used for a state that the solubility in 100 g of water at 20° C. is not greater than 10, preferably 5 or below.

Examples of a water-insoluble photographically-useful compound which can be used in the aqueous dispersion that can be used in the present invention, preferably in the second embodiment of the present invention, include dye-forming couplers, dye-image providing redox compounds, stain inhibitors, antifoggants, ultraviolet absorbers, discoloration inhibitors, color-mixing inhibitors, nucleating agents, silver halide solvents, bleach accelerators, developing agents, filter dyes and precursors thereof, dyes, pigments, sensitizers, hardeners, brightening agents, desensitizers, antistatic agents, antioxidants, oxidized-developing-agent scavengers, mordants, matting agents, development accelerators, development inhibitors, thermal solvents, color tone controllers, slipping agents, polymer latexes known as media for dispersing the foregoing agents, water-insoluble inorganic salts (such as zinc hydroxide), and membrane strength improvers. Specific examples of these agents are described, e.g., in *Research Disclosure* (R.D.) No. 17643, *R.D.* No. 18716, *R.D.* No. 307105 and *R.D.* No. 40145. The composition treated in the present invention, preferably in the second embodiment of the present invention, has no particular limitation as to the proportion of water-insoluble photographically-useful organic compounds, but it is preferred that the concentration of those compounds in the composition be at least 1 mass %, preferably from 2 to 50 mass %, particularly preferably from 5 to 20 mass %. It is most preferred that the aqueous dispersion in the present invention, preferably in the second embodiment of the present invention, contains a dye-forming coupler.

It is preferable that the aqueous medium used in the present invention, preferably in the second embodiment of the present invention, contains a water-soluble protective colloid. Examples of the protective colloid include known ones, such as polyvinyl alcohol, polyethylene oxide, polyvinyl pyrrolidone, polyacrylic acid, polyacrylamide, polysaccharide, casein, and gelatin. In particular, gelatin is preferred.

It is also preferable that the aqueous dispersion of a water-insoluble photographically-useful compound in the present invention, preferably in the second embodiment of the present invention, contains a surfactant. As the surfactant, known surfactants can be used. Examples of a hitherto disclosed dispersing aid include anionic dispersants, such as alkylphenoxyethane sulformates, polyoxyethylene alkyl phenyl ether sulfonates, alkylbenzene sulfonates, alkylnaphthalene sulfonates, alkylsulfuric acid ester salts, alkylsulfosuccinates, sodium oleylmethyltauride, naphthalenesulfonic acid-formaldehyde condensation polymer, polyacrylic acid, polymethacrylic acid, maleic acid-acrylic acid copolymer, carboxymethyl cellulose, and cellulose sulfate; nonionic dispersants, such as polyoxyethylene alkyl ethers, sorbitan fatty acid esters, polyoxyethylene sorbitan fatty acid esters, and block polymers of polyalkylene oxides; cationic dispersants, and betaine dispersants.

The average particle size of the aqueous dispersion in the present invention, preferably in the second embodiment of the present invention, is 0.1 μm (100 nm) or below, preferably from 70 nm to 5 nm.

The average particle size of the aqueous dispersion in the present invention, preferably in the second embodiment of the present invention, can be determined by the particle-size measurement according to dynamic light scattering. When gelatin is used as the protective colloid in the aqueous dispersion, the particle size can be determined with removing the gelatin adsorbed to particles, in the following manners.

Preparation of Solution for Enzyme Treatment:

The surfactant used in a target aqueous dispersion, in an amount of 0.25 g and a commercially available proteolytic enzyme (e.g., Actinase E, manufactured by Wako Pure Chemical Industries, Ltd.) in an amount of 0.020 g were dissolved in 200 mL of water at room temperature. By passing the thus obtained aqueous solution through a commercially available 0.2-μm aqueous-system filter, a solution for enzyme treatment was prepared.

Preparation of Solution for Size Measurement:

The aqueous dispersion was weighed in an amount of 0.25 g, and dissolved in 2.5 mL of water kept at a temperature of 40 to 45° C. This dilute solution and the foregoing solution for enzyme treatment were admixed in a proportion of 1 mL to 10 mL, and kept at 40° C. for 5 minutes. The solution thus obtained was then cooled to room temperature.

Measurement:

The thus-prepared solution for size measurement was subjected to particle-size measurement with a particle size analyzer LB500 (trade name) made by Horiba Ltd.

It is preferred that the aqueous dispersion in the present invention, preferably in the second embodiment of the present invention, be emulsified under pressure of 200 MPa or above, preferably 240 MPa or above, with a high-pressure homogenizer.

An example of a high-pressure homogenizer usable for emulsification in the present invention, preferably in the second embodiment of the present invention, is Ultimaizer System HJP-25005 (trade name) made by Sugino Machine Limited. This system can accelerate a dispersion by feeding the dispersion at ultrahigh pressure by means of a hydraulic pump and by passing it through 0.1 mm ϕ diamond-made chamber nozzles. The thus-accelerated dispersion flows can be caused oppose to and collide with each other. In addition, it is possible to apply back pressure to the dispersion outlet. Alternatively, the dispersing machine shown in FIGS. 1 to 3 of JP-A-2001-27795 or a DeBEE 2000 (trade name) made by BEE INTERNATIONAL can be favorably used.

It is preferred that the aqueous dispersion in the present invention, preferably in the second embodiment of the present invention, be rendered fine in a jet stream, with using a high-pressure homogenizer. The jet stream in the present invention, preferably in the second embodiment of the present invention, refers to a fluid flow, and the initial velocity of jet stream is preferably at least 300 m/sec, more preferably at least 400 m/sec, far preferably at least 600 m/sec.

The basic constitution of a silver halide color photographic light-sensitive material (hereinafter, sometimes referred to simply as "photosensitive material"), to which the present invention is to be applied, is explained in more detail below.

The silver halide color photosensitive material of the present invention has, on a support, at least one silver halide emulsion layer containing a yellow dye-forming coupler, at least one silver halide emulsion layer containing a magenta dye-forming coupler, and at least one silver halide emulsion layer containing a cyan dye-forming coupler.

In the present invention, the silver halide emulsion layer containing a yellow dye-forming coupler functions as a yellow color-forming (color-developing) layer, the silver halide emulsion layer containing a magenta dye-forming coupler functions as a magenta color-forming layer, and the silver halide emulsion layer containing a cyan dye-forming coupler functions as a cyan color-forming layer. Preferably, the silver halide emulsions contained in the yellow color-developing layer, the magenta color-developing layer, and the cyan color-developing layer may have photo-sensitivities to mutually different wavelength regions of light (for example, light in a blue region, light in a green region, and light in a red region).

In addition to the light-insensitive dye-forming-coupler-containing layer and/or the non-color-forming intermediate layer, the photosensitive material of the present invention may have a hydrophilic colloid layer, an antihalation layer, and/or a coloring layer, if necessary.

The silver halide photographic photosensitive material of the present invention can be used for various materials, such as color negative films, color positive films, color reversal films, color reversal papers, color papers, motion-picture color negatives, motion-picture color positives, display photosensitive materials, and color proof (especially, digital color proof) photosensitive materials.

The present invention is preferably applied to a photosensitive material that is used for direct view, such as a color photographic printing paper (color paper), a display photosensitive material, a color proof, a color reversal film (color reversal), a color reversal paper, and a motion picture color positive. Of these photosensitive materials, a color paper and a color reversal film are preferred.

In the case where the present invention is applied to a color paper, for example, the photosensitive materials described in JP-A-11-7109 are preferred. Particularly the description of the paragraph Nos. 0071 to 0087 in the JP-A-11-7109 is herein incorporated by reference.

In the case where the present invention is applied to a color negative film, the description of the paragraph Nos. 0115 to 0217 in JP-A-11-305396 is preferably applied, and the description is herein incorporated by reference.

In the case where the present invention is applied to a color reversal film, the photosensitive materials described in JP-A-2001-142181 are preferred. Specifically, the description of the paragraph Nos. 0164 to 0188 in the JP-A-2001-142181 and the description of the paragraph Nos. 0018 to 0021 in JP-A-11-84601 are preferably applied, and these descriptions are herein incorporated by reference.

The preferred silver halide photosensitive materials of the present invention are explained in detail below.

The silver halide emulsion preferably used in the present invention will be described in detail hereinbelow.

Silver halide grains in the silver halide emulsion, which can be used in the present invention, are preferably cubic or tetradecahedral crystal grains substantially having {100} planes (these grains may be rounded at the apexes thereof and further may have planes of high order), or octahedral crystal grains. Alternatively, a silver halide emulsion, in which the proportion of tabular grains having an aspect ratio of 2 or more and composed of {100} or {111} planes accounts for 50% or more in terms of the total projected area, can also be preferably used. The term "aspect ratio" refers to the value obtained by dividing the diameter of the circle having an area equivalent to the projected area of an individual grain by the thickness of the grain. In the present invention, cubic grains, or tabular grains having {100} planes as major faces, or tabular grains having {111} planes as major faces are preferably used.

As a silver halide emulsion which can be used in the present invention, for example, silver chloride, silver bromide, silver iodobromide, or silver chloro(iodo)bromide emulsion may be used. From a viewpoint of rapid processing, it is preferable to use a silver chloride, silver chlorobromide, silver chloroiodide, or silver chlorobromoiodide emulsion, having a silver chloride content of 90 mol % or greater; more preferably silver chloride, silver chlorobromide, silver chloroiodide, or silver chlorobromoiodide emulsion, having a silver chloride content of 98 mol % or greater. Preferred of these silver halide emulsions are those having in the shell parts of silver halide grains, a silver iodide-localized phase (preferably a silver iodochloride phase) with a silver iodide content of 0.01 to 0.50 mol %, more preferably 0.05 to 0.40 mol %, per mol of the total silver, in view of high sensitivity and excellent high illumination intensity exposure suitability. Further, especially preferred of these silver halide emulsions are those containing silver halide grains having on the surface thereof a silver bromide-localized phase with a silver bromide content of 0.2 to 5 mol %, more preferably 0.5 to 3 mol %, per mol of the total silver, since both high sensitivity and stabilization of photographic properties are attained.

The silver halide emulsion for use in the present invention, preferably contains silver iodide. In order to introduce iodide ions, an iodide salt solution may be added alone, or it may be added in combination with both a silver salt solution and a high chloride salt solution. In the latter case, the iodide salt solution and the high chloride salt solution may be added separately or as a mixture solution of these salts of iodide and high chloride. The iodide salt is generally added in the form of a soluble salt, such as an alkali or alkali earth iodide salt. Alternatively, iodide ions may be introduced by cleaving the iodide ions from an organic molecule, as described in U.S. Pat. No. 5,389,508. As another source of iodide ion, fine silver iodide grains may be used.

The addition of an iodide salt solution may be concentrated at one time of grain formation process or may be performed over a certain period of time. For obtaining an emulsion with high sensitivity and low fog, the position of introducing an iodide ion to a high chloride emulsion is limited. The deeper in the emulsion grain the iodide ion is introduced, the smaller is the increment of sensitivity. Accordingly, the addition of an iodide salt solution is preferably started at 50% or outer side of the volume of a grain, more preferably 70% or outer side, and most preferably 85% or outer side. Moreover, the addition of an iodide salt solution is preferably finished at 98% or inner side of the volume of a grain, more preferably 96% or inner side. By finishing the addition of an iodide salt solution at a little inner side of the grain surface, an emulsion having higher sensitivity and lower fog can be obtained.

The distribution of an iodide ion concentration in the depth direction in a grain can be measured according to an etching/TOF-SIMS (Time of Flight-Secondary Ion Mass Spectrometry) method by means of, for example, a TRIFT II Model TOF-SIMS (trade name) manufactured by Phi Evans Co. A TOF-SIMS method is specifically described in Nippon Hyomen Kagakukai edited, *Hyomen Bunseki Gijutsu Sensho Niji Ion Shitsuryo Bunsekiho* (*Surface Analysis Technique Selection Secondary Ion Mass Spectrometry*), Maruzen Co., Ltd. (1999). When an emulsion grain is analyzed by the etching/TOF-SIMS method, it can be analyzed that there are iodide ions oozed toward the surface of the grain, even though the addition of an iodide salt solution is finished at an inner side of the grain. When an emulsion for use in the present invention contains silver iodide, it is preferred that the grain has the maximum concentration of iodide ion at the surface of the grain, and the iodide ion concentration decreases inwardly in the grain, by analysis with the etching/TOF-SIMS method.

The emulsion grains for use in the light-sensitive material of the present invention preferably have a silver bromide localized phase.

When the emulsion grains for use in the present invention each contain a silver bromide localized phase, the silver bromide localized phase is preferably formed by epitaxial growth of the localized phase having a silver bromide content of at least 10 mol % on the grain surface. Further, the emulsion grains preferably have the outermost shell portion having a silver bromide content of at least 1 mol % or more in the vicinity of the surface of the grains.

The silver bromide content of the silver bromide localized phase is preferably in the range of 1 to 80 mol %, and most preferably in the range of 5 to 70 mol %. The silver bromide localized phase is preferably composed of silver having population of 0.1 to 30 mol %, more preferably 0.3 to 20 mol %, to the molar amount of entire silver which constitutes silver halide grains for use in the present invention. The silver bromide localized phase is preferably doped with complex ions of a metal of the Group VIII, such as iridium ion. The amount of these compounds to be added can be varied in a wide range depending on the purposes, and it is preferably in the range of $1\times10^{-9}$ to $1\times10^{-2}$ mol, per mol of silver halide.

In the present invention, ions of a transition metal are preferably added in the course of grain formation and/or growth of the silver halide grains, to include the metal ions in the inside and/or on the surface of the silver halide grains. The metal ions to be used are preferably ions of a transition metal. Preferable examples of the transition metal are iron, ruthenium, iridium, osmium, lead, cadmium, or zinc. Further, 6-coordinated octahedral complex salts of these metal ions which have ligands, are more preferably used. When employing an inorganic compound as a ligand, cyanide ion, halide ion, thiocyanato, hydroxide ion, peroxide ion, azide ion, nitrite ion, water, ammonia, nitrosyl ion, or thionitrosyl ion are preferably used. Such ligand is preferably coordinated to any one of the metal ions selected from the above-mentioned iron, ruthenium, iridium, osmium, lead, cadmium, and zinc. Two or more kinds of these ligands are also preferably used in one complex molecule.

Among them, the silver halide emulsion for use in the present invention particularly preferably contains an iridium ion having at least one organic ligand for the purpose of improving reciprocity failure at a high illuminance.

Though it is also common in the case of other transition metal, when an organic compound is used as a ligand, preferable examples of the organic compound include chain compounds having a main chain of 5 or less carbon atoms and/or heterocyclic compounds of 5- or 6-membered ring. More preferable examples of the organic compound are those having at least a nitrogen, phosphorus, oxygen, or sulfur atom in a molecule as an atom which is capable of coordinating to a metal. Most preferred organic compounds are furan, thiophene, oxazole, isooxazole, thiazole, isothiazole, imidazole, pyrazole, triazole, furazane, pyran, pyridine, pyridazine, pyrimidine, and pyrazine. Further, organic compounds which have a substituent introduced into a basic skeleton of the above-mentioned compounds are also preferred.

Among these compounds, 5-methylthiazole among thiazole ligands is particularly preferably used as the ligand preferable for iridium ion.

Preferable combinations of a metal ion and a ligand are those of the iron and/or ruthenium ion and the cyanide ion. Preferred of these compounds are those in which the number of cyanide ions accounts for the majority of the coordination number (site) intrinsic to the iron or ruthenium that is the central metal. The remaining coordination sites are preferably occupied by thiocyanato, ammonio, aquo, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. Such metal complexes composed of these cyanide ion ligands are preferably added during grain formation in an amount of $1\times10^{-8}$ mol to $1\times10^{-2}$ mol, most preferably $1\times10^{-6}$ mol to $5\times10^{-4}$ mol, per mol of silver.

In case of the iridium complex, preferable ligands are fluoride, chloride, bromide, and iodide ions, not only said organic ligands. Among these ligands, chloride and bromide ions are more preferably used. Specifically, preferable iridium complexes that can be used in the present invention include the following compounds, in addition to those having the above organic ligands: $[IrCl_6]^{3-}$, $[IrCl_6]^{2-}$, $[IrCl_5(H_2O)]^{2-}$, $[IrCl_5(H_2O)]^{-}$, $[IrCl_4(H_2O)_2]^{-}$, $[IrCl_4(H_2O)_2]^{0}$, $[IrCl_3(H_2O)_3]^{0}$, $[IrCl_3(H_2O)_3]^{+}$, $[IrBr_6]^{3-}$, $[IrBr_6]^{2-}$, $[IrBr_5(H_2O)]^{2-}$, $[IrBr_5(H_2O)]^{-}$, $[IrBr_4(H_2O)_2]^{-}$, $[IrBr_4(H_2O)_2]^{0}$, $[IrBr_3(H_2O)_3]^{0}$, and $[IrBr_3(H_2O)_3]^{+}$.

These iridium complexes are preferably added during grain formation in an amount of $1\times10^{-10}$ mol to $1\times10^{-3}$ mol, most preferably $1\times10^{-8}$ mol to $1\times10^{-5}$ mol, per mol of silver. In case of the ruthenium complex and the osmium complex, nitrosyl ion, thionitrosyl ion, or water molecule is also preferably used in combination with chloride ion, as ligands. More preferably these ligands form a pentachloronitrosyl complex, a pentachlorothionitrosyl complex, or a pentachloroaquo complex. The formation of a hexachloro complex is also preferred. These complexes are preferably added during grain formation in an amount of $1\times10^{-10}$ mol to $1\times10^{-6}$ mol, more preferably $1\times10^{-9}$ mol to $1\times10^{-6}$ mol, per mol of silver.

In the present invention, the above-mentioned complexes are preferably added directly to the reaction solution at the time of silver halide grain formation, or indirectly to the grain-forming-reaction solution via addition to an aqueous halide solution for forming silver halide grains or other solutions, so that they are doped to the inside of the silver halide grains. Further, these methods are preferably combined to incorporate the complex into the inside of the silver halide grains.

In case where these metal complex is doped to the inside of the silver halide grains, the metal complex is preferably uniformly distributed in the inside of the grains. On the other hand, as disclosed in JP-A-4-208936, JP-A-2-125245 and JP-A-3-188437, the metal complex is also preferably distributed only in the grain surface layer. Alternatively, the metal complex is also preferably distributed only in the inside of the grain, while the grain surface is covered with a layer free from the metal complex. Further, as disclosed in U.S. Pat. Nos. 5,252,451 and 5,256,530, it is also preferred that the silver halide grains are subjected to physical ripening in the presence of fine grains having the metal complex incorporated therein, to modify the grain surface phase. Further, these methods may be used in combination. Two or more kinds of metal complexes may be incorporated in the inside of an individual silver halide grain. There is no particular restriction on the halogen composition at the location where the above-mentioned metal complexes are incorporated, and they are preferably incorporated in any layer selected from a silver chloride layer, a silver chlorobromide layer, a silver bromide layer, a silver iodochloride layer, and a silver iodobromide layer.

The silver halide grains contained in the silver halide emulsion for use in the present invention have an average grain size (the grain size herein means the diameter of the circle equivalent to the projected area of the grain, and the number average thereof is taken as the average grain size) of preferably from 0.01 μm to 2 μm.

The grain size distribution is preferably a state of so-called "mono-dispersion" having coefficient of variation (the value obtained by dividing a standard deviation of grain size distribution by an average grain size) of generally 20% or less, preferably 15% or less, more preferably 10% or less. Further in order to attain wide latitude, two or more kinds of the above-mentioned mono-dispersion emulsions are preferably blended in the same layer, or coated to form separate layers (multi-coating layers).

Various compounds or precursors thereof can be included in the silver halide emulsion for use in the present invention, to prevent fogging from occurring or to stabilize photographic performance, during manufacture, storage, or photographic processing of the photosensitive material. Specific examples of compounds useful for the above purposes are disclosed in JP-A-62-215272, pages 39 to 72, and they can be preferably used. In addition, 5-arylamino-1,2,3,4-thiatriazole compounds (the aryl residual group has at least one electron-attractive group) disclosed in European Patent No. 0447647 can also be preferably used.

Further, in order to enhance storage stability of the silver halide emulsion for use in the present invention, it is also preferred in the present invention to use hydroxamic acid derivatives described in JP-A-11-109576; cyclic ketones having a double bond adjacent to a carbonyl group, both ends of said double bond being substituted with an amino group or a hydroxyl group, as described in JP-A-11-327094 (particularly compounds represented by formula (S1); the description at paragraph Nos. 0036 to 0071 of JP-A-11-327094 is incorporated herein by reference); sulfo-substituted catecols and hydroquinones described in JP-A-11-143011 (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts of these acids); water-soluble reducing agents represented by formula (I), (II), or (III) of JP-A-11-102045.

Spectral sensitization can be carried out for the purpose of imparting spectral sensitivity in a desired light wavelength region to the emulsion in each layer of the photosensitive material of the present invention.

Examples of spectral sensitizing dyes, which can be used in the photosensitive material of the present invention, for spectral sensitization of blue, green, and red light regions, include, for example, those disclosed by F. M. Harmer, in *Heterocyclic Compounds—Cyanine Dyes and Related Compounds*, John Wiley & Sons, New York, London (1964).

Specific examples of compounds and spectral sensitization processes that are preferably used in the present invention include those described in JP-A-62-215272, from page 22, right upper column to page 38. In addition, the spectral sensitizing dyes described in JP-A-3-123340 are very preferred as red-sensitive spectral sensitizing dyes for silver halide emulsion grains having a high silver chloride content, from the viewpoint of stability, adsorption strength, temperature dependency of exposure, and the like.

The amount of these spectral sensitizing dyes to be added can be varied in a wide range depending on the occasion, and it is preferably in the range of $0.5\times10^{-6}$ mole to $1.0\times10^{-2}$ mole, more preferably in the range of $1.0\times10^{-6}$ mole to $5.0\times10^{-3}$ mole, per mole of silver halide.

The silver halide emulsions for use in the present invention are generally chemically sensitized. Chemical sensitization can be performed by utilizing sulfur sensitization, represented by the addition of an unstable sulfur compound; noble metal sensitization represented by gold sensitization, and reduction sensitization, each singly or in combination thereof.

Compounds that are preferably used for chemical sensitization include those described in JP-A-62-215272, from page 18, right lower column to page 22, right upper column. Of these, gold-sensitized silver halide emulsion are particularly preferred, since a change in photographic properties which occurs when scanning exposure with laser beams or the like is conducted, can be further reduced by gold sensitization.

In order to conduct gold sensitization to the silver halide emulsion to be used in the present invention, various inorganic gold compounds, gold (I) complexes having an inorganic ligand, and gold (I) compounds having an organic ligand may be used. Inorganic gold compounds, such as chloroauric acid or salts thereof; and gold (I) complexes having an inorganic ligand, such as dithiocyanato gold compounds (e.g., potassium dithiocyanatoaurate (I)), and dithiosulfato gold compounds (e.g., trisodium dithiosulfatoaurate (I)), are preferably used.

As the gold (I) compounds having an organic ligand, the bis gold (I) mesoionic heterocycles described in JP-A-4-267249, for example, gold (I) tetrafluoroborate bis(1,4,5-trimethyl-1,2,4-triazolium-3-thiolate); the organic mercapto gold (I) complexes described in JP-A-11-218870, for example, potassium bis(1-[3-(2-sulfonatobenzamido)phenyl]-5-mercaptotetrazole potassium salt) aurate (I) pentahydrate; and the gold (I) compound with a nitrogen compound anion coordinated therewith, as described in JP-A-4-268550, for example, gold (I) bis(1-methylhydantoinate) sodium salt tetrahydrate may be used. Also, the gold (I) thiolate compound described in U.S. Pat. No. 3,503,749, the gold compounds described in JP-A-8-69074, JP-A-8-69075, and JP-A-9-269554, and the compounds described in U.S. Pat. No. 5,620,841, U.S. Pat. No. 5,912,112, U.S. Pat. No. 5,939,245, and U.S. Pat. No. 5,912,111 may be used.

The amount of these compounds to be added can be varied in a wide range depending on the occasion, and it is generally in the range of $5\times10^{-7}$ mole to $5\times10^{-3}$ mole, preferably in the range of $5\times10^{-6}$ mole to $5\times10^{-4}$ mole, per mole of silver halide.

The silver halide emulsion for use in the present invention can be subjected to gold sensitization using a colloidal gold sulfide. A method of producing the colloidal gold sulfide is described in, for example, *Research Disclosure*, No. 37154, *Solid State Ionics*, Vol. 79, pp. 60 to 66 (1995), and *Compt. Rend. Hebt. Seances Acad. Sci. Sect. B*, Vol. 263, p. 1328 (1996). Colloidal gold sulfide having various grain sizes are applicable, and even those having a grain diameter of 50 nm or less can also be used. The amount of the colloidal gold sulfide to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, per mol of silver halide, in terms of gold atom.

In the present invention, gold sensitization may be used in combination with other sensitizing methods, for example, sulfur sensitization, selenium sensitization, tellurium sensitization, reduction sensitization, and noble metal sensitization using a noble metal compound other than gold compound.

The light-sensitive material of the present invention preferably contains, in its hydrophilic colloid layer, a dye (particularly an oxonole dye or cyanine dye) that can be discolored by processing, as described in European Patent No. 0337490 A2, pages 27 to 76, in order to prevent irradiation or halation, or to enhance safelight safety (immunity), or the like. Further, dyes described in European Patent No. 0819977 A are also preferably used in the present invention. Among these water-soluble dyes, some deteriorate color separation or safelight safety when used in an increased amount. Preferable examples of the dye which can be used and which does not deteriorate color separation include water-soluble dyes described in JP-A-5-127324, JP-A-5-127325, and JP-A-5-216185.

In the present invention, it is possible to use a colored layer which can be discolored during processing, in place of the water-soluble dye, or in combination with the water-soluble dye. The colored layer that can be discolored with processing, to be used, may contact with an emulsion layer directly, or indirectly through an intermediate layer containing an agent for preventing color-mixing during processing, such as gelatin and hydroquinone. The colored layer is preferably provided as a lower layer (closer to a support) with respect to the emulsion layer which develops the same primary color as the color of the colored layer. It is possible to provide colored layers independently, each corresponding to respective primary colors. Alternatively, any one or more layers selected from the above colored layers may be provided. In addition, it is possible to provide a colored layer subjected to coloring so as to match a plurality of primary-color regions. About the optical reflection density of the colored layer, it is preferred that, at the wavelength which provides the highest optical density in a range of wavelengths used for exposure (a visible light region from 400 nm to 700 nm for an ordinary printer exposure, and the wavelength of the light generated from the scanning-exposure light source to be used in the case of scanning exposure), the optical density is within the range of 0.2 to 3.0, more preferably 0.5 to 2.5, and particularly preferably 0.8 to 2.0.

The colored layer described above may be formed by applying a known method. For example, can be mentioned a method in which a dye in a state of a dispersion of solid fine particles is incorporated in a hydrophilic colloid layer, with respect to dyes as described in JP-A-2-282244, from page 3, upper right column to page 8, and JP-A-3-7931, from page 3, upper right column to page 11, left under column; a method in which an anionic dye is mordanted in a cationic polymer, a method in which a dye is adsorbed onto fine grains of silver halide or the like and fixed in the layer, and a method in which a colloidal silver is used as described in JP-A-1-239544. As to a method of dispersing fine-powder of a dye in solid state, for example, JP-A-2-308244, pages 4 to 13 describes a method of incorporating fine particles of dye which is at least substantially water-insoluble at the pH of 6 or less, but substantially water-soluble at least at the pH of 8 or more. A method of mordanting an anionic dye in a cationic polymer is described, for example, in JP-A-2-84637, pages 18 to 26. U.S. Pat. Nos. 2,688,601 and 3,459,563 disclose a method of preparing a colloidal silver for use as a light absorber. Among these methods, preferred are the method of incorporating fine particles of dye, and the method of using colloidal silver.

When the present invention is applied to color printing papers, it preferably has at least one yellow color-forming silver halide emulsion layer, at least one magenta color-forming silver halide emulsion layer, and at least one cyan color-forming silver halide emulsion layer, on a support. Generally, these silver halide emulsion layers are in the order, from the support, of the yellow color-forming silver halide emulsion layer, the magenta color-forming silver halide emulsion layer, and the cyan color-forming silver halide emulsion layer.

However, other layer arrangements which are different from the above, may be adopted.

In the present invention, a yellow coupler-containing silver halide emulsion layer may be provided at any position on a support. In the case where silver halide tabular grains are contained in the yellow-coupler-containing layer, it is preferable that the yellow-coupler-containing layer be positioned more apart from a support than at least one of a magenta-coupler-containing silver halide emulsion layer and a cyan-coupler-containing silver halide emulsion layer. Further, it is preferable that the yellow-coupler-containing silver halide emulsion layer be positioned most apart from a support than other silver halide emulsion layers, from the viewpoint of color-development acceleration, desilvering acceleration, and reducing residual color due to a sensitizing dye. Further, it is preferable that the cyan-coupler-containing silver halide emulsion layer be disposed in the middle of the other silver halide emulsion layers, from the viewpoint of reducing blix fading. On the other hand, it is preferable that the cyan-coupler-containing silver halide emulsion layer be the lowest layer, from the viewpoint of reducing light fading. Further, each of the yellow-color-forming layer, the magenta-color-forming layer, and the cyan-color-forming layer may be composed of two or three layers. It is also preferable that a color-forming layer be formed by providing a silver-halide-emulsion-free layer containing a coupler in adjacent to a silver halide emulsion layer, as described in, for example, JP-A-4-75055, JP-A-9-114035, JP-A-10-246940, and U.S. Pat. No. 5,576,159.

For example, as a photographic support (base) for use in the present invention, a transmissive type support or a reflective type support may be used. As the transmissive type support, it is preferred to use a transparent film, such as a cellulose nitrate film, a polyethyleneterephthalate, and a cellulose triacetate film; or a film, for example, of a polyester of 2,6-naphthalenedicarboxylic acid (NDCA) and ethylene glycol (EG), or a polyester of NDCA, terephthalic acid, and EG, which film is provided with an information-recording layer such as a magnetic layer. In the present invention, a reflective support (reflective-type support) is preferable. As the reflective type support, it is especially preferable to use a reflective support having a substrate laminated thereon with a plurality of polyethylene layers or polyester layers (water-proof resin layers or laminate layers), at least one of which contains a white pigment such as titanium oxide.

Preferred examples of silver halide emulsions and other materials (additives or the like) that can be used in the present invention, photographic constitutional layers (arrangement of the layers or the like), and processing methods for processing the photographic materials and additives for processing, are disclosed in JP-A-62-215272, JP-A-2-33144, and European Patent No. 0355660 A2. Particularly, those disclosed in European Patent No. 0355660 A2 are preferably used. Further, it is also preferred to use silver halide color photographic light-sensitive materials and processing methods thereof disclosed in, for example, JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641, and European Patent Publication No. 0520457 A2.

In particular, as the above-described support and silver halide emulsion, as well as the different kinds of metal ions to be doped in the silver halide grains, the storage stabilizers or antifogging agents of the silver halide emulsion, the methods of chemical sensitization (sensitizers), the methods of spectral sensitization (spectral sensitizers), the cyan, magenta, and yellow couplers and the emulsifying and dispersing methods thereof, the dye-image-stability-improving agents (stain inhibitors and discoloration inhibitors), the dyes (coloring layers), the kinds of gelatin, the layer structure of the light-sensitive material, and the film pH of the light-sensitive material, those described in the patent publications as shown in the following table are particularly preferably used in the present invention.

TABLE 1

| Element | JP-A-7-104448 | JP-A-7-77775 | JP-A-7-301895 |
|---|---|---|---|
| Reflective type supports | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptoheterocyclic compounds) |
| Chemical sensitizing methods (Chemical sensitizers) | Column 74, line 45 to Column 75, line 6 | Column 47, lines 7 to 17 | Column 81, lines 9 to 17 |
| Spectral sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (coloring agents) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| Film pH of light-sensitive materials | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developer | Column 88, line 19 to Column 89, line 22 | | |

As cyan, magenta, and yellow couplers which can be used in the present invention, in addition to the above mentioned ones, those disclosed in JP-A-62-215272, page 91, right upper column, line 4 to page 121, left upper column, line 6, JP-A-2-33144, page 3, right upper column, line 14 to page 18, left upper column, bottom line, and page 30, right upper column, line 6 to page 35, right under column, line 11, European Patent No. 0355,660 (A2), page 4, lines 15 to 27, page 5, line 30 to page 28, bottom line, page 45, lines 29 to 31, page 47, line 23 to page 63, line 50, are also advantageously used.

Further, it is preferred for the present invention to add compounds represented by formula (II) or (III) in WO 98/33760 and compounds represented by formula (D) described in JP-A-10-221825.

As the cyan dye-forming coupler (hereinafter also simply referred to as "cyan coupler") which can be used in the present invention, pyrrolotriazole-series couplers are preferably used, and more specifically, couplers represented by formula (I) or (II) in JP-A-5-313324, and couplers represented by formula (I) in JP-A-6-347960 are preferred. Exemplified couplers described in these publications are particularly preferred. Further, phenol-series or naphthol-series cyan couplers are also preferred. For example, cyan couplers represented by formula (ADF) described in JP-A-10-333297 are preferred. Preferable examples of cyan couplers other than the foregoing cyan couplers, include pyrroloazole-type cyan couplers described in European Patent Nos. 0 488 248 and 0 491 197 (A1), 2,5-diacylamino phenol couplers described in U.S. Pat. No. 5,888,716; pyrazoloazole-type cyan couplers having an electron-withdrawing group or a group bonding via hydrogen bond at the 6-position, as described in U.S. Pat. Nos. 4,873,183 and 4,916,051; and particularly, pyrazoloazole-type cyan couplers having a carbamoyl group at the 6-position, as described in JP-A-8-171185, JP-A-8-311360, and JP-A-8-339060.

In addition, as a cyan coupler, use can also be made of a diphenylimidazole-series cyan coupler described in JP-A-2-33144; as well as a 3-hydroxypyridine-series cyan coupler (particularly a 2-equivalent coupler formed by allowing a 4-equivalent coupler of a coupler (42), to have a chlorine splitting-off group, and couplers (6) and (9), enumerated as specific examples are particularly preferable) described in European patent 0333185 A2; a cyclic active methylene-series cyan coupler (particularly couplers 3, 8, and 34 enumerated as specific examples are particularly preferable) described in JP-A-64-32260; a pyrrolopyrozole-type cyan coupler described in European Patent No. 0456226 A1; and a pyrroloimidazole-type cyan coupler described in European Patent No. 0484909.

Among these cyan couplers, pyrroloazole-series cyan couplers represented by formula (I) described in JP-A-11-282138 are particularly preferred. The descriptions of the paragraph Nos. 0012 to 0059 including exemplified cyan couplers (1) to (47) of the above JP-A-11-282138 can be entirely applied to the present invention, and therefore they are preferably incorporated herein by reference as a part of the present specification.

The magenta dye-forming couplers (which may be referred to simply as a "magenta coupler" hereinafter) that can be used in the present invention can be 5-pyrazolone-series magenta couplers and pyrazoloazole-series magenta couplers, such as those described in the above-mentioned patent publications in the above table. Among these, preferred are pyrazolotriazole couplers in which a secondary or tertiary alkyl group is directly bonded to the 2-, 3-, or 6-position of the pyrazolotriazole ring, such as those described in JP-A-61-65245; pyrazoloazole couplers having a sulfonamido group in its molecule, such as those described in JP-A-61-65246; pyrazoloazole couplers having an alkoxyphenylsulfonamido ballasting group, such as those described in JP-A-61-147254; and pyrazoloazole couplers having an alkoxy or aryloxy group at the 6-position, such as those described in European Patent Nos. 226849 A and 294785 A, in view of hue and stability of an image to be formed therefrom, and color-forming property of the couplers. Particularly, as the magenta coupler, pyrazoloazole couplers represented by formula (M-I) described in JP-A-8-122984 are preferred. The descriptions of paragraph Nos. 0009 to 0026 of the patent publication JP-A-8-122984 can be entirely applied to the present invention, and therefore are incorporated herein by reference as a part pf the present specification. In addition, pyrazoloazole couplers having a steric hindrance group at both the 3- and 6-positions, as described in European Patent Nos. 854384 and 884640, can also be preferably used.

Further, as yellow dye-forming couplers (which may be referred to simply as a "yellow coupler" herein), preferably use can be made, in the present invention, of acylacetamide-type yellow couplers in which the acyl group has a 3-membered to 5-membered cyclic structure, such as those described in European Patent No. 0447969 A1; malondianilide-type yellow couplers having a cyclic structure, as described in European Patent No. 0482552 A1; pyrrol-2 or 3-yl or indol-2 or 3-yl carbonyl acetanilide-series couplers, as described in European Patent (laid open to public) Nos. 953870 A1, 953871 A1, 953872 A1, 953873 A1, 953874 A1, and 953875 A1; acylacetamide-type yellow couplers having a dioxane structure, such as those described in U.S. Pat. No. 5,118,599; acetanilide-type couplers bonded with N-alkyl-4-pyrimidone, such as those described in JP-A-2002-296740, JP-A-2002-296741, JP-A-2002-318443, JP-A-2002-318442; and acetate or acetanilide-type couplers bonded with 1,2,4-benzothiadiazine-1,1-dioxide, such as those described in JP-A-2003-173007, in addition to the compounds described in the above-mentioned table. Of these couplers, the acylacetamide-type yellow couplers whose acyl groups are 1-alkylcyclopropane-1-carbonyl groups, the malondianilide-type yellow couplers wherein either anilide forms an indoline ring, the acetanilide couplers bonded with N-alkyl-4-pyrimidones, and the acetate or acetanilide-type couplers bonded with 1,2,4-benzothiadiazine-1,1-dioxide are used to advantage. In particular, the acetate or acetanilide-type couplers bonded with 1,2,4-benzothiadiazine-1,1-dioxide are preferred over the others. These couplers may be used singly or in combination.

It is preferred that couplers for use in the present invention, are pregnated into a loadable latex polymer (as described, for example, in U.S. Pat. No. 4,203,716) in the presence (or absence) of the high-boiling-point organic solvent described in the foregoing table, or they are dissolved in the presence (or absence) of the foregoing high-boiling-point organic solvent with a polymer insoluble in water but soluble in an organic solvent, and then emulsified and dispersed into an aqueous hydrophilic colloid solution. Examples of the water-insoluble but organic-solvent-soluble polymer which can be preferably used, include the homopolymers and co-polymers as disclosed in U.S. Pat. No. 4,857,449, from column 7 to column 15, and WO 88/00723, from page 12 to page 30. The use of methacrylate-series or acrylamide-series polymers, especially acrylamide-series polymers are more preferable, in view of color-image stabilization and the like.

In the present invention, as an ultraviolet ray absorbent, it is preferred to use compounds having a high molar extinction coefficient and a triazine skeleton. For example, compounds described in the following patent publications can be used. These compounds are preferably added to the light-sensitive layer or/and the light-insensitive layer. For example, use can be made of those described, in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368; JP-A-9-31067, JP-A-10-115898, JP-A-10-147577, JP-A-10-182621, German Patent No. 19,739,797A, European Patent No. 0,711,804 A and JP-T-8-501291 ("JP-T" means searched and published International patent application), and the like.

As the binder or protective colloid which can be used in the light-sensitive material of the present invention, gelatin is used advantageously, but another hydrophilic colloid can be used singly or in combination with gelatin. It is preferable for the gelatin that the content of heavy metals, such as Fe, Cu, Zn, and Mn, included as impurities, be reduced to 5 ppm or below, more preferably 3 ppm or below. Further, the amount of calcium contained in the light-sensitive material is preferably 20 mg/m$^2$ or less, more preferably 10 mg/m$^2$ or less, and most preferably 5 mg/m$^2$ or less.

In the present invention, it is preferred to add an antibacterial (fungi-preventing) agent and antimold agent, as described in JP-A-63-271247, in order to destroy various kinds of molds and bacteria which propagate in a hydrophilic colloid layer and deteriorate the image. Further, the pH of coating film of the light-sensitive material is preferably in the range of 4.0 to 7.0, more preferably in the range of 4.0 to 6.5.

In the present invention, a surface-active agent may be added to the light-sensitive material, in view of improvement in coating-stability, prevention of static electricity from being occurred, and adjustment of the charge amount. As the surface-active agent, mention can be made of anionic, cationic, betaine, and nonionic surfactants. Examples thereof include those described in JP-A-5-333492. As the surface-active agent that can be used in the present invention, a fluorine-containing surface-active agent is particularly preferred. The fluorine-containing surface-active agent may be used singly, or in combination with known other surface-active agent. The fluorine-containing surfactant is preferably used in combination with known other surface-active agent. The amount of the surface-active agent to be added to the light-sensitive material is not particularly limited, but it is generally in the range of $1\times10^{-5}$ to 1 g/m$^2$, preferably in the range of $1\times10^{-4}$ to $1\times10^{-1}$ g/m$^2$, and more preferably in the range of $1\times10^{-3}$ to $1\times10^{-2}$ g/m$^2$.

The photosensitive material of the present invention can form an image, via an exposure step in which the photosensitive material is irradiated with light according to image information, and a development step in which the photosensitive material irradiated with light is developed.

The light-sensitive material of the present invention can preferably be used, in a scanning exposure system using a cathode ray tube (CRT), in addition to the printing system using a usual negative printer. The cathode ray tube exposure apparatus is simpler and more compact, and therefore less expensive than an apparatus using a laser. Further, optical axis and color (hue) can easily be adjusted. In a cathode ray tube which is used for image-wise exposure, various light-emitting materials which emit a light in the spectral region, are used as occasion demands. For example, any one of red-light-emitting materials, green-light-emitting materials, blue-light-emitting materials, or a mixture of two or more of these light-emitting materials may be used. The spectral regions are not limited to the above red, green, and blue, and fluorophoroes which can emit a light in a region of yellow, orange, purple, or infrared can be used. Particularly, a cathode ray tube which emits a white light by means of a mixture of these light-emitting materials, is often used.

In the case where the light-sensitive material has a plurality of light-sensitive layers each having different spectral sensitivity distribution from each other, and also the cathode ray tube has a fluorescent substance which emits light in a plurality of spectral regions, exposure to a plurality of colors may be carried out at the same time. Namely, a plurality of color image signals may be input into a cathode ray tube, to allow light to be emitted from the surface of the tube.

Alternatively, a method in which an image signal of each of colors is successively input and light of each of colors is emitted in order, and then exposure is carried out through a film capable of cutting a color other than the emitted color, i.e., an area (or surface) sequential exposure, may be used. Generally, among these methods, the area sequential exposure is preferred from the viewpoint of high image quality enhancement, because a cathode ray tube having a high resolving power can be used.

The light-sensitive material of the present invention can preferably be used in the digital scanning exposure system using monochromatic high density light, such as a gas laser, a light-emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a solid state laser or a semiconductor laser, to make a system more compact and inexpensive. In particular, to design a compact and inexpensive apparatus having a longer duration of life and high stability, use of a semiconductor laser is preferable; and it is preferred that at least one of exposure light sources be a semiconductor laser.

When such a scanning exposure light source is used, the maximum spectral sensitivity wavelength of the light-sensitive material of the present invention can be arbitrarily set up in accordance with the wavelength of a scanning exposure light source to be used. Since oscillation wavelength of a laser can be made half, using a SHG light source obtainable by a combination of a nonlinear optical crystal with a semiconductor laser or a solid state laser using a semiconductor as an excitation light source, blue light and green light can be obtained. Accordingly, it is possible to have the spectral sensitivity maximum of a light-sensitive material in usual three wavelength regions of blue, green, and red. The exposure time in such a scanning exposure is defined as the time period necessary to expose the size of the picture element (pixel) with the density of the picture element being 400 dpi, and a preferred exposure time is $1\times10^{-4}$ sec or less, more preferably $1\times10^{-6}$ sec or less. Particularly preferably, the exposure is carried out by scanning exposure, wherein the exposure time is $1\times10^{-8}$ to $1\times10^{-4}$ sec per picture element and adjacent rasters are overlapped (the overlap between rasters is preferably in the range of from ⅛ to ⅞, more preferably in the range of from ⅕ to ⅘), because improvement is made with respect to the reciprocity law failure. Preferable scanning exposure systems that can be applied to the present invention are described in detail in the patent publications in the aforementioned table.

As an exposure apparatus that is preferably used in the present invention, can be included Digital mini-lab FRONTIER 330 (trade name, manufactured by Fuji Photo Film Co., Ltd.), Lambda 130 (trade name, manufactured by Durst Co.), LIGHTJET 5000 (trade name, manufactured by Gretag Co.), and the like.

The silver halide color photosensitive material of the present invention is preferably used in combination with the exposure and development systems described in the following known literatures. Example of the development system include the automatic print and development system described in JP-A-10-333253, the photosensitive material conveying apparatus described in JP-A-2000-10206, a recording system including the image reading apparatus, as described in JP-A-11-215312, exposure systems with the color image recording method, as described in JP-A-11-88619 and JP-A-10-202950, a digital photo print system including the remote diagnosis method, as described in JP-A-10-210206, and a photo print system including the image recording apparatus, as described in JP-A-2000-310822.

The preferred scanning exposure methods which can be applied to the present invention are described in detail in the publications listed in the table shown above.

It is preferred to use a band stop filter, as described in U.S. Pat. No. 4,880,726, when the light-sensitive material of the present invention is subjected to exposure with a printer. Color mixing of light can be excluded and color reproducibility is remarkably improved by the above means.

In the present invention, a yellow microdot pattern may be previously formed by pre-exposure before giving an image information, to thereby perform a copy restraint, as described in European Patent Nos. 0789270 A1 and 0789480 A1.

In particular, the light-sensitive material of the present invention is preferably applied to a silver halide color photographic light-sensitive material, which comprises a coupler capable of forming a dye upon a coupling reaction with an oxidized product of an aromatic primary amine.

Further, in order to process the photosensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be preferably applied. Further, as the preservative that can be used for this developing solution, compounds described in the patent publications listed in the above Table are preferably used.

The present invention can also be preferably applied to a light-sensitive material having rapid processing suitability. In the case of conducting rapid processing, the color-developing time is preferably 60 sec or less, more preferably from 30 sec to 6 sec, further preferably from 20 sec to 6 sec, and most preferably from 15 sec to 8 sec. Likewise, the blix time is preferably 60 sec or less, more preferably from 30 sec to 6 sec, further preferably from 20 sec to 6 sec, and more preferably 15 sec to 8 sec. Further, the washing or stabilizing time is preferably 150 sec or less, and more preferably from 130 sec to 6 sec.

Herein, the term "color-developing time" as used herein means a period of time required from the beginning of dipping a light-sensitive material into a color developing solution until the light-sensitive material is dipped into a blix solution in the subsequent processing step. For example, when a processing is carried out using an autoprocessor or the like, the color developing time is the sum total of a time in which a light-sensitive material has been dipped in a color developing solution (so-called "time in the solution") and a time in which the light-sensitive material has left the color developing solution and been conveyed in air toward a bleach-fixing bath in the step subsequent to color development (so-called "time in the air"). Likewise, the term "blix time" as used herein means a period of time required from the beginning of dipping a light-sensitive material into a blix solution until the light-sensitive material is dipped into a washing bath or a stabilizing bath in the subsequent processing step. Further, the term "washing or stabilizing time" as used herein means a period of time required from the beginning of dipping a light-sensitive material into a washing solution or a stabilizing solution until the end of the dipping toward a drying step (so-called "time in the solution").

The term "ultra-rapid processing" used in the invention means that a series of operations from photographic processing to drying is accomplished within 80 seconds.

Examples of a development method after exposure, applicable to the light-sensitive material of the present invention, include a conventional wet method, such as a development method using a developing solution containing an alkali agent and a developing agent, and a development method wherein a developing agent is incorporated in the light-sensitive material and an activator solution, e.g., an alkaline solution free of developing agent is employed for the development, as well as a heat development method using no processing solution. In particular, the activator method is preferred over the other methods, because the processing solutions contain no developing agent, thereby it enables easy management and handling of the processing solutions and reduction in waste solution disposal or processing-related load to make for environmental preservation.

The preferable developing agents or their precursors incorporated in the light-sensitive materials in the case of adopting the activator method, include the hydrazine-type compounds described in, for example, JP-A-8-234388, JP-A-9-152686, JP-A-9-152693, JP-A-9-211814 and JP-A-9-160193.

Further, the processing method in which the light-sensitive material reduced in the amount of silver to be applied, undergoes the image amplification processing using hydrogen peroxide (intensification processing), can be employed preferably. In particular, it is preferable to apply this processing method to the activator method. Specifically, the image-forming methods utilizing an activator solution containing hydrogen peroxide, as disclosed in JP-A-8-297354 and JP-A-9-152695 can be preferably used. Although the processing with an activator solution is generally followed by a desilvering step in the activator method, the desilvering step can be omitted in the case of applying the image amplification processing method to photographic materials having a reduced silver amount. In such a case, washing or stabilization processing can follow the processing with an activator solution to result in simplification of the processing process. On the other hand, when the system of reading the image information from light-sensitive materials by means of a scanner or the like, is employed, the processing form requiring no desilvering step can be applied, even if the photographic materials are those having a high silver amount, such as photographic materials for shooting.

As the processing materials and processing methods of the activator solution, desilvering solution (bleach/fixing solution), washing solution and stabilizing solution, which can be used in the present invention, known ones can be used. Preferably, those described in *Research Disclosure*, Item 36544, pp. 536–541 (September 1994), and JP-A-8-234388 can be used in the present invention.

According to the present invention, it is possible, first, to provide a silver halide color photographic light-sensitive material that enables the color developing capability of silver to be drawn out maximally in silver halide emulsion layers, thereby acquiring excellent properties, including being able to reduce the coating amount of silver. Second, the invention can provide a silver halide photographic light-sensitive material that ensures satisfactory developed-color densities even in ultra-rapid processing; that has excellent color formation efficiency relative to the amount of silver coated, and that undergoes slight changes in developed-color densities even when stored under high humidity. Third, the invention can provide a silver halide photographic light-sensitive material that has excellent silver removal and drying characteristics even in ultra-rapid processing. Fourth, the present invention can provide a silver halide photographic light-sensitive material that can exhibit satisfactory image densities even when it has low silver coating amount. Fifth, the present invention can provide a silver halide photographic light-sensitive material that can produce stable images of high quality even with low-replenishment processing.

According to the present invention, it is possible to provide a silver halide photographic light-sensitive material that ensures satisfactory developed-color densities even in ultra-rapid processing; that has excellent color formation efficiency relative to the amount of silver coated; that undergoes slight changes in developed-color densities even when stored under high humidity; and that is excellent in silver removal and drying characteristics.

Further, according to the present invention, it is possible to provide a silver halide photographic light-sensitive material that can exhibit satisfactory image densities even when it has low silver coating amount; that can produce stable images of high quality even with low-replenishment, very-rapid processing.

The present invention will be explained in more detail by way of the following examples, but the invention is not intended to be limited thereto.

EXAMPLES

Example 1

Examples of the Modes According to the Items (2), (3), (4) and (9) of the First Embodiment of the Present Invention (Preparation of Blue-sensitive Layer Emulsion BH-1)

Using a method of simultaneously adding silver nitrate and sodium chloride mixed into stirring deionized distilled water containing deionized gelatin, high silver chloride cubic grains were prepared. In this preparation, at the step of from 60% to 80% addition of the entire silver nitrate amount, $Cs_2[OsCl_5(NO)]$ was added. At the step of from 80% to 90% addition of the entire silver nitrate amount, potassium bromide (1.5 mol % per mol of the finished silver halide) and $K_4[Fe(CN)_6]$ were added. $K_2[IrCl_6]$ was added at the step of from 83% to 88% addition of the entire silver nitrate amount. Further, $K_2[IrCl_5(H_2O)]$ and $K[IrCl_4(H_2O)_2]$ were added at the step of from 92% to 98% addition of the entire silver nitrate amount. Potassium iodide (0.27 mol % per mol of the finished silver halide) was added, with vigorous stirring, at the step of completion of 94% addition of the entire silver nitrate amount. The thus-obtained emulsion grains were monodisperse cubic silver iodobromochloride grains having a side length of 0.54 μm and a variation coefficient of 8.5%. After being subjected to a sedimentation desalting treatment, the following were added to the resulting emulsion: gelatin, Compounds Ab-1, Ab-2, and Ab-3, and calcium nitrate, and the emulsion was re-dispersed.

Compound Ab-1

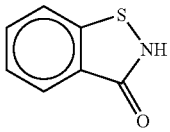

Compound Ab-2

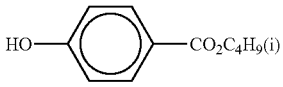

Compound Ab-3

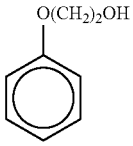

The re-dispersed emulsion was dissolved at 40° C., and sensitizing dye S-1, sensitizing dye S-2, and sensitizing dye S-3 were added for optimal spectral sensitization. Then, the resulting emulsion was ripened by adding sodium benzene thiosulfate, triethylthiourea as a sulfur sensitizer, and Compound-1 as a gold sensitizer for optimal chemical sensitization. Further, 1-(5-methyl ureidophenyl)-5-mercaptotetrazole; Compound-2; a mixture whose major components are compounds represented by Compound-3 in which the repeating unit (n) is 2 or 3 (both ends $X_1$ and $X_2$ are each a hydroxyl group); Compound-4, and potassium bromide were added, to finalize chemical sensitization. The thus-obtained emulsion was referred to as Emulsion BH-1.

Sensitizing dye S-1

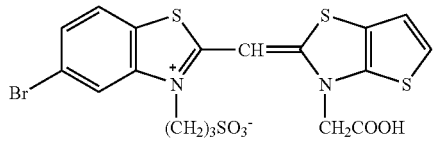

Sensitizing dye S-2

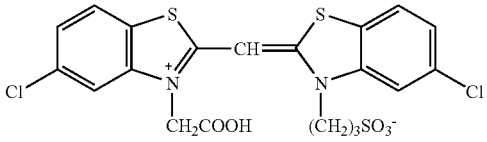

Sensitizing dye S-3

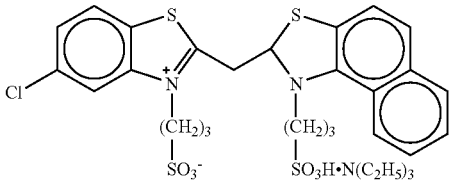

Compound - 1

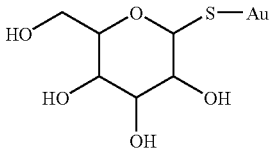

Compound - 2

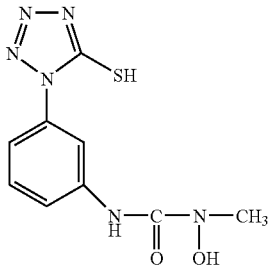

Compound - 3

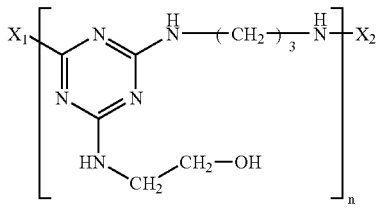

Compound - 4

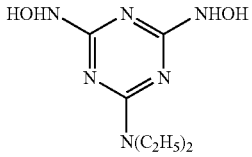

(Preparation of Blue-sensitive Layer Emulsion BL-1)

Emulsion grains were prepared in the same manner as in the preparation of Emulsion BH-1, except that the temperature and the addition rate at the step of mixing silver nitrate and sodium chloride by simultaneous addition were changed, and the amounts of respective metal complexes that were to be added during the addition of the silver nitrate and sodium chloride were changed. The thus-obtained emulsion grains were monodisperse cubic silver iodobromochloride grains having a side length of 0.44 μm and a variation coefficient of 9.5%. After re-dispersion of this emulsion, Emulsion BL-1 was prepared in the same manner as Emulsion BH-1, except that the amounts of compounds to be added in the preparation of BH-1 were changed.

(Preparation of Green-sensitive Layer Emulsion GH-1)

Using a method of simultaneously adding silver nitrate and sodium chloride mixed into stirring deionized distilled water containing a deionized gelatin, high silver chloride cubic grains were prepared. In this preparation, at the step of from 80% to 90% addition of the entire silver nitrate amount, $K_4[Ru(CN)_6]$ was added. At the step of from 80% to 100% addition of the entire silver nitrate amount, potassium bromide (2 mol % per mol of the finished silver halide) was added. Further, $K_2[IrCl_6]$ and $K_2[RhBr_5(H_2O)]$ were added at the step of from 83% to 88% addition of the entire silver nitrate amount. Potassium iodide (0.1 mol % per mol of the finished silver halide) was added with a vigorous stirring, at the step of completion of 90% addition of the entire silver nitrate amount. $K_2[IrCl_5(H_2O)]$ and $K[IrCl_4(H_2O)_2]$ were added at the step of from 92% to 98% addition of the entire silver nitrate amount. The thus-obtained emulsion grains were monodisperse cubic silver iodobromochloride grains having a side length of 0.42 μm and a variation coefficient of 8.0%. The resulting emulsion was subjected to a sedimentation desalting treatment and re-dispersing treatment in the same manner as described in the above.

The re-dispersed emulsion was dissolved at 40° C., and sodium benzenethiosulfate, p-glutaramidophenyldisulfide, sodium thiosulfate pentahydrate as a sulfur sensitizer, and (bis(1,4,5-trimethyl-1,2,4-triazolium-3-thiolate)aurate (I) tetrafluoroborate) as a gold sensitizer were added, and the emulsion was ripened for optimal chemical sensitization. Thereafter, 1-(3-acetamidophenyl)-5-mercaptotetrazole, 1-(5-methylureidophenyl)-5-mercaptotetrazole, Compound-2, Compound-4, and potassium bromide were added. Further, in a midway of the emulsion preparation step, sensitizing dye S-4, sensitizing dye S-5, sensitizing dye S-6, and sensitizing dye S-7 were added as sensitizing dyes, to conduct spectral sensitization. The thus-obtained emulsion was referred to as Emulsion GH-1.

Sensitizing dye S-4

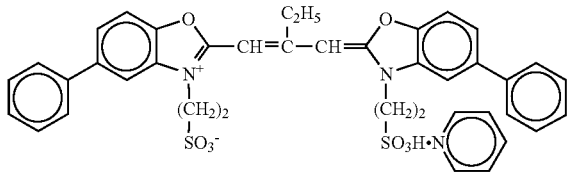

Sensitizing dye S-5

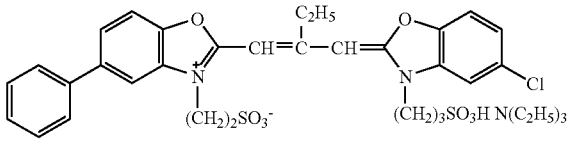

-continued

Sensitizing dye S-6

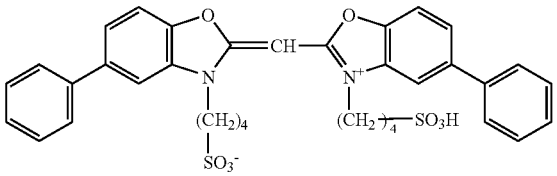

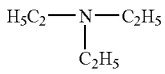

Sensitizing dye S-7

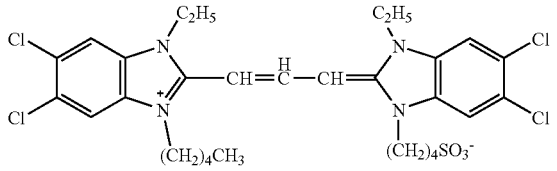

(Preparation of Green-sensitive Layer Emulsion GL-1)

Emulsion grains were prepared in the same manner as in the preparation of Emulsion GH-1, except that the temperature and the addition rate at the step of mixing silver nitrate and sodium chloride by simultaneous addition were changed, and the amounts of respective metal complexes that were to be added during the addition of silver nitrate and sodium chloride were changed. The thus-obtained emulsion grains were monodisperse cubic silver iodobromochloride grains having a side length of 0.35 μm and a variation coefficient of 9.8%. After this emulsion was subjected to re-dispersion, Emulsion GL-1 was prepared in the same manner as Emulsion GH-1, except that the amounts of compounds in the preparation of GH-1 were changed.

(Preparation of Red-sensitive Layer Emulsion RH-1)

Using a method of simultaneously adding silver nitrate and sodium chloride mixed into stirring deionized distilled water containing deionized gelatin, high silver chloride cubic grains were prepared. In this preparation, at the step of from 60% to 80% addition of the entire silver nitrate amount, $CS_2[OSCl_5(NO)]$ was added. At the step of from 80% to 90% addition of the entire silver nitrate amount, $K_4[Ru(CN)_6]$ was added. At the step of from 80% to 100% addition of the entire silver nitrate amount, potassium bromide (1.3 mol % per mol of the finished silver halide) was added. Further, $K_2[IrCl_5(5\text{-methylthiazole})]$ was added at the step of from 83% to 88% addition of the entire silver nitrate amount. Potassium iodide (0.05 mol % per mol of the finished silver halide) was added, with vigorous stirring, at the step of completion of 88% addition of the entire silver nitrate amount. Further, $K_2[IrCl_5(H_2O)]$ and $K[IrCl_4(H_2O)_2]$ were added at the step of from 92% to 98% addition of the entire silver nitrate amount. The thus-obtained emulsion grains were monodisperse cubic silver iodobromochloride grains having a side length of 0.39 μm and a variation coefficient of 10%. The resulting emulsion was subjected to a sedimentation desalting treatment and re-dispersing treatment in the same manner as described in the above.

The re-dispersed emulsion was dissolved at 40° C., and sensitizing dye S-8, Compound-5, triethylthiourea as a sulfur sensitizer, and Compound-1 as a gold sensitizer were added, and the emulsion was ripened for optimal chemical sensitization. Thereafter, 1-(3-acetamidophenyl)-5-mercaptotetrazole, 1-(5-methylureidophenyl)-5-mercaptotetrazole, Compound-2, Compound-4, and potassium bromide were added. The thus-obtained emulsion was referred to as Emulsion RH-1.

Sensitizing dye S-8

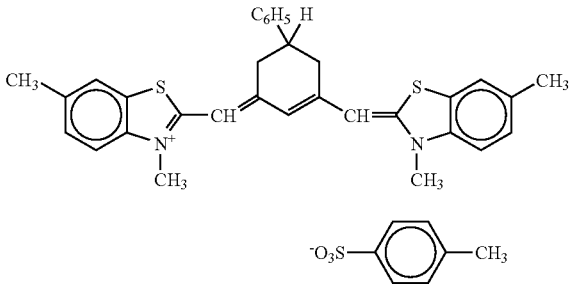

Compound -5

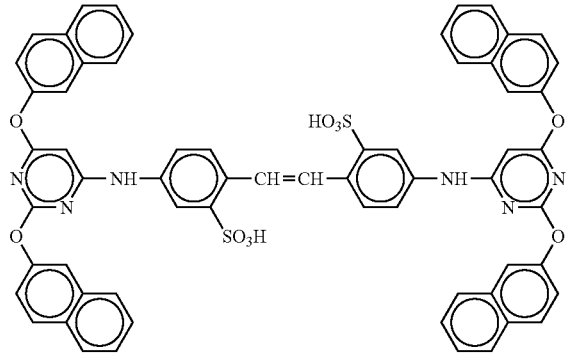

(Preparation of Red-sensitive Layer Emulsion RL-1)

Emulsion grains were prepared in the same manner as in the preparation of Emulsion RH-1, except that the temperature and the addition rate at the step of mixing silver nitrate and sodium chloride by simultaneous addition were changed, and the amounts of respective metal complexes that were to be added during the addition of silver nitrate and sodium chloride were changed. The thus-obtained emulsion grains were monodisperse cubic silver iodobromochloride grains having a side length of 0.29 μm and a variation coefficient of 9.9%. After this emulsion was subjected to a sedimentation desalting treatment and re-dispersion, Emulsion RL-1 was prepared in the same manner as Emulsion RH-1, except that the amounts of compounds in the preparation of RH-1 were changed.

(Preparation of a Coating Solution for the First Layer)

Into 23 g of a solvent (Solv-4), 4 g of a solvent (Solv-6), 23 g of a solvent (Solv-9) and 60 ml of ethyl acetate were dissolved 34 g of a yellow coupler (ExY-1), 1 g of a color-image stabilizer (Cpd-1), 1 g of a color-image stabilizer (Cpd-2), 8 g of a color-image stabilizer (Cpd-8), and 1 g of a color-image stabilizer (Cpd-18), 2 g of a color-image stabilizer (Cpd-19), 15 g of a color-image stabilizer (Cpd-20), 1 g of a color-image stabilizer (Cpd-21), 15 g of a color-image stabilizer (Cpd-23), 0.1 g of an additive (ExC-1), and 1 g of a color-image stabilizer (UV-2). This solution was emulsified and dispersed in 270 g of a 20 mass % aqueous gelatin solution containing 4 g of sodium dodecylbenzenesulfonate with a high-speed stirring emulsifier (dissolver). Water was added thereto, to prepare 900 g of an emulsified dispersion A.

On the other hand, the above emulsified dispersion A and the prescribed emulsions BH-1 and BL-1 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, 1-oxy-3,5-dichloro-s-triazine sodium salt (H-1), (H-2), and (H-3) were used. Further, to each layer, were added Ab-1, Ab-2, and Ab-3, so that the total amounts would be 15.0 mg/m$^2$, 60.0 mg/m$^2$, 5.0 mg/m$^2$, and 10.0 mg/m$^2$, respectively.

(H-1) Hardener

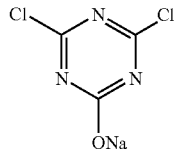

(H-2) Hardener

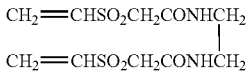

(H-3) Hardener

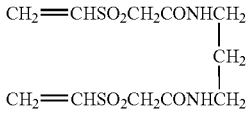

Further, to the second layer, the fourth layer, and the sixth layer, was added 1-(3-methylureidophenyl)-5-mercaptotetrazole in amounts of 0.2 mg/m$^2$, 0.2 mg/m$^2$, and 0.6 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$.

Disodium salt of catecol-3,5-disulfonic acid was added to the second layer, the fourth layer and the sixth layer so that coating amounts would be 6 mg/m$^2$, 6 mg/m$^2$ and 18 mg/m$^2$, respectively.

Further, to each layer, sodium polystyrene sulfonate was added to adjust viscosity of the coating solutions, if necessary.

Further, in order to prevent irradiation, the following dyes (coating amounts are shown in parentheses) were added.

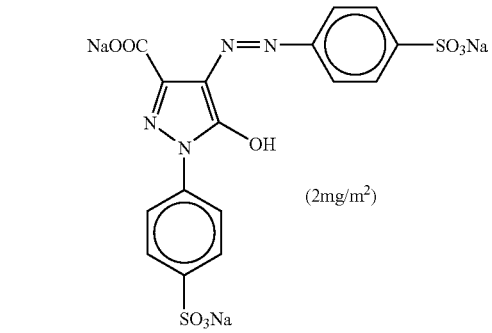

(2mg/m$^2$)

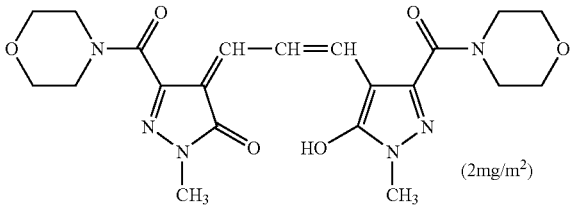

(2mg/m$^2$)

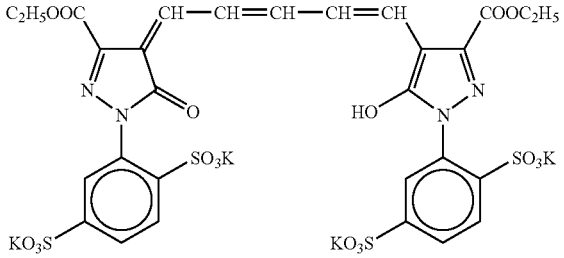

(24mg/m$^2$)

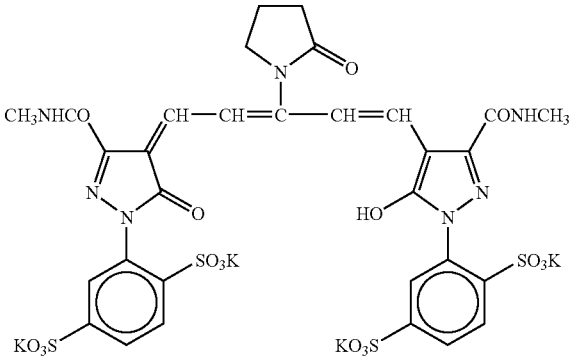

(3mg/m$^2$)

Support

Polyethylene resin laminated paper {The polyethylene resin on the first layer side contained white pigments ($TiO_2$, content of 16 mass %; ZnO, content of 4 mass %), a fluorescent whitening agent (4,4'-bis(5-methylbenzoxazolyl)stilbene, content of 0.03 mass %) and a bluish dye (ultramarine, content of 0.33 mass %); and the amount of the polyethylene resin was 29.2 g/m$^2$.}

(Layer Constitution)

The composition of each layer provided on the above-described support is shown below. The numbers show coating amounts (g/m$^2$). In the case of the silver halide emulsion, the coating amount is in terms of silver.

| First layer (Blue-sensitive emulsion layer) | |
|---|---|
| Emulsion (a 5:5 mixture of BH-1 and BL-1 (mol ratio of silver)) | 0.16 |
| Gelatin | 1.32 |
| Yellow coupler (Ex-Y) | 0.34 |
| Color image stabilizer (Cpd-1) | 0.01 |
| Color image stabilizer (Cpd-2) | 0.01 |
| Color image stabilizer (Cpd-8) | 0.08 |
| Color image stabilizer (Cpd-18) | 0.01 |
| Color image stabilizer (Cpd-19) | 0.02 |
| Color image stabilizer (Cpd-20) | 0.15 |
| Color image stabilizer (Cpd-21) | 0.01 |
| Color image stabilizer (Cpd-23) | 0.15 |
| Additive (ExC-1) | 0.001 |
| Color image stabilizer (UV-A) | 0.01 |
| Solvent (Solv-4) | 0.12 |
| Solvent (Solv-6) | 0.02 |
| Solvent (Solv-9) | 0.12 |

| Second layer (1st Color-mixing-inhibiting layer) | |
|---|---|
| Gelatin | 0.78 |
| Color-mixing inhibitor (Cpd-4) | 0.05 |
| Color image stabilizer (Cpd-5) | 0.006 |
| Color image stabilizer (Cpd-6) | 0.05 |
| Color image stabilizer (Cpd-7) | 0.006 |
| Antiseptic (Ab-2) | 0.006 |
| Color image stabilizer (UV-A) | 0.06 |
| Solvent (Solv-1) | 0.03 |
| Solvent (Solv-2) | 0.03 |
| Solvent (Solv-5) | 0.04 |
| Solvent (Solv-8) | 0.04 |

| Third layer (Green-sensitive emulsion layer) | |
|---|---|
| Emulsion (a 1:3 mixture of GH-1 and GL-1 (mol ratio of silver)) | 0.12 |
| Gelatin | 0.95 |
| Magenta coupler (ExM) | 0.12 |
| Ultraviolet absorber (UV-A) | 0.03 |
| Color image stabilizer (Cpd-2) | 0.01 |
| Color image stabilizer (Cpd-6) | 0.08 |
| Color image stabilizer (Cpd-7) | 0.005 |
| Color image stabilizer (Cpd-8) | 0.01 |
| Color image stabilizer (Cpd-9) | 0.01 |
| Color image stabilizer (Cpd-10) | 0.005 |
| Color image stabilizer (Cpd-11) | 0.0001 |
| Color image stabilizer (Cpd-20) | 0.01 |
| Solvent (Solv-3) | 0.02 |
| Solvent (Solv-4) | 0.06 |
| Solvent (Solv-6) | 0.03 |
| Solvent (Solv-9) | 0.08 |

| Fourth layer (2nd Color-mixing-inhibiting layer) | |
|---|---|
| Gelatin | 0.65 |
| Color-mixing inhibitor (Cpd-4) | 0.04 |
| Color image stabilizer (Cpd-5) | 0.005 |
| Color image stabilizer (Cpd-6) | 0.04 |
| Color image stabilizer (Cpd-7) | 0.005 |
| Antiseptic (Ab-2) | 0.006 |
| Color image stabilizer (UV-A) | 0.05 |
| Solvent (Solv-1) | 0.03 |
| Solvent (Solv-2) | 0.03 |
| Solvent (Solv-5) | 0.03 |
| Solvent (Solv-8) | 0.03 |

| Fifth layer (Red-sensitive emulsion layer) | |
|---|---|
| Emulsion (a 4:6 mixture of RH-1 and RL-1 (mol ratio of silver)) | 0.10 |
| Gelatin | 1.11 |
| Cyan coupler (ExC-1) | 0.11 |
| Cyan coupler (ExC-2) | 0.01 |
| Cyan coupler (ExC-3) | 0.04 |
| Color image stabilizer (Cpd-1) | 0.03 |
| Color image stabilizer (Cpd-7) | 0.01 |
| Color image stabilizer (Cpd-9) | 0.04 |
| Color image stabilizer (Cpd-10) | 0.001 |
| Color image stabilizer (Cpd-14) | 0.001 |
| Color image stabilizer (Cpd-15) | 0.18 |
| Color image stabilizer (Cpd-16) | 0.002 |
| Color image stabilizer (Cpd-17) | 0.001 |
| Color image stabilizer (Cpd-18) | 0.05 |
| Color image stabilizer (Cpd-19) | 0.04 |
| Color image stabilizer (UV-5) | 0.10 |
| Solvent (Solv-5) | 0.10 |

| Sixth layer (Ultraviolet absorbing layer) | |
|---|---|
| Gelatin | 0.34 |
| Ultraviolet absorber (UV-B) | 0.24 |
| Compound (S1-4) | 0.0015 |
| Solvent (Solv-7) | 0.11 |

| Seventh layer (Protective layer) | |
|---|---|
| Gelatin | 0.82 |
| Additive (Cpd-22) | 0.03 |
| Liquid paraffin | 0.02 |
| Surfactant (Cpd-13) | 0.02 |

The compounds used in Example 1 and the subsequent working examples are shown below.

(Ex-Y)

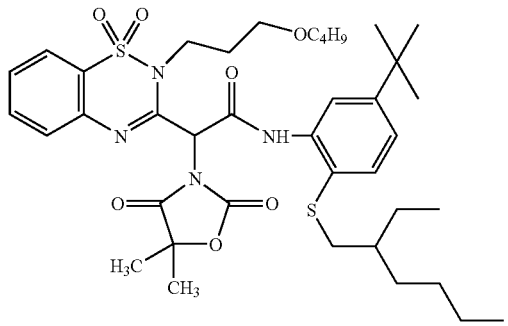

-continued (E x M) Magenta coupler

A mixture in 40:40:20 (mol ratio) of

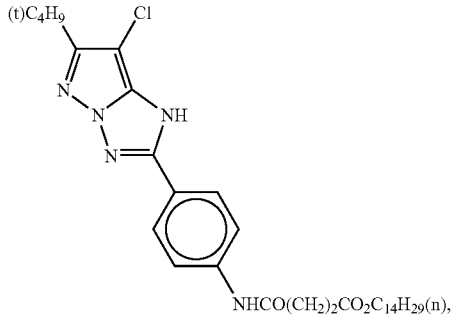

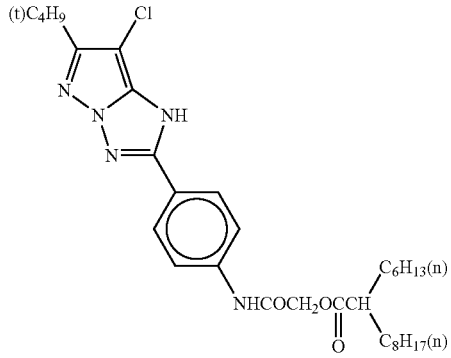

and

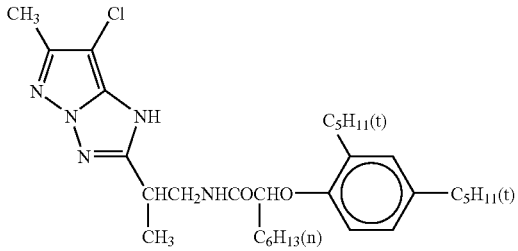

(E x C - 1) Cyan coupler

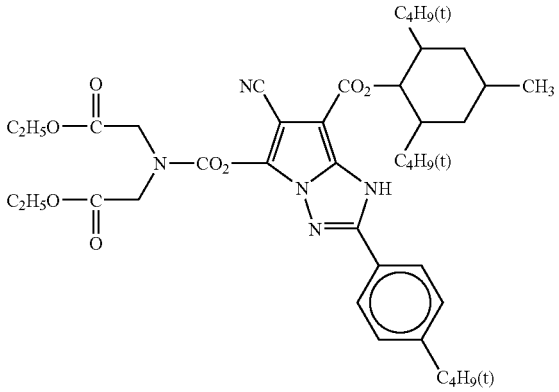

(ExC-2) Cyan coupler

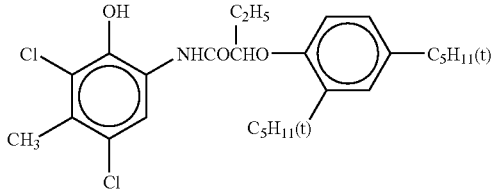

-continued (ExC-3) Cyan coupler

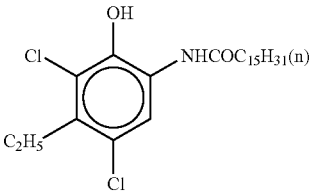

(Cpd-1) Color-image stabilizer

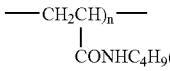

Number-average molecular mass 60, 000

(Cpd-2) Color-image stabilizer

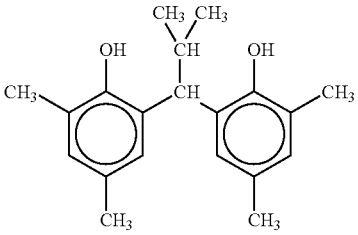

(Cpd-3) Color-image stabilizer

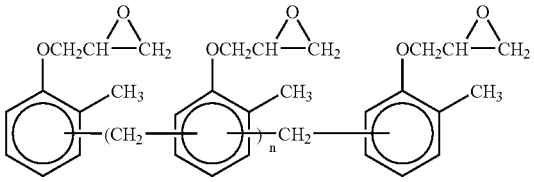

n = 7~8
(Average value)

(Cpd-4) Color-mixing inhibitor

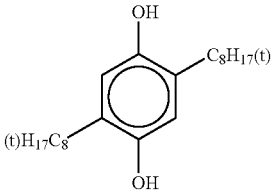

(Cpd-5) Color-image stabilizer

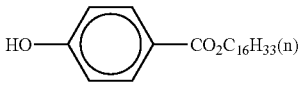

(Cpd-6) Color-image stabilizer

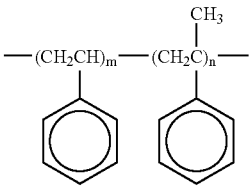

Number-average molecular mass 600
m/n = 10/90

(Cpd-7) Color-image stabilizer

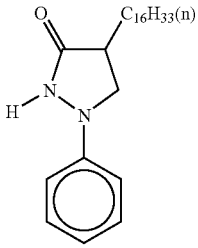

-continued (Cpd-8) Color-image stabilizer

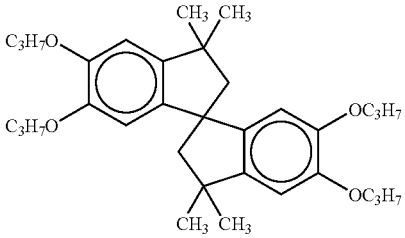

(Cpd-9) Color-image stabilizer

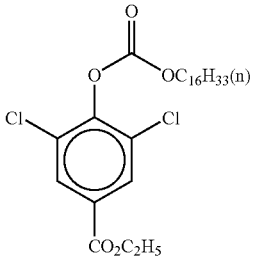

(Cpd-10) Color-image stabilizer

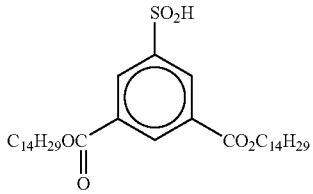

(Cpd-11)

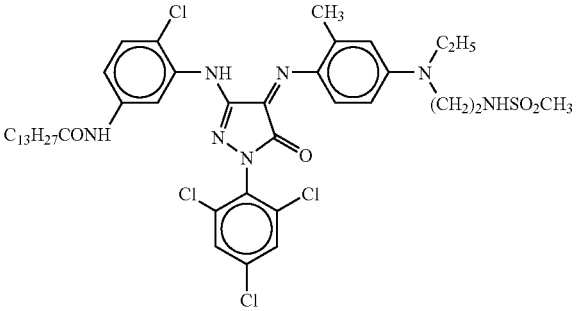

(Cpd-12)

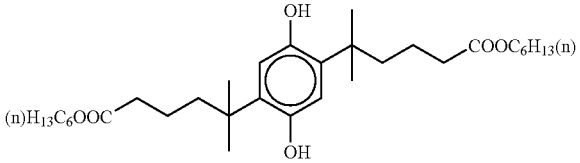

(Cpd-13) Surfactant

A mixture in 6:2:2 (molar ratio) of (a), (b), and (c)

(a)

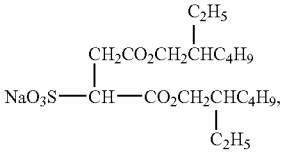

(b)

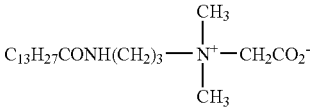

and

-continued
(c)
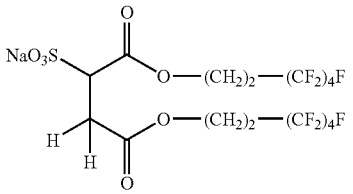
(Cpd-14)
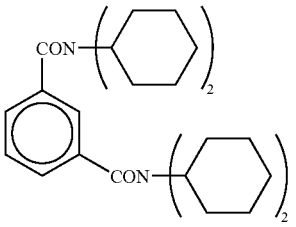
(Cpd-15)
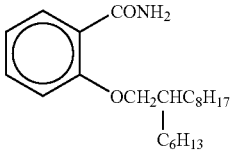
(Cpd-16)
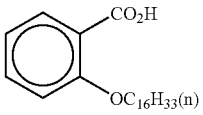
(Cpd-17)
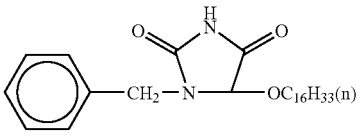
(Cpd-18)
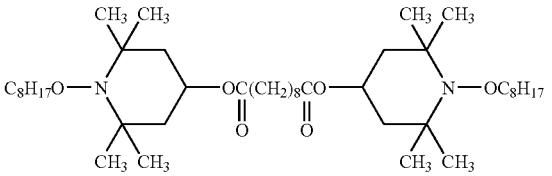
(Cpd-19)
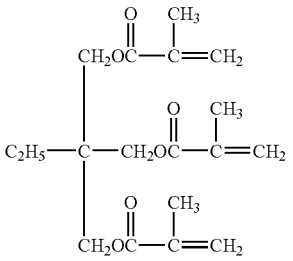
(Cpd-20)
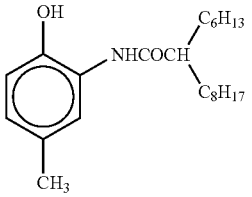
-continued
(Cpd-21)
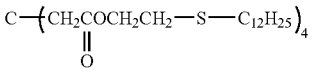
(Cpd-22)
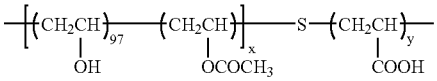
x:y = 5:1 (Mass ratio)
(Cpd-23)
KAYARAD DPCA-30
(trade name, manufactured by Nippon Kayaku Co., Ltd.)
(Solv-1)
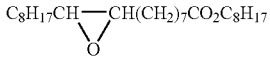
(Solv-2)
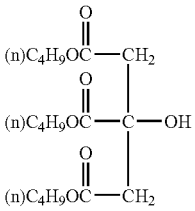
(Solv-3)
(Solv-4)
(Solv-5)
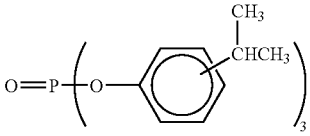
(Solv-6)
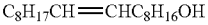
(Solv-7)
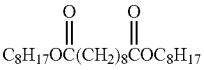
(Solv-8)
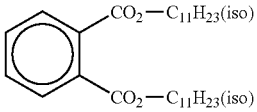
(Solv-9)
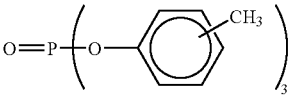
(S1-4)
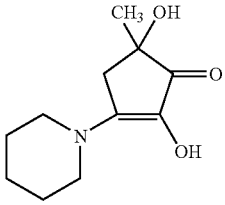
(UV-1) Ultraviolet absorbent
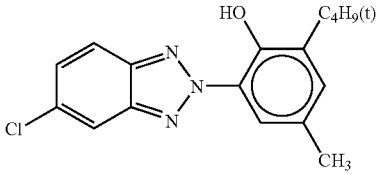

-continued (UV-2) Ultraviolet absorbent

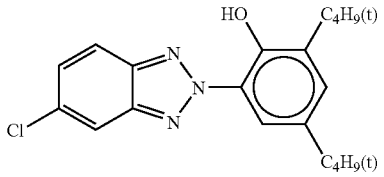

(UV-3) Ultraviolet absorbent

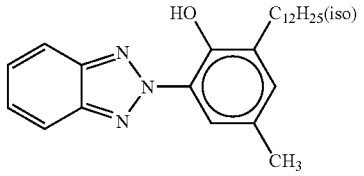

(UV-4) Ultraviolet absorbent

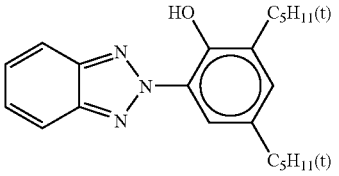

(UV-5) Ultraviolet Absorbent

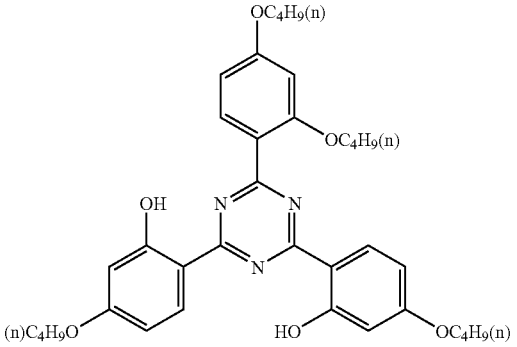

UV-A: A mixture of UV-1/UV-4/UV-5=1/7/2 (mass ratio)
UV-B: A mixture of UV-1/UV-3/UV-4/UV-5=1/3/5/1 (mass ratio)

The thus prepared sample is referred to as Sample 101.

Sample 101 had a total coating amount of gelatin of 5.97 g/m$^2$ and a total coating amount of silver of 0.38 g/m$^2$.

(Preparation of Samples 102 to 104)

The composition of each layer provided on the same support as used in Sample 101 is described below. Each number is the coating amount (g/m$^2$). As for the silver halide emulsion, the number represents the coating amount in terms of silver.

Then, the layer structure of Sample 102 is explained.

First Layer (Blue-sensitive Emulsion Layer)

The same as that in Sample 101.

Second Layer (1st Color-Mixing-Inhibiting Layer)

The same as that in Sample 101, except that Color-mixing inhibitor Cpd-4 was added 0.8 times the amount in Sample 101.

| Third layer (1st Magenta-coupler layer) | |
|---|---|
| Gelatin | 0.32 |
| Magenta coupler (ExM) | 0.04 |
| Ultraviolet absorber (UV-A) | 0.01 |
| Color image stabilizer (Cpd-2) | 0.0033 |
| Color image stabilizer (Cpd-6) | 0.027 |
| Color image stabilizer (Cpd-7) | 0.0017 |
| Color image stabilizer (Cpd-8) | 0.0033 |
| Color image stabilizer (Cpd-9) | 0.0033 |
| Color image stabilizer (Cpd-10) | 0.0017 |
| Color image stabilizer (Cpd-11) | 0.000033 |
| Color image stabilizer (Cpd-20) | 0.033 |
| Solvent (Solv-3) | 0.02 |
| Solvent (Solv-4) | 0.04 |
| Solvent (Solv-6) | 0.017 |
| Solvent (Solv-9) | 0.027 |

| Fourth layer (Green-sensitive emulsion layer) | |
|---|---|
| Emulsion (a 1:3 mixture of GH-1 and GL-1 (mol ratio of silver)) | 0.12 |
| Gelatin | 0.31 |
| Magenta coupler (ExM) | 0.04 |
| Ultraviolet absorber (UV-A) | 0.01 |
| Color image stabilizer (Cpd-2) | 0.0033 |
| Color image stabilizer (Cpd-6) | 0.027 |
| Color image stabilizer (Cpd-7) | 0.0017 |
| Color image stabilizer (Cpd-8) | 0.0033 |
| Color image stabilizer (Cpd-9) | 0.0033 |
| Color image stabilizer (Cpd-10) | 0.0017 |
| Color image stabilizer (Cpd-11) | 0.000033 |
| Color image stabilizer (Cpd-20) | 0.033 |
| Solvent (Solv-3) | 0.02 |
| Solvent (Solv-4) | 0.04 |
| Solvent (Solv-6) | 0.017 |

| Fifth layer (2nd Magenta-coupler layer) | |
|---|---|
| Gelatin | 0.32 |
| Magenta coupler (ExM) | 0.04 |
| Ultraviolet absorber (UV-A) | 0.01 |
| Color image stabilizer (Cpd-2) | 0.0033 |
| Color image stabilizer (Cpd-6) | 0.027 |
| Color image stabilizer (Cpd-7) | 0.0017 |
| Color image stabilizer (Cpd-8) | 0.0033 |
| Color image stabilizer (Cpd-9) | 0.0033 |
| Color image stabilizer (Cpd-10) | 0.0017 |
| Color image stabilizer (Cpd-11) | 0.000033 |
| Color image stabilizer (Cpd-20) | 0.033 |
| Solvent (Solv-3) | 0.02 |
| Solvent (Solv-4) | 0.04 |
| Solvent (Solv-6) | 0.017 |
| Solvent (Solv-9) | 0.027 |

Sixth Layer (2nd Color-mixing-inhibiting Layer)

The same as the 2nd Color-mixing-inhibiting layer of Sample 101, except that Color-mixing inhibitor Cpd-4 was added 0.8 times the amount in Sample 101.

Seventh Layer (Red-sensitive Emulsion Layer)

The same as the Red-sensitive emulsion layer in Sample 101.

Eighth Layer (Ultraviolet Absorbing Layer)

The same as the ultraviolet absorbing layer in Sample 101.

Ninth Layer (Protective Layer)

The same as the protective layer in Sample 101.

Next, the layer constitution of Sample 103 is explained.

First Layer (Blue-sensitive Emulsion Layer)

The same as that in Sample 101.

| Second layer (1st Non-color-forming intermediate layer) | |
|---|---|
| Gelatin | 0.20 |
| Antiseptic (Ab-2) | 0.002 |

| Third layer (1st Color-mixing-inhibiting layer) | |
|---|---|
| Gelatin | 0.38 |
| Color-mixing inhibitor (Cpd-4) | 0.043 |
| Color image stabilizer (Cpd-5) | 0.006 |
| Color image stabilizer (Cpd-6) | 0.05 |
| Color image stabilizer (Cpd-7) | 0.006 |
| Antiseptic (Ab-2) | 0.004 |
| Color image stabilizer (UV-A) | 0.06 |
| Solvent (Solv-1) | 0.03 |
| Solvent (Solv-2) | 0.03 |
| Solvent (Solv-5) | 0.04 |
| Solvent (Solv-8) | 0.04 |

| Fourth layer (1st Non-color-forming intermediate layer) | |
|---|---|
| Gelatin | 0.20 |
| Antiseptic (Ab-2) | 0.002 |

Fifth Layer (Green-sensitive Emulsion Layer)

The same as the green-sensitive emulsion layer in Sample 101.

| Sixth layer (2nd Non-color-forming intermediate layer) | |
|---|---|
| Gelatin | 0.16 |
| Antiseptic (Ab-2) | 0.002 |

| Seventh layer (2nd Color-mixing-inhibiting layer) | |
|---|---|
| Gelatin | 0.33 |
| Color-mixing inhibitor (Cpd-4) | 0.034 |
| Color image stabilizer (Cpd-5) | 0.005 |
| Color image stabilizer (Cpd-6) | 0.04 |
| Color image stabilizer (Cpd-7) | 0.005 |
| Antiseptic (Ab-2) | 0.004 |
| Color image stabilizer (UV-A) | 0.05 |
| Solvent (Solv-1) | 0.03 |
| Solvent (Solv-2) | 0.03 |
| Solvent (Solv-5) | 0.03 |
| Solvent (Solv-8) | 0.03 |

| Eighth layer (2nd Non-color-forming intermediate layer) | |
|---|---|
| Gelatin | 0.16 |
| Antiseptic (Ab-2) | 0.002 |

Ninth Layer (Red-sensitive Emulsion Layer)

The same as the red-sensitive emulsion layer in Sample 101.

Tenth Layer (Ultraviolet Absorbing Layer)

The same as the ultraviolet absorbing layer in Sample 101.

Eleventh Layer (Protective Layer)

The same as the protective layer in Sample 101.

Next, the layer constitution of Sample 104 is explained below.

First Layer (Blue-Sensitive Emulsion Layer)

The same as the blue-sensitive emulsion layer in Sample 101.

| Second layer (1st Non-color-forming intermediate layer) | |
|---|---|
| Gelatin | 0.20 |
| Antiseptic (Ab-2) | 0.002 |

| Third layer (1st Color-mixing-inhibiting layer) | |
|---|---|
| Gelatin | 0.38 |
| Color-mixing inhibitor (Cpd-4) | 0.031 |
| Color image stabilizer (Cpd-5) | 0.006 |
| Color image stabilizer (Cpd-6) | 0.05 |
| Color image stabilizer (Cpd-7) | 0.006 |
| Antiseptic (Ab-2) | 0.004 |
| Color image stabilizer (UV-A) | 0.06 |
| Solvent (Solv-1) | 0.03 |
| Solvent (Solv-2) | 0.03 |
| Solvent (Solv-5) | 0.04 |
| Solvent (Solv-8) | 0.04 |

| Fourth layer (1st Non-color-forming intermediate layer) | |
|---|---|
| Gelatin | 0.20 |
| Antiseptic (Ab-2) | 0.002 |

| Fifth layer (1st Magenta-coupler layer) | |
|---|---|
| Gelatin | 0.32 |
| Magenta coupler (ExM) | 0.04 |
| Ultraviolet absorber (UV-A) | 0.01 |
| Color image stabilizer (Cpd-2) | 0.0033 |
| Color image stabilizer (Cpd-6) | 0.027 |
| Color image stabilizer (Cpd-7) | 0.0017 |
| Color image stabilizer (Cpd-8) | 0.0033 |
| Color image stabilizer (Cpd-9) | 0.0033 |
| Color image stabilizer (Cpd-10) | 0.0017 |
| Color image stabilizer (Cpd-11) | 0.000033 |
| Color image stabilizer (Cpd-20) | 0.033 |
| Solvent (Solv-3) | 0.02 |

-continued

| Fifth layer (1st Magenta-coupler layer) | |
|---|---|
| Solvent (Solv-4) | 0.04 |
| Solvent (Solv-6) | 0.017 |
| Solvent (Solv-9) | 0.027 |

| Sixth layer (Green-sensitive emulsion layer) | |
|---|---|
| Emulsion (a 1:3 mixture of GH-1 and GL-1 (mol ratio of silver)) | 0.12 |
| Gelatin | 0.31 |
| Magenta coupler (ExM) | 0.04 |
| Ultraviolet absorber (UV-A) | 0.01 |
| Color image stabilizer (Cpd-2) | 0.0033 |
| Color image stabilizer (Cpd-6) | 0.027 |
| Color image stabilizer (Cpd-7) | 0.0017 |
| Color image stabilizer (Cpd-8) | 0.0033 |
| Color image stabilizer (Cpd-9) | 0.0033 |
| Color image stabilizer (Cpd-10) | 0.0017 |
| Color image stabilizer (Cpd-11) | 0.000033 |
| Color image stabilizer (Cpd-20) | 0.033 |
| Solvent (Solv-3) | 0.02 |
| Solvent (Solv-4) | 0.04 |
| Solvent (Solv-6) | 0.017 |

| Seventh layer (2nd Magenta-coupler layer) | |
|---|---|
| Gelatin | 0.32 |
| Magenta coupler (ExM) | 0.04 |
| Ultraviolet absorber (UV-A) | 0.01 |
| Color image stabilizer (Cpd-2) | 0.0033 |
| Color image stabilizer (Cpd-6) | 0.027 |
| Color image stabilizer (Cpd-7) | 0.0017 |
| Color image stabilizer (Cpd-8) | 0.0033 |
| Color image stabilizer (Cpd-9) | 0.0033 |
| Color image stabilizer (Cpd-10) | 0.0017 |
| Color image stabilizer (Cpd-11) | 0.000033 |
| Color image stabilizer (Cpd-20) | 0.033 |
| Solvent (Solv-3) | 0.02 |
| Solvent (Solv-4) | 0.04 |
| Solvent (Solv-6) | 0.017 |
| Solvent (Solv-9) | 0.027 |

| Eighth layer (2nd Non-color-forming intermediate layer) | |
|---|---|
| Gelatin | 0.16 |
| Antiseptic (Ab-2) | 0.002 |

| Ninth layer (2nd Color-mixing-inhibiting layer) | |
|---|---|
| Gelatin | 0.33 |
| Color-mixing inhibitor (Cpd-4) | 0.025 |
| Color image stabilizer (Cpd-5) | 0.005 |
| Color image stabilizer (Cpd-6) | 0.04 |
| Color image stabilizer (Cpd-7) | 0.005 |
| Antiseptic (Ab-2) | 0.004 |
| Color image stabilizer (UV-A) | 0.05 |
| Solvent (Solv-1) | 0.03 |
| Solvent (Solv-2) | 0.03 |
| Solvent (Solv-5) | 0.03 |
| Solvent (Solv-8) | 0.03 |

| Tenth layer (2nd Non-color-forming intermediate layer) | |
|---|---|
| Gelatin | 0.16 |
| Antiseptic (Ab-2) | 0.002 |

Eleventh Layer (Red-sensitive Emulsion Layer)

The same as the red-sensitive emulsion layer in Sample 101.

Twelfth Layer (Ultraviolet Absorbing Layer)

The same as the ultraviolet absorbing layer in Sample 101.

Thirteenth Layer (Protective Layer)

The same as the protective layer in Sample 101.

Each of Samples 102, 103 and 104 had the same total coating amount of gelatin and the same total coating amount of silver as Sample 101 had.

(Preparation of Samples 105 to 107)

Samples 105 to 107 were prepared in the same manners as Samples 101 to 103, respectively, except that the three (3) light-sensitive emulsion layers each had the coating amount of silver increased by a factor of 1.45 and thereby the total coating amount of silver was changed to 0.55 g/m$^2$.

(Preparation of Samples 108 to 111)

Samples 108 to 111 were prepared in the same manners as Samples 101 to 104, respectively, except that the three (3) light-sensitive emulsion layers each had the silver coating amount decreased to 0.79 time the silver coating amount which Samples 101 to 104 each had and thereby the total coating amount of silver was changed to 0.30 g/m$^2$.

Further, each of the color-mixing-inhibiting layers of Samples 105 to 111 was optimized with respect to the coating amount of the color-mixing inhibitor Cpd-4 for the purpose of controlling color impurity in the color-forming layers.

The aforementioned Sample 101 was made into a roll with a width of 127 mm; the resultant sample was exposed to light with a standard photographic image, using Digital Minilab Frontier 350 (trade name, manufactured by Fuji Photo Film Co., Ltd.); and then, the exposed sample was continuously processed (running test) in the following processing steps, until an accumulated replenisher amount of the color developing solution reached to be equal to twice the color developer tank volume. The following two processings, which were different in the composition of processing solutions and processing time, were carried out, to evaluate the light-sensitive materials.

Among the two processings, one is Developing Processing (I) described in Example 1 of JP-A-4-75055 (which is the same as Developing Processing (I) described in Example 1 of JP-A-4-110844), and this was named processing A. Another one was processing B described below.

(Processing B)

A processing with the following running processing solutions was named processing B.

| Processing step | Temperature | Time | Replenisher amount* |
|---|---|---|---|
| Color development | 45.0° C. | 13 sec | 35 ml |
| Bleach-fixing | 40.0° C. | 13 sec | 30 ml |
| Rinse (1)** | 45.0° C. | 4 sec | — |
| Rinse (2)** | 45.0° C. | 4 sec | — |
| Rinse (3)** | 45.0° C. | 3 sec | — |
| Rinse (4)** | 45.0° C. | 5 sec | 121 ml |
| Drying | 80° C. | 12 sec | |

(Note)
*Replenisher amount per $m^2$ of the light-sensitive material to be processed.
**A rinse cleaning system RC50D (trade name), manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated water was returned to the rinse (3).

Pump pressure was controlled such that the water to be permeated in the reverse osmosis module would be maintained in an amount of 50 to 300 ml/min, and the rinse solution was circulated under controlled temperature for 10 hours a day. The rinse was made in a four-tank counter-current system from Rinse (1) to (4).

The composition of each processing solution was as follows.

| (Color developer) | (Tank solution) | (Replenisher) |
|---|---|---|
| Water | 800 ml | 800 ml |
| Fluorescent whitening agent (FL-3) | 4.0 g | 8.0 g |
| Residual color reducing agent (SR-1) | 3.0 g | 5.5 g |
| Triisopropanolamine | 8.8 g | 8.8 g |
| Sodium p-toluenesulfonate | 10.0 g | 10.0 g |
| Ethylenediamine tetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |

-continued

| (Color developer) | (Tank solution) | (Replenisher) |
|---|---|---|
| Disodium-N,N-bis(sulfonatoethyl) hydroxylamine | 8.5 g | 14.0 g |
| 4-Amino-3-methyl-N-ethyl-N-(β-methanesulfonamidoethyl) aniline.3/2 sulfate.monohydrate | 7.0 g | 19.0 g |
| Potassium carbonate | 26.3 g | 26.3 g |
| Water to make | 1,000 ml | 1,000 ml |
| pH (25° C./adjusted using sulfuric acid and KOH) | 10.25 | 12.6 |

| (Bleach-fixing solution) | (Tank solution) | (Replenisher) |
|---|---|---|
| Water | 800 ml | 800 ml |
| Ammonium thiosulfate (750 g/l) | 107 ml | 214 ml |
| Succinic acid | 29.5 g | 59.0 g |
| Ammonium iron (III) ethylenediaminetetraacetate | 47.0 g | 94.0 g |
| Ethylenediamine tetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1,000 ml | 1,000 ml |
| pH (25° C./adjusted using nitric acid and aqua ammonia) | 6.00 | 6.00 |

| (Rinse solution) | (Tank solution) | (Replenisher) |
|---|---|---|
| Sodium chlorinated-isocyanurate | 0.02 g | 0.02 g |
| Deionized water (conductivity: 5 μS/cm or less) | 1,000 ml | 1,000 ml |
| PH (25° C.) | 6.5 | 6.5 |

FL-1

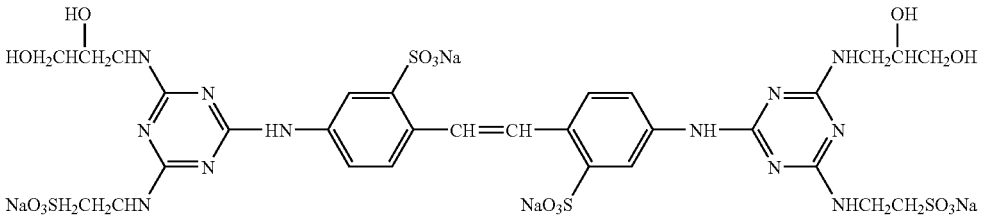

FL-2

-continued

| (Rinse solution) | (Tank solution) | (Replenisher) |
|---|---|---|

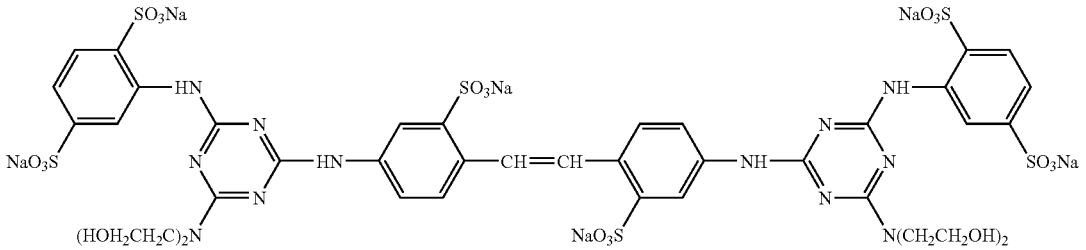

FL-3

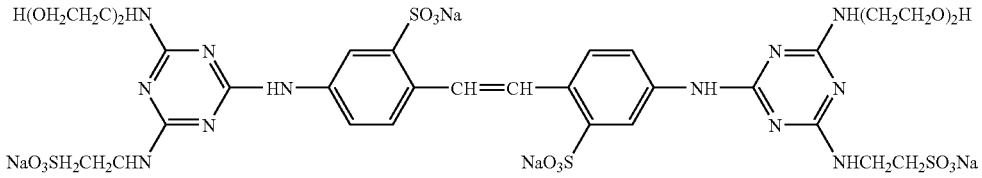

SR-1

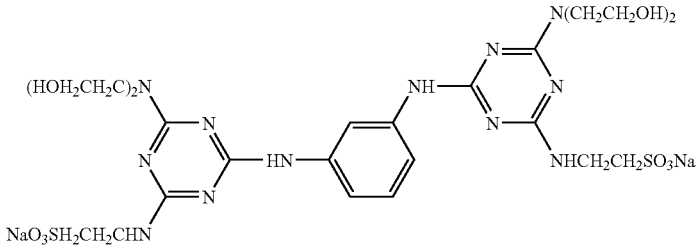

Evaluation of Samples

After keeping samples 101 to 111 under conditions of 25° C. and 55% RH for 7 days after coating, the following evaluations were performed.

(Color Formation Efficiency and Change in Color Formation Efficiency Upon Storage Under High Humidity)

In storing each sample in advance of exposure, two conditions, 7 days' storage at −20° C. (Storage 1) and 7 days' storage at 30° C. and a relative humidity of 55% (Storage 2), were adopted.

Each sample was subjected to green-light gradation exposure by means of the following exposure apparatus, and further to the foregoing three kinds of processing after a 5-second lapse from conclusion of the exposure. As light sources, a blue laser at a wavelength of about 470 nm pulled out by performing a wavelength conversion of a semiconductor laser (an oscillation wavelength of about 940 nm) using a SHG crystal of $LiNbO_3$ having a waveguide-like reverse domain structure, a green laser at a wavelength of about 530 nm pulled out by performing a wavelength conversion of a semiconductor laser (an oscillation wavelength of about 1060 nm) using a SHG crystal of $LiNbO_3$ having a waveguide-like reverse domain structure, and a red semiconductor laser at a wavelength of about 650 nm (Hitachi Type No. HL6501MG), were used. Each laser light of three colors moved perpendicularly to a scanning direction by a polygon mirror, and could be made to carry out sequential-scanning exposure on the sample. The change of light quantity caused by the temperature of the semiconductor is prevented by using a Peltier device and by keeping the temperature constant. An effectual beam diameter is 80 μm, a scanning pitch is 42.3 μm (600 dpi), and the average exposure time per pixel was $1.7\times10^{-7}$ sec. The temperature of the semiconductor laser was kept constant by using a Peltier device to prevent the quantity of light from being changed by temperature.

The exposed Samples 101 to 111 were each subjected to the foregoing Processing B.

After the processing, magenta reflection densities of each sample were measured, and the maximum developed-color density Dmax of magenta densities was determined from the characteristic curve relating to the green-sensitive layer. In addition, a difference of the Dmax between two cases where each sample was stored under the conditions Storage 1 and Storage 2, respectively, was denoted as ΔDmax and determined. The smaller the value of ΔDmax(M), the better the color formation characteristics.

(Silver Removal Characteristics)

After uniform exposure under a condition to develop gray color by Processing B, each sample was subjected to Processing A and Processing B, respectively. In order to remove organic dyes and colored matter from the processed samples, the samples were allowed to stand in an 85:15 mixture of dimethylformamide and water for 12 hours at room temperature. Then, stain derived from silver remaining in each sample was observed, and a sensory evaluation was made by grading the extent of stain in accordance with the criterion described below:

Grade Criterion of Evaluation

○ Practically no residual silver stain was observed

Δ Slight stain was observed

× Stain observed was noticeable, so unacceptable

All results obtained are shown in Table 2. The term "Coating amount of Cpd-4 in Color-mixing inhibiting layers" in the table refers to the total Cpd-4 coating amount of two color-mixing-inhibiting layers, and is expressed in relative value, taking Sample 101 as 100.

TABLE 2

| Sample No. | Coating amount of gelatin(g/m$^2$) | Coating amount of silver(g/m$^2$) | Layer in multilayer-form | Coating amount of Cpd-4 in Color-mixing-inhibiting layers | Dmax Processing B | Δ Dmax(M) after high humidity storage | Silver removal characteristics Processing A | Silver removal characteristics Processing B |
|---|---|---|---|---|---|---|---|---|
| 101 | 5.97 | 0.38 | None | 100 | 2.11 | −0.10 | ○ | ○ |
| 102 | 5.97 | 0.38 | Magenta color-forming layer | 80 | 2.15 | −0.05 | ○ | ○ |
| 103 | 5.97 | 0.38 | Color-mixing inhibiting layer | 85 | 2.16 | −0.04 | ○ | ○ |
| 104 | 5.97 | 0.38 | Magenta color-forming layer Color-mixing inhibiting layer | 61 | 2.20 | 0 | ○ | ○ |
| 105 | 5.97 | 0.55 | None | 120 | 2.20 | −0.06 | Δ | X |
| 106 | 5.97 | 0.55 | Magenta color-forming layer | 87 | 2.20 | −0.04 | Δ | X |
| 107 | 5.97 | 0.55 | Color-mixing inhibiting layer | 90 | 2.20 | −0.03 | Δ | X |
| 108 | 5.97 | 0.30 | None | 85 | 1.99 | −0.12 | ○ | ○ |
| 109 | 5.97 | 0.30 | Magenta color-forming layer | 63 | 2.05 | −0.04 | ○ | ○ |
| 110 | 5.97 | 0.30 | Color-mixing inhibiting layer | 65 | 2.06 | −0.04 | ○ | ○ |
| 111 | 5.97 | 0.30 | Magenta color-forming layer Color-mixing inhibiting layer | 55 | 2.18 | 0 | ○ | ○ |

As compared with Sample 105, Samples 106 and 107 were increased in developed color density and decreased in the photographic property change occurring after storage under high humidity, by a multilayer structure being imparted to the magenta color-forming layer and the color-mixing-inhibiting layer, respectively, but the extents of these effects were slight; and besides, these samples had a problem with silver removal characteristics in the ultra-rapid processing. Samples 102 and 103, reduced in coating amount of silver, showed good silver removal characteristics even when subjected to ultra-rapid processing, and they had improvements in color-developed density on a per-silver-coating-amount basis. In accordance with the mode of the above item (3) in the first embodiment of the present invention, the light-sensitive materials excellent in both silver removal characteristics and color formation efficiency relative to coating amount of silver were obtained.

Further, it was found that Sample 104, in which a multilayer form was imparted to both the magenta color-forming layer and the color-mixing-inhibiting layer, was reduced in the photographic property change occurring after storage under high humidity, compared with Sample 102 and Sample 103, wherein a multilayer form was imparted to either of the magenta color formation or color-mixing-inhibiting layers. In the case of Sample 111, which had less coating amount of silver, greater effects were produced on the color density developed by ultra-rapid processing, and on the photographic property change occurring after storage under high humidity. Therefore, the mode of the above item (2) in the first embodiment of the present invention was effective especially when the coating amount of silver was reduced.

Example 2

Examples Related to the Mode According to the Item (5) of the First Embodiment of the Present Invention (Preparation of Sample 201)

The composition of each layer is shown below; these layers were applied on the same support as in Sample 101. The numbers show coating amounts (g/m$^2$). In the case of the silver halide emulsion, the coating amount is in terms of silver.

Next, the layer constitution of Sample 201 is explained.

First Layer (Blue-Sensitive Emulsion Layer)

The same as the blue-sensitive emulsion layer in Sample 101.

| Second layer (1st Color-mixing-inhibiting layer) | |
|---|---|
| Gelatin | 0.78 |
| Color-mixing inhibitor (Cpd-4) | 0.05 |
| Color image stabilizer (Cpd-5) | 0.006 |
| Color image stabilizer (Cpd-6) | 0.05 |
| Color image stabilizer (Cpd-7) | 0.006 |
| Antiseptic (Ab-2) | 0.006 |
| Color image stabilizer (UV-A) | 0.06 |
| Solvent (Solv-1) | 0.03 |
| Solvent (Solv-2) | 0.03 |
| Solvent (Solv-5) | 0.04 |
| Solvent (Solv-8) | 0.04 |

| Third layer (Red-sensitive emulsion layer) | |
|---|---|
| Emulsion (a 4:6 mixture of RH-1 and RL-1 (mol ratio of silver)) | 0.10 |

-continued

| Third layer (Red-sensitive emulsion layer) | |
|---|---|
| Gelatin | 1.11 |
| Cyan coupler (ExC-1) | 0.11 |
| Cyan coupler (ExC-2) | 0.01 |
| Cyan coupler (ExC-3) | 0.04 |
| Color image stabilizer (Cpd-1) | 0.03 |
| Color image stabilizer (Cpd-7) | 0.01 |
| Color image stabilizer (Cpd-9) | 0.04 |
| Color image stabilizer (Cpd-10) | 0.001 |
| Color image stabilizer (Cpd-14) | 0.001 |
| Color image stabilizer (Cpd-15) | 0.18 |
| Color image stabilizer (Cpd-16) | 0.002 |
| Color image stabilizer (Cpd-17) | 0.001 |
| Color image stabilizer (Cpd-18) | 0.05 |
| Color image stabilizer (Cpd-19) | 0.04 |
| Color image stabilizer (UV-5) | 0.10 |
| Solvent (Solv-5) | 0.10 |

| Fourth layer (2nd Color-mixing-inhibiting layer) | |
|---|---|
| Gelatin | 0.65 |
| Color-mixing inhibitor (Cpd-4) | 0.04 |
| Color image stabilizer (Cpd-5) | 0.005 |
| Color image stabilizer (Cpd-6) | 0.04 |
| Color image stabilizer (Cpd-7) | 0.005 |
| Antiseptic (Ab-2) | 0.005 |
| Color image stabilizer (UV-A) | 0.05 |
| Solvent (Solv-1) | 0.03 |
| Solvent (Solv-2) | 0.03 |
| Solvent (Solv-5) | 0.03 |
| Solvent (Solv-8) | 0.03 |

| Fifth layer (Green-sensitive emulsion layer) | |
|---|---|
| Emulsion (a 1:3 mixture of GH-1 and GL-1 (mol ratio of silver)) | 0.12 |
| Gelatin | 0.95 |
| Magenta coupler (ExM) | 0.12 |
| Ultraviolet absorber (UV-A) | 0.03 |
| Color image stabilizer (Cpd-2) | 0.01 |
| Color image stabilizer (Cpd-6) | 0.08 |
| Color image stabilizer (Cpd-7) | 0.005 |
| Color image stabilizer (Cpd-8) | 0.01 |
| Color image stabilizer (Cpd-9) | 0.01 |
| Color image stabilizer (Cpd-10) | 0.005 |
| Color image stabilizer (Cpd-11) | 0.0001 |
| Color image stabilizer (Cpd-20) | 0.01 |
| Solvent (Solv-3) | 0.02 |
| Solvent (Solv-4) | 0.06 |
| Solvent (Solv-6) | 0.03 |
| Solvent (Solv-9) | 0.08 |

| Sixth layer (Ultraviolet absorbing layer) | |
|---|---|
| Gelatin | 0.34 |
| Ultraviolet absorber (UV-B) | 0.24 |
| Compound (S1-4) | 0.0015 |
| Solvent (Solv-7) | 0.11 |

| Seventh layer (Protective layer) | |
|---|---|
| Gelatin | 0.82 |
| Additive (Cpd-22) | 0.03 |
| Liquid paraffin | 0.02 |
| Surfactant (Cpd-13) | 0.02 |

(Preparation of Sample 202)

Sample 202 was prepared in the same manner as Sample 201, except that the coating amount of gelatin of the third layer was changed to 0.39 g/m$^2$ and the coating amount of Cpd-4 of the first color-mixing-inhibiting layer and that of the second color-mixing-inhibiting layer were each optimized.

(Preparation of Sample 203)

Sample 203 was prepared in the same manner as Sample 201, except that the third layer of Sample 201 was replaced by a cyan color-forming layer constituted of the three layers (1) to (3) described below and the coating amount of Cpd-4 of the first color-mixing-inhibiting layer and that of the second color-mixing-inhibiting layer were each optimized.

| (1) (1st Cyan-coupler layer) | |
|---|---|
| Gelatin | 0.22 |
| Cyan coupler (ExC-1) | 0.022 |
| Cyan coupler (ExC-2) | 0.002 |
| Cyan coupler (ExC-3) | 0.008 |
| Color image stabilizer (Cpd-1) | 0.006 |
| Color image stabilizer (Cpd-7) | 0.002 |
| Color image stabilizer (Cpd-9) | 0.008 |
| Color image stabilizer (Cpd-10) | 0.0002 |
| Color image stabilizer (Cpd-14) | 0.0002 |
| Color image stabilizer (Cpd-15) | 0.036 |
| Color image stabilizer (Cpd-16) | 0.0004 |
| Color image stabilizer (Cpd-17) | 0.0002 |
| Color image stabilizer (Cpd-18) | 0.01 |
| Color image stabilizer (Cpd-19) | 0.008 |
| Color image stabilizer (UV-5) | 0.02 |
| Solvent (Solv-5) | 0.02 |

| (2) (Red-sensitive emulsion layer) | |
|---|---|
| Emulsion (a 4:6 mixture of RH-1 and RL-1 (mol ratio of silver)) | 0.10 |
| Gelatin | 0.67 |
| Cyan coupler (ExC-1) | 0.066 |
| Cyan coupler (ExC-2) | 0.006 |
| Cyan coupler (ExC-3) | 0.024 |
| Color image stabilizer (Cpd-1) | 0.018 |
| Color image stabilizer (Cpd-7) | 0.006 |
| Color image stabilizer (Cpd-9) | 0.024 |
| Color image stabilizer (Cpd-10) | 0.0006 |
| Color image stabilizer (Cpd-14) | 0.0006 |
| Color image stabilizer (Cpd-15) | 0.108 |
| Color image stabilizer (Cpd-16) | 0.0012 |
| Color image stabilizer (Cpd-17) | 0.0006 |
| Color image stabilizer (Cpd-18) | 0.03 |
| Color image stabilizer (Cpd-19) | 0.024 |
| Color image stabilizer (UV-5) | 0.06 |
| Solvent (Solv-5) | 0.06 |

| (3) (2nd Cyan-coupler layer) | |
|---|---|
| Gelatin | 0.22 |
| Cyan coupler (ExC-1) | 0.022 |
| Cyan coupler (ExC-2) | 0.002 |
| Cyan coupler (ExC-3) | 0.008 |
| Color image stabilizer (Cpd-1) | 0.006 |
| Color image stabilizer (Cpd-7) | 0.002 |
| Color image stabilizer (Cpd-9) | 0.008 |
| Color image stabilizer (Cpd-10) | 0.0002 |
| Color image stabilizer (Cpd-14) | 0.0002 |
| Color image stabilizer (Cpd-15) | 0.036 |
| Color image stabilizer (Cpd-16) | 0.0004 |
| Color image stabilizer (Cpd-17) | 0.0002 |
| Color image stabilizer (Cpd-18) | 0.01 |
| Color image stabilizer (Cpd-19) | 0.008 |
| Color image stabilizer (UV-5) | 0.02 |
| Solvent (Solv-5) | 0.02 |

(Preparation of Sample 204)

Sample 204 was prepared in the same manner as Sample 203, except that the third layer of Sample 203 was replaced by a cyan color-forming layer constituted of the three layers (4) to (6) described below, and the coating amount of Cpd-4 of the first color-mixing-inhibiting layer and that of the second color-mixing-inhibiting layer were each optimized.

| (4) (1st Non-color-forming cyan coupler layer) | |
|---|---|
| Gelatin | 0.36 |
| Cyan coupler (ExC-1) | 0.014 |
| Cyan coupler (ExC-2) | 0.002 |
| Cyan coupler (ExC-3) | 0.005 |
| Color image stabilizer (Cpd-1) | 0.01 |
| Color image stabilizer (Cpd-7) | 0.003 |
| Color image stabilizer (Cpd-9) | 0.013 |
| Color image stabilizer (Cpd-10) | 0.0003 |
| Color image stabilizer (Cpd-14) | 0.0003 |
| Color image stabilizer (Cpd-15) | 0.059 |
| Color image stabilizer (Cpd-16) | 0.0006 |
| Color image stabilizer (Cpd-17) | 0.0003 |
| Color image stabilizer (Cpd-18) | 0.016 |
| Color image stabilizer (Cpd-19) | 0.013 |
| Color image stabilizer (UV-5) | 0.03 |
| Solvent (Solv-5) | 0.03 |

| (5) (Red-sensitive emulsion layer) | |
|---|---|
| Emulsion (a 4:6 mixture of RH-1 and RL-1 (mol ratio of silver)) | 0.10 |
| Gelatin | 0.39 |
| Cyan coupler (ExC-1) | 0.038 |
| Cyan coupler (ExC-2) | 0.004 |
| Cyan coupler (ExC-3) | 0.014 |
| Color image stabilizer (Cpd-1) | 0.01 |
| Color image stabilizer (Cpd-7) | 0.004 |
| Color image stabilizer (Cpd-9) | 0.014 |
| Color image stabilizer (Cpd-10) | 0.0004 |
| Color image stabilizer (Cpd-14) | 0.0004 |
| Color image stabilizer (Cpd-15) | 0.062 |
| Color image stabilizer (Cpd-16) | 0.0008 |
| Color image stabilizer (Cpd-17) | 0.0004 |
| Color image stabilizer (Cpd-18) | 0.018 |
| Color image stabilizer (Cpd-19) | 0.014 |

-continued

| (5) (Red-sensitive emulsion layer) | |
|---|---|
| Color image stabilizer (UV-5) | 0.04 |
| Solvent (Solv-5) | 0.04 |

| (6) (2nd Non-color-forming cyan-coupler layer) | |
|---|---|
| Gelatin | 0.36 |
| Cyan coupler (ExC-1) | 0.014 |
| Cyan coupler (ExC-2) | 0.002 |
| Cyan coupler (ExC-3) | 0.005 |
| Color image stabilizer (Cpd-1) | 0.01 |
| Color image stabilizer (Cpd-7) | 0.003 |
| Color image stabilizer (Cpd-9) | 0.013 |
| Color image stabilizer (Cpd-10) | 0.0003 |
| Color image stabilizer (Cpd-14) | 0.0003 |
| Color image stabilizer (Cpd-15) | 0.059 |
| Color image stabilizer (Cpd-16) | 0.0006 |
| Color image stabilizer (Cpd-17) | 0.0003 |
| Color image stabilizer (Cpd-18) | 0.016 |
| Color image stabilizer (Cpd-19) | 0.013 |
| Color image stabilizer (UV-5) | 0.03 |
| Solvent (Solv-5) | 0.03 |

(Preparation of Samples 205 to 207)

Sample 205 was prepared in the same manner as Sample 201, except that the coating amount of silver in the red-sensitive layer was changed to 0.24 g/m$^2$

.

Samples 206 and 207 were prepared in the same manner as Samples 203 and 204, respectively, except that the coating amount of silver in the red-sensitive emulsion layer was changed to 0.24 g/m$^2$.

(Evaluation of the Light-sensitive Materials)

In conformity with Example 1, each sample was exposed to red light, subjected to Processing B, and then examined for cyan density.

The maximum cyan density Dmax(C) of each of Samples 201 to 207 and the cyan density difference ΔDmax caused in each of Samples 201 to 207 by the storage under high humidity are shown in Table 3.

The total Cpd-4 coating amount of two color-mixing-inhibiting layers in each sample is expressed in relative value, taking that of Sample 201 as 100.

TABLE 3

| Sample No. | Red-sensitive emulsion layer: Coating amount of silver(g/m$^2$) | Red-sensitive emulsion layer: Coating amount of gelatin(g/m$^2$) | Red-sensitive emulsion layer: Silver/hydrophilic binder ratio | Red-sensitive emulsion layer: Multilayered cyan color-forming layer | Coating amount of Cpd-4 in Color-mixing-inhibiting layers | Dmax(C) (Processing B) | Δ Dmax after high humidity storage |
|---|---|---|---|---|---|---|---|
| 201 | 0.10 | 1.11 | 0.09 | None | 100 | 2.03 | −0.16 |
| 202 | 0.10 | 0.39 | 0.26 | None | 112 | 1.87 | −0.23 |
| 203 | 0.10 | 0.67 | 0.15 | Exist | 84 | 2.15 | −0.11 |
| 204 | 0.10 | 0.39 | 0.26 | Exist | 70 | 2.22 | −0.02 |
| 205 | 0.24 | 1.11 | 0.21 | None | 118 | 2.20 | −0.18 |
| 206 | 0.24 | 0.67 | 0.36 | Exist | 104 | 2.22 | −0.15 |
| 207 | 0.24 | 0.39 | 0.62 | Exist | 97 | 2.22 | −0.12 |

Samples 201, 203, and 204, provided with red-sensitive emulsion layers having the same coating amount of silver, had, in their respective emulsion layers, silver/hydrophilic binder ratios that were higher for each respective sample of a higher number, and the higher ratio shows that emulsion grains were concentrated on the central plane of each cyan color-forming layer. Sample 204, which had a reduced Cpd-4 coating amount, exhibited significant effect of lessening ΔDmax after storage under high humidity, and, in the case of Sample 204, satisfactory Dmax was achieved even by the ultra-rapid processing.

(Evaluation of Photographic Materials)

In conformity with Example 2, Sample 201, 203, 204 and 301 were exposed to red light, subjected to Processing B, and then examined for cyan density.

The maximum cyan density Dmax(C) of each of Samples 301, 201, 203, and 204 and the cyan density difference ΔDmax caused in each of Samples 301, 201, 203, and 204 after the storage under high humidity were obtained.

The results are shown in Table 4.

TABLE 4

| Sample No. | Coating amount of gelatin(g/m$^2$): Total | Coating amount of gelatin(g/m$^2$): Red-sensitive emulsion layer | Coating amount of gelatin(g/m$^2$): light-insensitive cyan coupler-containing layers | Gelatin coating amount ratio of cyan color-forming layer * | Multilayered cyan color-forming layer | Dmax(C) (Processing B) | Δ Dmax after high humidity storage |
|---|---|---|---|---|---|---|---|
| 201 | 5.97 | 1.11 | 0 | 0 | None | 2.03 | −0.16 |
| 203 | 5.97 | 0.67 | 0.44 | 0.66 | Exist | 2.15 | −0.11 |
| 204 | 5.97 | 0.39 | 0.72 | 1.85 | Exist | 2.22 | −0.02 |
| 301 | 5.97 | 0.50 | 0.61 | 1.22 | Exist | 2.20 | −0.06 |

* "Gelatin coating amount ratio of cyan color-forming layer" means a ratio of a gelatin coating amount in the light-insensitive cyan coupler-containing layers to that in the red-sensitive emulsion layer.

In Sample 207, in which the coating amount of silver of the emulsion layer having a multilayer structure was greater than 0.2 g/m$^2$, although the silver/hydrophilic binder ratio in the emulsion layer was not lower than 0.2, reduction in Cpd-4 coating amount was impossible and the improvement effect on ΔDmax after storage under high humidity was insufficient.

Example 3

Examples Relating to the Mode According to the Item (7) of the First Embodiment of the Present Invention (Preparation of Sample 301)

Sample 301 was prepared in the same manner as Sample 204, except that the coating amount of gelatin of the cyan coupler layer as the third layer and that of the cyan-coupler layer as the fifth layer (that is, the gelatin coating amounts of the (4) 1st and (6) 2nd non-color-forming cyan-coupler layers in Sample 204) were each changed to 0.305 g/m$^2$ and the coating amount of gelatin of the red-sensitive emulsion layer as the fourth layer (that is, the gelatin coating amount of the (5) red-sensitive emulsion layer in Sample 204) was changed to 0.50 g/m$^2$.

A comparison among Samples 203, 204, and 301, in which each cyan color-forming layer was constituted of three layers, shows that the change resulting from storage under high humidity was the smallest in Sample 204, in which the total gelatin coating amount of the non-color-forming cyan-coupler layers was greater than the gelatin coating amount of the red-sensitive emulsion layer, and the ratio between these gelatin coating amount values was greater than 1.0.

Example 4

Examples Related to the Mode According to the Item (8) of the First Embodiment of the Present Invention (Preparation of Sample 401)

The composition of each layer of Sample 401 is shown below; these layers were applied on the same support as in Sample 101. The numbers show coating amounts (g/m$^2$). In the case of the silver halide emulsion, the coating amount is in terms of silver.

Sample 401 was prepared in the same manner as Sample 201, except for the following changes.

The color-mixing-inhibiting layer as the second layer of Sample 201 was replaced by a unit constituted of the following three layers (1) to (3).

| (1) (1st Non-color-forming intermediate layer) | |
|---|---|
| Gelatin | 0.20 |
| Antiseptic (Ab-2) | 0.0025 |

| (2) (1st Color-mixing-inhibiting layer) | |
|---|---|
| Gelatin | 0.38 |
| Color-mixing inhibitor (Cpd-4) | 0.031 |
| Color image stabilizer (Cpd-5) | 0.006 |
| Color image stabilizer (Cpd-6) | 0.05 |
| Color image stabilizer (Cpd-7) | 0.006 |
| Color image stabilizer (UV-A) | 0.06 |
| Antiseptic (Ab-2) | 0.004 |
| Solvent (Solv-1) | 0.03 |
| Solvent (Solv-2) | 0.03 |
| Solvent (Solv-5) | 0.04 |
| Solvent (Solv-8) | 0.04 |

| (3) (1st Non-color-forming intermediate layer) | |
|---|---|
| Gelatin | 0.20 |
| Antiseptic (Ab-2) | 0.0025 |

Further, the fourth layer (Color-mixing inhibiting layer) was replaced by a unit constituted of the following three layers (4) to (6).

| (4) (2nd Non-color-forming intermediate layer) | |
|---|---|
| Gelatin | 0.16 |
| Antiseptic (Ab-2) | 0.002 |

| (5) (2nd Color-mixing-inhibiting layer) | |
|---|---|
| Gelatin | 0.33 |
| Color-mixing inhibitor (Cpd-4) | 0.025 |

-continued

| (5) (2nd Color-mixing-inhibiting layer) | |
|---|---|
| Color image stabilizer (Cpd-5) | 0.005 |
| Color image stabilizer (Cpd-6) | 0.04 |
| Color image stabilizer (Cpd-7) | 0.005 |
| Color image stabilizer (UV-A) | 0.05 |
| Antiseptic (Ab-2) | 0.003 |
| Solvent (Solv-1) | 0.03 |
| Solvent (Solv-2) | 0.03 |
| Solvent (Solv-5) | 0.03 |
| Solvent (Solv-8) | 0.03 |

| (6) (2nd Non-color-forming intermediate layer) | |
|---|---|
| Gelatin | 0.16 |
| Antiseptic (Ab-2) | 0.002 |

(Preparation of Sample 402)

Sample 402 was prepared in the same manner as Sample 401, except that the coating amounts of gelatin in the 1st Color-mixing-inhibiting layer, each of the 1st Non-color-forming intermediate layers, the 2nd Color-mixing-inhibiting layer, and each of the 2nd Non-color-forming intermediate layers were changed to 0.28 g/m$^2$, 0.25 g/m$^2$, 0.25 g/m$^2$, and 0.2 g/m$^2$, respectively.

(Preparation of Sample 403)

Sample 403 was prepared in the same manner as Sample 401, except that all of the hydrophilic colloid layers were increased in gelatin coating amount by the same factor of 1.17.

(Evaluation of the Photographic Materials)

In conformity with Example 3, Dmax(C) and ΔDmax after storage under high humidity of the cyan density of each sample were evaluated.

(Drying Characteristics)

Drying characteristic evaluations were performed on Samples 401 to 403 and Sample 201 by observation and examination by touch with fingers immediately after the processing according to the ultra-rapid Processing B. The drying characteristic criterion adopted for evaluation was as follows:

○: Sample was sufficiently dried

×: Sample was in a damp state and not yet dried

All results obtained are shown in Table 5.

TABLE 5

| | Coating amount of gelatin(g/m$^2$) | | | | | | |
|---|---|---|---|---|---|---|---|
| Sample No. | Total | Color-mixing inhibiting layers | Non-color-forming intermediate layers | Multilayered color-mixing-inhibiting layer | Dmax(C) (Processing B) | Δ Dmax after high humidity storage | Drying characteristics |
| 201 | 5.97 | 1.43 | 0 | None | 2.03 | −0.16 | ○ |
| 401 | 5.97 | 0.71 | 0.72 | Exist | 2.15 | −0.02 | ○ |
| 402 | 5.97 | 0.53 | 0.90 | Exist | 2.23 | −0.01 | ○ |
| 403 | 6.98 | 0.88 | 0.89 | Exist | 2.13 | −0.02 | X |

As can be seen from Table 5, Samples 401 and 402, in which the color-mixing-inhibiting layer was constituted of three layers, were excellent in each of color formation under ultra-rapid processing, changes resulting from storage under high humidity, and drying characteristics. On the other hand, Sample 403, in which the total gelatin coating amount was greater than 6.0 g/m$^2$, despite that the color-mixing-inhibiting layer had a three-layer structure, had a problem with its drying characteristics.

Example 5

The effects of the modes according to the item (6) of the first embodiment of the present invention are described below.

(Preparation of Samples 501 and 502)

Sample 501 was prepared in the same manner as Sample 204 in Example 2, except that the total coating amount of Color-mixing inhibitor Cpd-4 used in the second and sixth layers (that is, the first and second color-mixing inhibiting layers) was changed from $2.7\times10^{-4}$ mol/m$^2$ to $3\times10^{-5}$ mol/m$^2$. Sample 502 was prepared in the same manner as Sample 204 in Example 2, except that Cpd-4 was not included. The total coating amount of Cpd-4 in the second and sixth layers in Sample 501 was 0.11 times that of Sample 204.

(Preparation of Sample 503)

Sample 503 was prepared in the same manner as Sample 204, except that all of the hydrophilic colloid layers were increased in coating amount of gelatin by the same factor of 1.17.

(Evaluation of Photographic Materials)

In conformity with Examples 1 and 4, Dmax(C), ΔDmax after storage under high humidity, and drying characteristics of the cyan density of each sample were evaluated.

Further, color impurity was evaluated in the following manner.

Each sample was exposed to blue light and green light, and subjected to the development Processing B. The cyan density under the exposure providing a yellow density of 1.5 in a yellow color-developed area was measured, and thereby color impurity D(C/Y) was determined. Likewise, the cyan density under the exposure providing a magenta density of 1.5 in a magenta color-developed area was measured, and thereby color impurity D(C/M) was determined.

All results obtained are shown in Table 6.

Samples 501 and 502, in which the cyan color-forming layer was constituted of three layers, were satisfactory in Dmax(C) and the change resulting from storage under high humidity, but they were seriously inferior in color impurity because the coating amount of color-mixing inhibitor Cpd-4 was less than $5\times10^{-5}$ mole/m$^2$. As such, these samples were dismissed as impractical. Sample 503, having a coating amount of gelatin greater than 6.0 g/m$^2$ was inferior in drying characteristics and lacking in suitability for ultra-rapid processing. On the other hand, Sample 204, meeting the requirements of the mode of the above item (6) in the first embodiment of the present invention, was found to be superior in all the experimental items shown in Table 6.

Example 6

Working Examples of the Modes According to the Items (2) to (12) of the First Embodiment of the Present Invention Preparation of Sample 601

The composition of each layer of Sample 601 is shown below; these layers were applied on the same support as in Sample 101. The numbers show coating amounts (g/m$^2$). In the case of the silver halide emulsion, the coating amount is in terms of silver.

| First layer (Blue-sensitive emulsion layer) | |
|---|---|
| Emulsion (a 5:5 mixture of BH-1 and BL-1 (mol ratio of silver)) | 0.16 |
| Gelatin | 0.56 |
| Yellow coupler (Ex-Y) | 0.17 |
| Color image stabilizer (Cpd-1) | 0.005 |
| Color image stabilizer (Cpd-2) | 0.005 |
| Color image stabilizer (Cpd-8) | 0.004 |
| Color image stabilizer (Cpd-18) | 0.005 |
| Color image stabilizer (Cpd-19) | 0.01 |
| Color image stabilizer (Cpd-20) | 0.08 |
| Color image stabilizer (Cpd-21) | 0.005 |
| Color image stabilizer (Cpd-23) | 0.08 |
| Additive (ExC-1) | 0.0005 |
| Color image stabilizer (UV-A) | 0.005 |
| Solvent (Solv-4) | 0.06 |
| Solvent (Solv-6) | 0.01 |
| Solvent (Solv-9) | 0.06 |

TABLE 6

| Sample No. | Coating amount of gelatin(g/m$^2$) | Layer in multiplayer form | Coating amount of Cpd-4(mol/m$^2$) | Dmax Processing B | Δ Dmax after high humidity storage | Color impurity D(C/Y) | Color impurity D(C/M) | Drying characteristics Processing B |
|---|---|---|---|---|---|---|---|---|
| 204 | 5.97 | Cyan color-forming layer | $2.7\times10^{-4}$ | 2.22 | −0.02 | 0.15 | 0.18 | ○ |
| 501 | 5.97 | Cyan color-forming layer | $3.0\times10^{-5}$ | 2.31 | 0 | 0.38 | 0.40 | ○ |
| 502 | 5.97 | Cyan color-forming layer | 0 | 2.31 | 0 | 0.38 | 0.40 | ○ |
| 503 | 6.98 | Cyan color-forming layer | $2.7\times10^{-4}$ | 2.25 | −0.01 | 0.18 | 0.15 | X |

| Second layer (Light-insensitive yellow-coupler layer) | |
|---|---|
| Gelatin | 0.56 |
| Yellow coupler (Ex-Y) | 0.17 |
| Color image stabilizer (Cpd-1) | 0.005 |
| Color image stabilizer (Cpd-2) | 0.005 |
| Color image stabilizer (Cpd-8) | 0.004 |
| Color image stabilizer (Cpd-18) | 0.005 |
| Color image stabilizer (Cpd-19) | 0.01 |
| Color image stabilizer (Cpd-20) | 0.08 |
| Color image stabilizer (Cpd-21) | 0.005 |
| Color image stabilizer (Cpd-23) | 0.08 |
| Additive (ExC-1) | 0.0005 |
| Color image stabilizer (UV-A) | 0.005 |
| Solvent (Solv-4) | 0.06 |
| Solvent (Solv-6) | 0.01 |
| Solvent (Solv-9) | 0.06 |

| Third layer (1st Non-color-forming intermediate layer) | |
|---|---|
| Gelatin | 0.17 |
| Color image stabilizer (Cpd-5) | 0.002 |
| Color image stabilizer (Cpd-6) | 0.02 |
| Color image stabilizer (Cpd-7) | 0.002 |
| Antiseptic (Ab-2) | 0.001 |
| Color image stabilizer (UV-A) | 0.02 |
| Solvent (Solv-1) | 0.01 |
| Solvent (Solv-2) | 0.01 |
| Solvent (Solv-5) | 0.01 |
| Solvent (Solv-8) | 0.01 |

| Fourth layer (1st Color-mixing-inhibiting layer) | |
|---|---|
| Gelatin | 0.32 |
| Color-mixing inhibitor (Cpd-4) | 0.031 |
| Color image stabilizer (Cpd-5) | 0.004 |
| Color image stabilizer (Cpd-6) | 0.03 |
| Color image stabilizer (Cpd-7) | 0.003 |
| Antiseptic (Ab-2) | 0.004 |
| Color image stabilizer (UV-A) | 0.03 |
| Solvent (Solv-1) | 0.02 |
| Solvent (Solv-2) | 0.02 |
| Solvent (Solv-5) | 0.02 |
| Solvent (Solv-8) | 0.02 |

| Fifth layer (1st Non-color-forming intermediate layer) | |
|---|---|
| Gelatin | 0.17 |
| Color image stabilizer (Cpd-5) | 0.002 |
| Color image stabilizer (Cpd-6) | 0.02 |
| Color image stabilizer (Cpd-7) | 0.002 |
| Antiseptic (Ab-2) | 0.001 |
| Color image stabilizer (UV-A) | 0.02 |
| Solvent (Solv-1) | 0.01 |
| Solvent (Solv-2) | 0.01 |
| Solvent (Solv-5) | 0.01 |
| Solvent (Solv-8) | 0.01 |

| Sixth layer (1st Non-color-forming magenta-coupler layer) | |
|---|---|
| Gelatin | 0.27 |
| Magenta coupler (ExM) | 0.04 |

-continued

| Sixth layer (1st Non-color-forming magenta-coupler layer) | |
|---|---|
| Ultraviolet absorber (UV-A) | 0.01 |
| Color image stabilizer (Cpd-2) | 0.0033 |
| Color image stabilizer (Cpd-6) | 0.027 |
| Color image stabilizer (Cpd-7) | 0.0017 |
| Color image stabilizer (Cpd-8) | 0.0033 |
| Color image stabilizer (Cpd-9) | 0.0033 |
| Color image stabilizer (Cpd-10) | 0.0017 |
| Color image stabilizer (Cpd-11) | 0.000033 |
| Color image stabilizer (Cpd-20) | 0.033 |
| Solvent (Solv-3) | 0.02 |
| Solvent (Solv-4) | 0.04 |
| Solvent (Solv-6) | 0.017 |
| Solvent (Solv-9) | 0.027 |

| Seventh layer (Green-sensitive emulsion layer) | |
|---|---|
| Emulsion (a 1:3 mixture of GH-1 and GL-1 (mol ratio of silver)) | 0.12 |
| Gelatin | 0.26 |
| Magenta coupler (ExM) | 0.04 |
| Ultraviolet absorber (UV-A) | 0.01 |
| Color image stabilizer (Cpd-2) | 0.0033 |
| Color image stabilizer (Cpd-6) | 0.027 |
| Color image stabilizer (Cpd-7) | 0.0017 |
| Color image stabilizer (Cpd-8) | 0.0033 |
| Color image stabilizer (Cpd-9) | 0.0033 |
| Color image stabilizer (Cpd-10) | 0.0017 |
| Color image stabilizer (Cpd-11) | 0.000033 |
| Color image stabilizer (Cpd-20) | 0.033 |
| Solvent (Solv-3) | 0.02 |
| Solvent (Solv-4) | 0.04 |
| Solvent (Solv-6) | 0.017 |

| Eighth layer (2nd Non-color-forming magenta-coupler layer) | |
|---|---|
| Gelatin | 0.27 |
| Magenta coupler (ExM) | 0.04 |
| Ultraviolet absorber (UV-A) | 0.01 |
| Color image stabilizer (Cpd-2) | 0.0033 |
| Color image stabilizer (Cpd-6) | 0.027 |
| Color image stabilizer (Cpd-7) | 0.0017 |
| Color image stabilizer (Cpd-8) | 0.0033 |
| Color image stabilizer (Cpd-9) | 0.0033 |
| Color image stabilizer (Cpd-10) | 0.0017 |
| Color image stabilizer (Cpd-11) | 0.000033 |
| Color image stabilizer (Cpd-20) | 0.033 |
| Solvent (Solv-3) | 0.02 |
| Solvent (Solv-4) | 0.04 |
| Solvent (Solv-6) | 0.017 |
| Solvent (Solv-9) | 0.027 |

| Ninth layer (2nd Non-color-forming intermediate layer) | |
|---|---|
| Gelatin | 0.14 |
| Color-mixing inhibitor (Cpd-4) | 0.006 |
| Color image stabilizer (Cpd-5) | 0.001 |
| Color image stabilizer (Cpd-6) | 0.01 |
| Color image stabilizer (Cpd-7) | 0.001 |
| Antiseptic (Ab-2) | 0.002 |
| Color image stabilizer (UV-A) | 0.02 |
| Solvent (Solv-1) | 0.01 |
| Solvent (Solv-2) | 0.01 |

-continued

| Ninth layer (2nd Non-color-forming intermediate layer) | |
|---|---|
| Solvent (Solv-5) | 0.01 |
| Solvent (Solv-8) | 0.01 |

| Tenth layer (2nd Color-mixing-inhibiting layer) | |
|---|---|
| Gelatin | 0.28 |
| Color-mixing inhibitor (Cpd-4) | 0.012 |
| Color image stabilizer (Cpd-5) | 0.003 |
| Color image stabilizer (Cpd-6) | 0.02 |
| Color image stabilizer (Cpd-7) | 0.002 |
| Antiseptic (Ab-2) | 0.004 |
| Color image stabilizer (UV-A) | 0.03 |
| Solvent (Solv-1) | 0.02 |
| Solvent (Solv-2) | 0.02 |
| Solvent (Solv-5) | 0.02 |
| Solvent (Solv-8) | 0.02 |

| Eleventh layer (2nd Non-color-forming intermediate layer) | |
|---|---|
| Gelatin | 0.14 |
| Color-mixing inhibitor (Cpd-4) | 0.006 |
| Color image stabilizer (Cpd-5) | 0.001 |
| Color image stabilizer (Cpd-6) | 0.01 |
| Color image stabilizer (Cpd-7) | 0.001 |
| Antiseptic (Ab-2) | 0.002 |
| Color image stabilizer (UV-A) | 0.02 |
| Solvent (Solv-1) | 0.01 |
| Solvent (Solv-2) | 0.01 |
| Solvent (Solv-5) | 0.01 |
| Solvent (Solv-8) | 0.01 |

| Twelfth layer (1st Non-color-forming cyan-coupler layer) | |
|---|---|
| Gelatin | 0.29 |
| Cyan coupler (ExC-1) | 0.014 |
| Cyan coupler (ExC-2) | 0.002 |
| Cyan coupler (ExC-3) | 0.005 |
| Color image stabilizer (Cpd-1) | 0.01 |
| Color image stabilizer (Cpd-7) | 0.003 |
| Color image stabilizer (Cpd-9) | 0.013 |
| Color image stabilizer (Cpd-10) | 0.0003 |
| Color image stabilizer (Cpd-14) | 0.0003 |
| Color image stabilizer (Cpd-15) | 0.059 |
| Color image stabilizer (Cpd-16) | 0.0006 |
| Color image stabilizer (Cpd-17) | 0.0003 |
| Color image stabilizer (Cpd-18) | 0.016 |
| Color image stabilizer (Cpd-19) | 0.013 |
| Color image stabilizer (UV-5) | 0.03 |
| Solvent (Solv-5) | 0.03 |

| Thirteenth layer (Red-sensitive emulsion layer) | |
|---|---|
| Emulsion (a 4:6 mixture of RH-1 and RL-1 (mol ratio of silver)) | 0.10 |
| Gelatin | 0.32 |
| Cyan coupler (ExC-1) | 0.038 |
| Cyan coupler (ExC-2) | 0.004 |
| Cyan coupler (ExC-3) | 0.014 |
| Color image stabilizer (Cpd-1) | 0.01 |
| Color image stabilizer (Cpd-7) | 0.004 |

-continued

| Thirteenth layer (Red-sensitive emulsion layer) | |
|---|---|
| Color image stabilizer (Cpd-9) | 0.014 |
| Color image stabilizer (Cpd-10) | 0.0004 |
| Color image stabilizer (Cpd-14) | 0.0004 |
| Color image stabilizer (Cpd-15) | 0.062 |
| Color image stabilizer (Cpd-16) | 0.0008 |
| Color image stabilizer (Cpd-17) | 0.0004 |
| Color image stabilizer (Cpd-18) | 0.018 |
| Color image stabilizer (Cpd-19) | 0.014 |
| Color image stabilizer (UV-5) | 0.04 |
| Solvent (Solv-5) | 0.04 |

| Fourteenth layer (2nd non-color-forming cyan-coupler layer) | |
|---|---|
| Gelatin | 0.29 |
| Cyan coupler (ExC-1) | 0.014 |
| Cyan coupler (ExC-2) | 0.002 |
| Cyan coupler (ExC-3) | 0.005 |
| Color image stabilizer (Cpd-1) | 0.01 |
| Color image stabilizer (Cpd-7) | 0.003 |
| Color image stabilizer (Cpd-9) | 0.013 |
| Color image stabilizer (Cpd-10) | 0.0003 |
| Color image stabilizer (Cpd-14) | 0.0003 |
| Color image stabilizer (Cpd-15) | 0.059 |
| Color image stabilizer (Cpd-16) | 0.0006 |
| Color image stabilizer (Cpd-17) | 0.0003 |
| Color image stabilizer (Cpd-18) | 0.016 |
| Color image stabilizer (Cpd-19) | 0.013 |
| Color image stabilizer (UV-5) | 0.03 |
| Solvent (Solv-5) | 0.03 |

| Fifteenth layer (Ultraviolet absorbing layer) | |
|---|---|
| Gelatin | 0.29 |
| Ultraviolet absorber (UV-B) | 0.24 |
| Compound (S1-4) | 0.0015 |
| Solvent (Solv-7) | 0.11 |

| Sixteenth layer (Protective layer) | |
|---|---|
| Gelatin | 0.70 |
| Additive (Cpd-22) | 0.03 |
| Liquid paraffin | 0.02 |
| Surfactant (Cpd-13) | 0.02 |

In Sample 601, the total silver coating amount was 0.38 $g/m^2$, and the total gelatin coating amount was 5.08 $g/m^2$.

In conformity with Examples 1 and 4, evaluations of color generation with the rapid Processing B, change resulting from the storage under high humidity, silver removal characteristics and drying characteristics were performed on Sample 601. And all the evaluation results obtained were excellent.

Example 7

This example demonstrates that the light-sensitive materials according to the present invention can suppress processing unevenness from occurring, which processing unevenness occurs when subjected to ultra-rapid processing, after storage.

Sample 701 was prepared in the same manner as Sample 201, except that all of the hydrophilic colloid layers were increased in coating amount of gelatin by the same factor of 1.17, to make the sample include 6.98 g/m$^2$ of gelatin in total. In addition, Sample 702 was prepared in the same manner as Sample 201, except that all of the hydrophilic colloid layers were decreased in coating amount of gelatin by the same factor of 0.85, to make the sample include 5.08 g/m$^2$ of gelatin in total.

Among the samples in the previous Examples 1 to 6, the samples shown in Table 7 below were used for evaluations.

Each sample was stored at a temperature of 25° C. and a relative humidity of 55% for 7 days after coating, and further stored at a temperature of 30° C. and a relative humidity of 50% for 30 days. The thus-stored samples were each subjected to the aforementioned exposure using digital information recorded with a digital camera. They were subjected to ultra-rapid processing B. 10 sheets of color print were produced for each of the samples, and a visual observation of unevenness of each print was made and evaluated according to the following criterion.

A: Uneven density was hardly observed, so the print quality was excellent.

B: Uneven density was slightly observed on 1 to 3 out of 10 sheets.

C: Uneven density was clearly observed on 1 to 3 out of 10 sheets, so the print quality was poor.

D: Uneven density was clearly observed on almost all of 10 sheets, so the print quality was unacceptable.

The results are summarized and shown in Table 7.

Further, each of the samples was evaluated A, when they were subjected to Processing A, which was not an ultra-rapid processing.

TABLE 7

| Sample No. | Coating amount of gelatin (g/m$^2$) | Coating amount of silver (g/m$^2$) | Layer in multilayered structure | Unevenness after storage |
|---|---|---|---|---|
| 101 | 5.97 | 0.38 | None | C |
| 102 | 5.97 | 0.38 | Magenta color-forming layer | A |
| 103 | 5.97 | 0.38 | Color-mixing-inhibiting layer | A |
| 104 | 5.97 | 0.38 | Magenta color-forming layer<br>Color-mixing-inhibiting layer | A |
| 105 | 5.97 | 0.55 | None | A |
| 106 | 5.97 | 0.55 | Magenta color-forming layer | A |
| 107 | 5.97 | 0.55 | Color-mixing-inhibiting layer | A |
| 108 | 5.97 | 0.33 | None | D |
| 109 | 5.97 | 0.33 | Magenta color-forming layer | A |
| 110 | 5.97 | 0.33 | Color-mixing-inhibiting layer | A |
| 111 | 5.97 | 0.33 | Magenta color-forming layer<br>Color-mixing-inhibiting layer | A |
| 201 | 5.97 | 0.38 | None | C |
| 203 | 5.97 | 0.38 | Cyan color-forming layer | A |
| 204 | 5.97 | 0.38 | Cyan color-forming layer | A |
| 701 | 6.98 | 0.38 | None | A |
| 702 | 5.08 | 0.38 | None | D |
| 601 | 5.08 | 0.38 | Yellow color-forming layer<br>Magenta color-forming layer<br>Cyan color-forming layer<br>Color-mixing-inhibiting layer | A |

Among the samples not having any color-forming layer nor color-mixing-inhibiting layer in multilayer structure, processing unevenness was not observed in the samples, which contained a large amount of silver or gelatin and thus were not suited for ultra-rapid processing (i.e., Sample 105 compared with Sample 101, and Sample 701 compared with Sample 201); while processing unevenness was worsen in the samples, which had a reduced silver or gelatin amount and thus suited for ultra-rapid processing (i.e., Samples 108 and 702).

By imparting a multilayer structure according to the present invention, to a color-forming layer and/or a color-mixing-inhibiting layer, processing unevenness in ultra-rapid processing, could be effectively prevented.

Example 8

Effects of the modes according to the Second embodiment of the present invention are explained.

(Preparation of Blue-sensitive Emulsion Bm-1)

Using a method of simultaneously adding silver nitrate and sodium chloride mixed into stirring deionized distilled water containing deionized gelatin, high silver chloride cubic grains were prepared. In this preparation, at the step of from 60% to 80% addition of the entire silver nitrate amount, $CS_2[OSCl_5(NO)]$ was added. At the step of from 80% to 90% addition of the entire silver nitrate amount, potassium bromide (1.5 mol % per mol of the finished silver halide) and $K_4[Fe(CN)_6]$ were added. $K_2[IrCl_6]$ was added at the step of from 83% to 88% addition of the entire silver nitrate amount. Further, $K_2[IrCl_5(H_2O)]$ and $K[IrCl_4(H_2O)_2]$ were added at the step of from 92% to 98% addition of the entire silver nitrate amount. Potassium iodide (0.27 mol % per mol of the finished silver halide) was added, with vigorous stirring, at the step of completion of 94% addition of the entire silver nitrate amount. The thus-obtained emulsion grains were monodisperse cubic silver iodobromochloride grains having a side length of 0.54 μm and a variation coefficient of 8.5%. After being subjected to a sedimentation desalting treatment, the following were added to the resulting emulsion: gelatin, Compounds Ab-1, Ab-2, Ab-3, and Ab-4, and calcium nitrate, and the emulsion was re-dispersed.

(Ab-1) Antiseptic

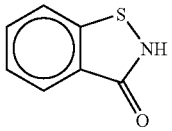

(Ab-2) Antiseptic

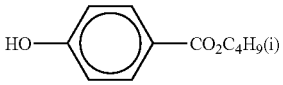

(Ab-3) Antiseptic

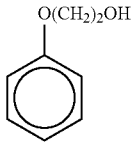

(Ab-1) Antiseptic

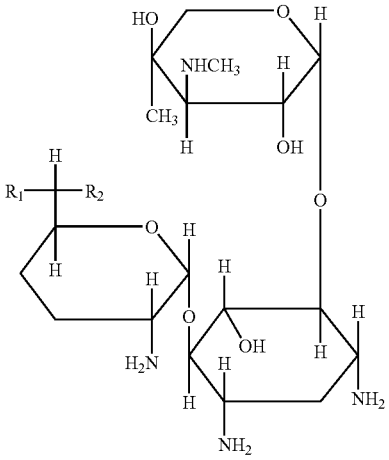

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture in 1:1:1:1 (molar ratio) of a, b, c, and d

The re-dispersed emulsion was dissolved at 40° C., and sensitizing dye S-1, sensitizing dye S-2, and sensitizing dye S-3 were added for optimal spectral sensitization. Then, the resulting emulsion was ripened by adding sodium benzene thiosulfate, triethylthiourea as a sulfur sensitizer, and Compound-1 as a gold sensitizer for optimal chemical sensitization. Further, 1-(5-methyl ureidophenyl)-5-mercaptotetrazole; Compound-2; a mixture whose major components are compounds represented by Compound-3 in which the repeating unit (n) is 2 or 3 (both ends $X_1$ and $X_2$ are each a hydroxyl group); Compound-4, and potassium bromide were added, to finalize chemical sensitization. The thus-obtained emulsion was referred to as Emulsion Bm-1.

Sensitizing dye S-1

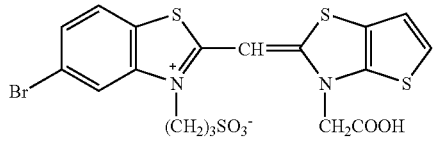

Sensitizing dye S-2

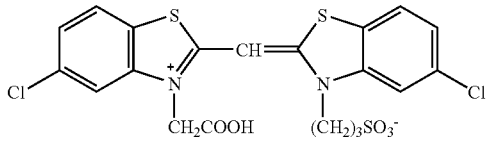

Sensitizing dye S-3

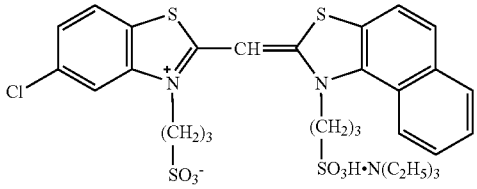

Compound - 1

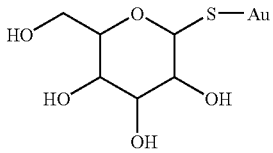

Compound - 2

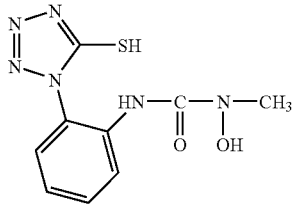

Compound - 3

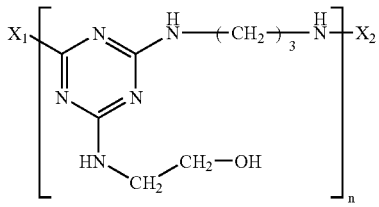

Compound - 4

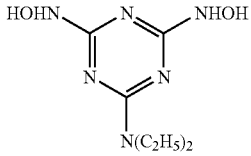

(Preparation of Blue-sensitive Layer Emulsion Bm-2)

Emulsion grains were prepared in the same manner as in the preparation of Emulsion Bm-1, except that the temperature and the addition rate at the step of mixing the silver nitrate and sodium chloride by simultaneous addition were changed, and the amounts of respective metal complexes that were to be added during the addition of silver nitrate and sodium chloride were changed. The thus-obtained emulsion grains were monodisperse cubic silver iodobromochloride grains having a side length of 0.44 μm and a variation coefficient of 9.5%. After re-dispersion of this emulsion, Emulsion Bm-2 was prepared in the same manner as Emulsion Bm-1, except that the amounts of compounds to be added in the preparation of Bm-1 were changed.

(Preparation of Blue-sensitive Layer Emulsion Bm-3)

Emulsion grains were prepared in the same manner as in the preparation of Emulsion Bm-1, except that the temperature and the addition rate at the step of mixing silver nitrate and sodium chloride by simultaneous addition were changed, and the amounts of respective metal complexes that were to be added during the addition of silver nitrate and sodium chloride were changed. The thus-obtained emulsion grains were monodisperse cubic silver iodobromochloride grains having a side length of 0.35 μm and a variation coefficient of 10.7%. After re-dispersion of this emulsion, Emulsion Bm-3 was prepared in the same manner as Emulsion Bm-1, except that the amounts of compounds to be added in the preparation of Bm-1 were changed.

(Preparation of Green-sensitive Layer Emulsion Gm-1)

Using a method of simultaneously adding silver nitrate and sodium chloride mixed into stirring deionized distilled water containing a deionized gelatin, high silver chloride cubic grains were prepared. In this preparation, at the step of from 80% to 90% addition of the entire silver nitrate amount, $K_4[Ru(CN)_6]$ was added. At the step of from 80% to 100% addition of the entire silver nitrate amount, potassium bromide (2 mol % per mol of the finished silver halide) was added. Further, $K_2[IrCl_6]$ and $K_2[RhBr_5(H_2O)]$ were added at the step of from 83% to 88% addition of the entire silver nitrate amount. Potassium iodide (0.1 mol % per mol of the finished silver halide) was added with a vigorous stirring, at the step of completion of 90% addition of the entire silver nitrate amount. $K_2[IrCl_5(H_2O)]$ and $K[IrCl_4(H_2O)_2]$ were added at the step of from 92% to 98% addition of the entire silver nitrate amount. The thus-obtained emulsion grains were monodisperse cubic silver iodobromochloride grains having a side length of 0.40 μm and a variation coefficient of 7.7%. The resulting emulsion was subjected to a sedimentation desalting treatment and re-dispersing treatment in the same manner as described in the above.

The re-dispersed emulsion was dissolved at 40° C., and sodium benzenethiosulfate, p-glutaramidophenyldisulfide, sodium thiosulfate pentahydrate as a sulfur sensitizer, and (bis(1,4,5-trimethyl-1,2,4-triazolium-3-thiolate)aurate (I) tetrafluoroborate) as a gold sensitizer were added, and the emulsion was ripened for optimal chemical sensitization. Thereafter, 1-(3-acetamidophenyl)-5-mercaptotetrazole, 1-(5-methylureidophenyl)-5-mercaptotetrazole, Compound-2, Compound-4, and potassium bromide were added. Further, in a midway of the emulsion preparation step, sensitizing dye S-4, sensitizing dye S-5, sensitizing dye S-6, and sensitizing dye S-7 were added as sensitizing dyes, to conduct spectral sensitization. The thus-obtained emulsion was referred to as Emulsion Gm-1.

Sensitizing dye S-4

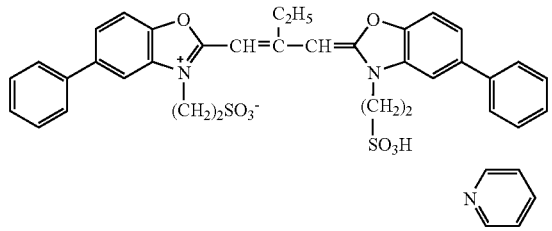

Sensitizing dye S-5

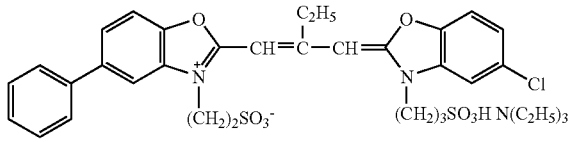

Sensitizing dye S-6

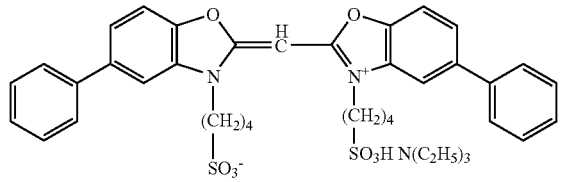

Sensitizing dye S-7

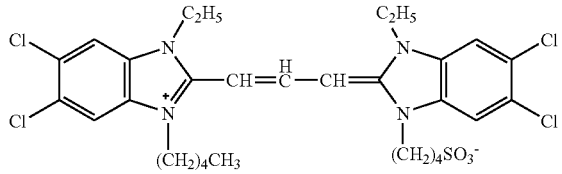

(Preparation of Red-sensitive Layer Emulsion Rm-1)

Using a method of simultaneously adding silver nitrate and sodium chloride mixed into stirring deionized distilled water containing deionized gelatin, high silver chloride cubic grains were prepared. In this preparation, at the step of from 60% to 80% addition of the entire silver nitrate amount, $CS_2[OsCl_5(NO)]$ was added. At the step of from 80% to 90% addition of the entire silver nitrate amount, $K_4[Ru(CN)_6]$ was added. At the step of from 80% to 100% addition of the entire silver nitrate amount, potassium bromide (1.3 mol % per mol of the finished silver halide) was added. Further, $K_2[IrCl_5(5\text{-methylthiazole})]$ was added at the step of from 83% to 88% addition of the entire silver nitrate amount. Potassium iodide (0.05 mol % per mol of the finished silver halide) was added, with vigorous stirring, at the step of completion of 88% addition of the entire silver nitrate amount. Further, $K_2[IrCl_5(H_2O)]$ and $K[IrCl_4(H_2O)_2]$ were added at the step of from 92% to 98% addition of the entire silver nitrate amount. The thus-obtained emulsion grains were monodisperse cubic silver iodobromochloride grains having a side length of 0.41 μm and a variation coefficient of 10.2%. The resulting emulsion was subjected to a sedimentation desalting treatment and re-dispersing treatment in the same manner as described in the above.

The re-dispersed emulsion was dissolved at 40° C., and sensitizing dye S-8, Compound-5, triethylthiourea as a sulfur sensitizer, Compound-1 as a gold sensitizer were added, and the emulsion was ripened for optimal chemical sensitization. Thereafter, 1-(3-acetamidophenyl)-5-mercaptotetrazole, 1-(5-methylureidophenyl)-5-mercaptotetrazole, Compound-2, Compound-4, and potassium bromide were added. The thus-obtained emulsion was referred to as Emulsion Rm-1.

Sensitizing dye S-8

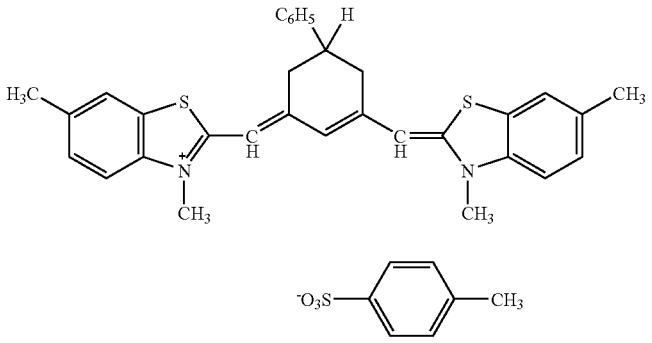

Compound -5

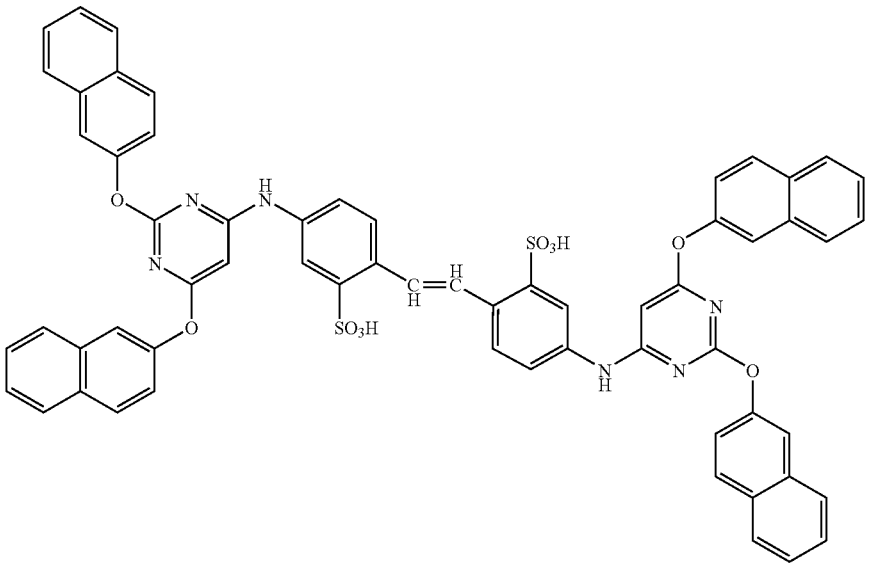

(Preparation of Emulsified Dispersion Bv-1)

Into 23 g of Solvent (Solv-4), 4 g of Solvent (Solv-6), 23 g of Solvent (Solv-9), and 60 ml of ethyl acetate were dissolved 34 g of Yellow coupler (Ex-Y), 1 g of Color-image stabilizer (Cpd-1), 1 g of Color-image stabilizer (Cpd-2), 8 g of Color-image stabilizer (Cpd-8), 1 g of Color-image stabilizer (Cpd-18), 2 g of Color-image stabilizer (Cpd-19), 15 g of Color-image stabilizer (Cpd-20), 1 g of Color-image stabilizer (Cpd-21), 15 g of Color-image stabilizer (Cpd-23), 0.1 g of Additive (ExC-1), and 1 g of Color-image stabilizer (UV-A) (hereinafter referred to as "Solution 1"). This solution was emulsified and dispersed in 270 g of a 20 mass % aqueous gelatin solution containing 4 g of sodium dodecylbenzenesulfonate with a high-speed stirring emulsifier (dissolver). Water was added thereto, to prepare 900 g of an emulsified dispersion Bv-1. The average particle size was 140 nm.

(Preparation of Emulsified Dispersion Bv-2)

The foregoing Solution 1 was added to and mixed with 270 g of a 20 mass % aqueous gelatin solution containing 4 g of sodium dodecylbenzenesulfonate. Thereto, water was added to make 900 g of a coarse dispersion. This coarse dispersion was emulsified and further dispersed by use of an Ultimaizer System HJP-25005 (trade name) made by Sugino Machine Limited. Herein, the dispersion was fed at a pressure of 150 MPa by means of a hydraulic pump, and passed through 0.1 mm ϕ diamond-made chamber nozzles. The dispersion flowed through the nozzles was emulsified and dispersed repeatedly over 5 times while cooling them at 40° C., to prepare an emulsified dispersion Bv-2. The average particle size of the thus emulsified dispersion was 100 nm.

(Preparation of Emulsified Dispersion Bv-3)

The foregoing Solution 1 was added to and mixed with 270 g of a 20 mass % aqueous gelatin solution containing 8 g of sodium dodecylbenzenesulfonate. Thereto, water was added to make 900 g of a coarse dispersion. This coarse dispersion was emulsified and further dispersed by use of an Ultimaizer System HJP-25005 made by Sugino Machine Limited. Herein, the dispersion was fed at a pressure of 210 MPa by means of a hydraulic pump, and passed through 0.1 mm+diamond-made chamber nozzles. The dispersion flowed through the nozzles was emulsified and dispersed repeatedly over 5 times while cooling them at 40° C., to prepare an emulsified dispersion Bv-3. The average particle size of the thus emulsified dispersion was 80 nm.

(Preparation of Emulsified Dispersion Bv-4)

The foregoing Solution 1 was added to and mixed with 270 g of a 20 mass % aqueous gelatin solution containing 8 g of sodium dodecylbenzenesulfonate. Thereto, water was added to make 900 g of a coarse dispersion. This coarse dispersion was emulsified and further dispersed by use of an Ultimaizer System HJP-25005 made by Sugino Machine Limited. Herein, the dispersion was fed at a pressure of 245 MPa by means of a hydraulic pump, and passed through 0.1 mm+diamond-made chamber nozzles. The dispersion flowed through the nozzles was emulsified and dispersed repeatedly over 5 times while cooling them at 40° C., to prepare an emulsified dispersion Bv-4. The average particle size of the thus emulsified dispersion was 60 nm.

(Preparation of Sample 801)

Preparation of First Layer Coating Solution

On the other hand, the above Emulsified dispersion Bv-1 and the prescribed Emulsion Bm-1 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, 1-oxy-3,5-dichloro-s-triazine sodium salt (H-1), (H-2), and (H-3) were used. Further, to each layer, were added Ab-1, Ab-2, Ab-3, and Ab-4, so that the total amounts would be 15.0 mg/m$^2$, 60.0 mg/m$^2$ 5.0 mg/m$^2$, and 10.0 mg/m$^2$, respectively.

(H-1) Hardener

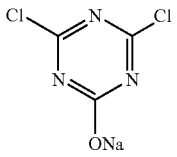

(H-2) Hardener

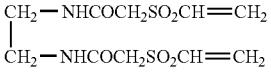

(H-3) Hardener

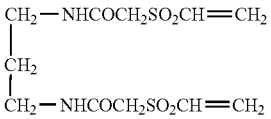

Further, to the second layer, the fourth layer, and the sixth layer, was added 1-(3-methylureidophenyl)-5-mercaptotetrazole in amounts of 0.2 mg/m$^2$, 0.2 mg/m$^2$, and 0.6 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$ Disodium salt of catecol-3,5-disulfonic acid was added to the second layer, the fourth layer, and the sixth layer so that coating amounts would be 6 mg/m$^2$, 6 mg/m$^2$ and 18 mg/m$^2$, respectively.

Further, to each layer, sodium polystyrene sulfonate was, if necessary, added to adjust viscosity of the coating solution.

Further, in order to prevent irradiation, the following dyes (coating amounts are shown in parentheses) were added.

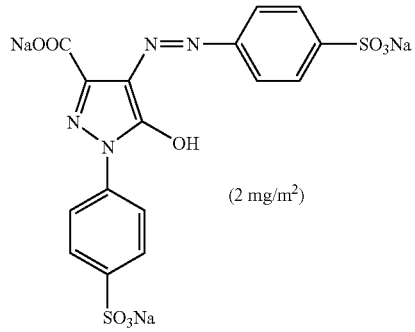

(2 mg/m$^2$)

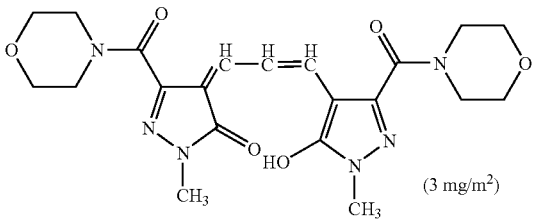

(3 mg/m$^2$)

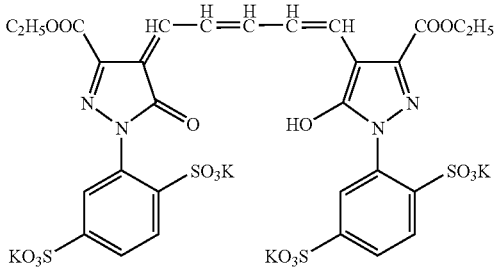

(10 mg/m$^2$)

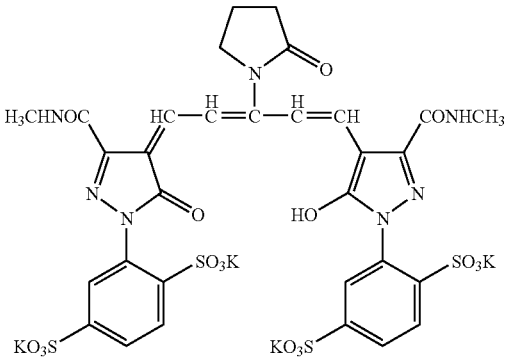

(16 mg/m$^2$)

Support

Polyethylene resin laminated paper {The polyethylene resin on the first layer side contained white pigments ($TiO_2$, content of 16 mass %; ZnO, content of 4 mass %), a fluorescent whitening agent (4,4'-bis(5-methylbenzoxazolyl)stilbene, content of 0.03 mass %) and a bluish dye (ultramarine, content of 0.33 mass %); the amount of polyethylene resin was 29.2 g/m$^2$}.

(Layer Constitution)

The composition of each layer provided on the above-described support is shown below. The numbers show coating amounts (g/m$^2$). In the case of the silver halide emulsion, the coating amount is in terms of silver.

| First layer (Blue-sensitive emulsion layer BL-1) | |
|---|---|
| Emulsion (Bm-1) | 0.16 |
| Gelatin | 1.32 |
| Yellow coupler (Ex-Y) | 0.34 |
| Color image stabilizer (Cpd-1) | 0.01 |
| Color image stabilizer (Cpd-2) | 0.01 |
| Color image stabilizer (Cpd-8) | 0.08 |
| Color image stabilizer (Cpd-18) | 0.01 |
| Color image stabilizer (Cpd-19) | 0.02 |
| Color image stabilizer (Cpd-20) | 0.15 |
| Color image stabilizer (Cpd-21) | 0.01 |
| Color image stabilizer (Cpd-23) | 0.15 |
| Additive (ExC-1) | 0.001 |
| Color image stabilizer (UV-A) | 0.01 |
| Solvent (Solv-4) | 0.12 |
| Solvent (Solv-6) | 0.02 |
| Solvent (Solv-9) | 0.12 |

Emulsified dispersion Bv-1 was used in the first layer.

| Second layer (1st Color-mixing-inhibiting layer MCS1-1) | |
|---|---|
| Gelatin | 0.78 |
| Color-mixing inhibitor (Cpd-4) | 0.05 |
| Color image stabilizer (Cpd-5) | 0.006 |
| Color image stabilizer (Cpd-6) | 0.05 |
| Color image stabilizer (Cpd-7) | 0.006 |
| Antiseptic (Ab-2) | 0.006 |
| Color image stabilizer (UV-A) | 0.06 |
| Solvent (Solv-1) | 0.03 |
| Solvent (Solv-2) | 0.03 |
| Solvent (Solv-5) | 0.04 |
| Solvent (Solv-8) | 0.04 |

| Third layer (Green-sensitive emulsion layer GL-1) | |
|---|---|
| Emulsion (Gm-1) | 0.12 |
| Gelatin | 0.95 |
| Magenta coupler (Ex-M) | 0.12 |
| Ultraviolet absorber (UV-A) | 0.03 |
| Color image stabilizer (Cpd-2) | 0.01 |
| Color image stabilizer (Cpd-6) | 0.08 |
| Color image stabilizer (Cpd-7) | 0.005 |
| Color image stabilizer (Cpd-8) | 0.01 |
| Color image stabilizer (Cpd-9) | 0.01 |
| Color image stabilizer (Cpd-10) | 0.005 |
| Color image stabilizer (Cpd-11) | 0.0001 |
| Color image stabilizer (Cpd-20) | 0.01 |
| Solvent (Solv-3) | 0.02 |
| Solvent (Solv-4) | 0.06 |
| Solvent (Solv-6) | 0.03 |
| Solvent (Solv-9) | 0.08 |

| Fourth layer (2nd Color-mixing-inhibiting layer MCS2-1) | |
|---|---|
| Gelatin | 0.65 |
| Color-mixing inhibitor (Cpd-4) | 0.04 |
| Color image stabilizer (Cpd-5) | 0.005 |
| Color image stabilizer (Cpd-6) | 0.04 |
| Color image stabilizer (Cpd-7) | 0.005 |
| Antiseptic (Ab-2) | 0.006 |
| Color image stabilizer (UV-A) | 0.05 |
| Solvent (Solv-1) | 0.03 |
| Solvent (Solv-2) | 0.03 |
| Solvent (Solv-5) | 0.03 |
| Solvent (Solv-8) | 0.03 |

| Fifth layer (Red-sensitive emulsion layer RL-1) | |
|---|---|
| Emulsion (Rm-1) | 0.10 |
| Gelatin | 1.11 |
| Cyan coupler (ExC-1) | 0.11 |
| Cyan coupler (ExC-2) | 0.01 |
| Cyan coupler (ExC-3) | 0.04 |
| Color image stabilizer (Cpd-1) | 0.03 |
| Color image stabilizer (Cpd-7) | 0.01 |
| Color image stabilizer (Cpd-9) | 0.04 |
| Color image stabilizer (Cpd-10) | 0.001 |
| Color image stabilizer (Cpd-14) | 0.001 |
| Color image stabilizer (Cpd-15) | 0.18 |
| Color image stabilizer (Cpd-16) | 0.002 |
| Color image stabilizer (Cpd-17) | 0.001 |
| Color image stabilizer (Cpd-18) | 0.05 |
| Color image stabilizer (Cpd-19) | 0.04 |
| Color image stabilizer (UV-5) | 0.10 |
| Solvent (Solv-5) | 0.10 |

| Sixth layer (Ultraviolet absorbing layer UV-1) | |
|---|---|
| Gelatin | 0.34 |
| Ultraviolet absorber (UV-B) | 0.24 |
| Compound (S1-4) | 0.0015 |
| Solvent (Solv-7) | 0.11 |

| Seventh layer (Protective layer PC-1) | |
|---|---|
| Gelatin | 0.82 |
| Additive (Cpd-22) | 0.03 |
| Liquid paraffin | 0.02 |
| Surfactant (Cpd-13) | 0.02 |

(Ex-Y)

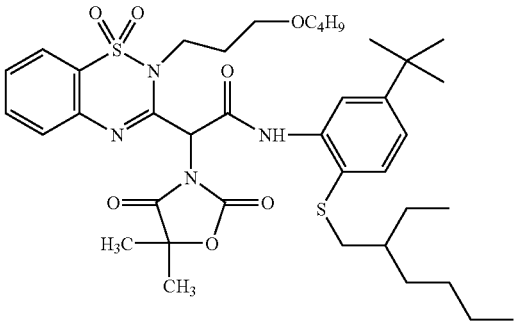

(Ex-M) Magenta coupler

A mixture in 40:40:20 (mol ratio) of

-continued

Seventh layer (Protective layer PC-1)

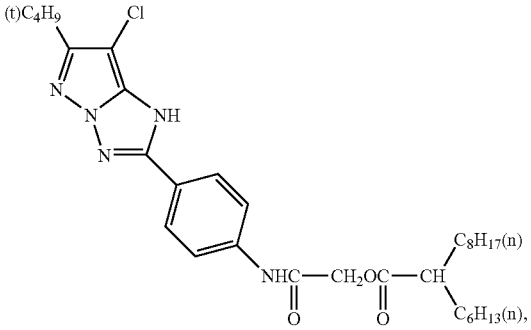

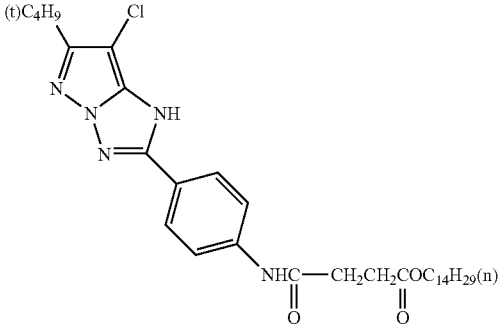

and

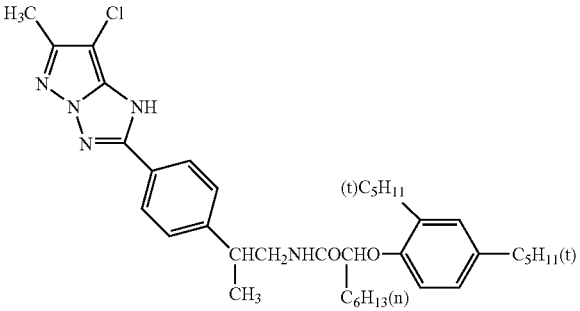

(ExC-1) Cyan coupler

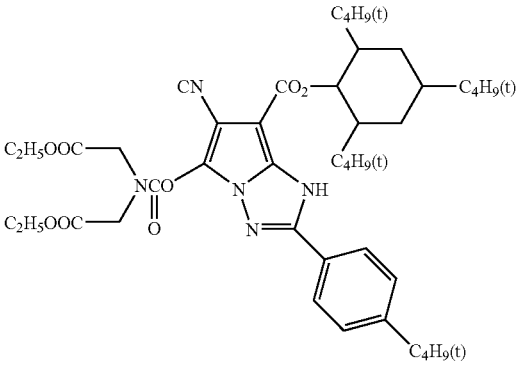

(ExC-2) Cyan coupler

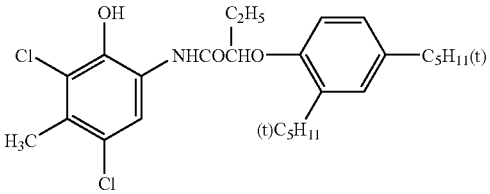

(ExC-3) Cyan coupler

-continued

Seventh layer (Protective layer PC-1)

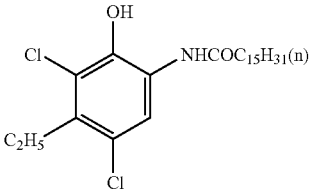

(Cpd-1) Color-image stabilizer

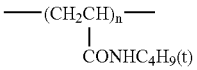

Number-average molecular mass 60,000

(Cpd-2) Color-image stabilizer

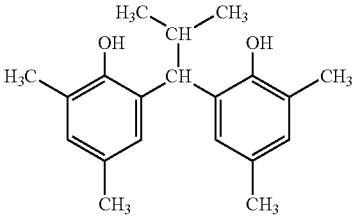

(Cpd-3) Color-image stabilizer

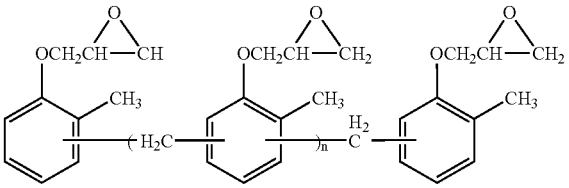

n = 7 ~ 8 (Average value)

(Cpd-4) Color-mixing inhibitor

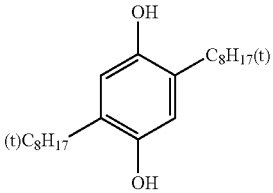

(Cpd-5) Color-image stabilizer

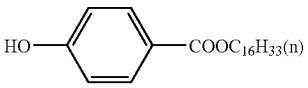

(Cpd-6) Color-image stabilizer

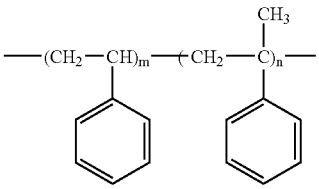

Number-average molecular mass 600, m/n = 10/90

(Cpd-7) Color-image stabilizer

-continued
Seventh layer (Protective layer PC-1)
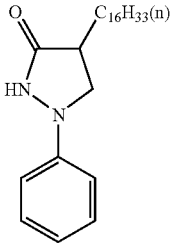
(Cpd-8) Color-image stabilizer
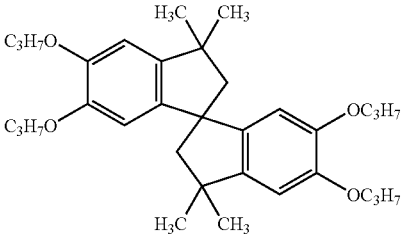
(Cpd-9) Color-image stabilizer
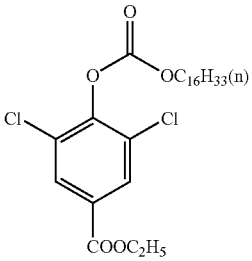
(Cpd-10) Color-image stabilizer
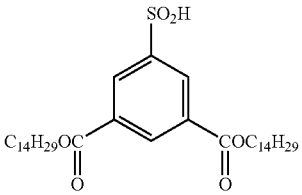
(Cpd-11)
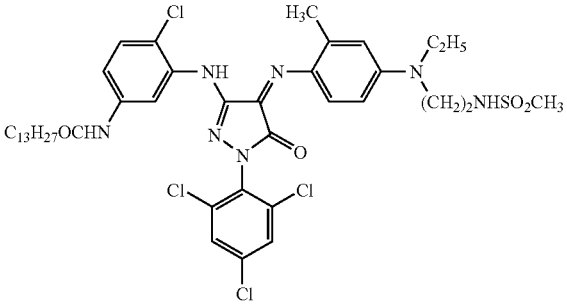
(Cpd-12)
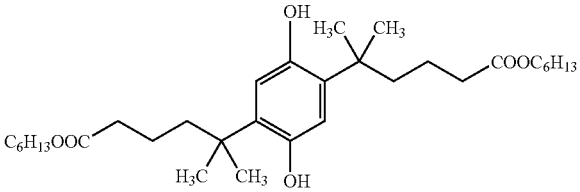
(Cpd-13)
A mixture in 6:2:2 (molar ratio) of (a), (b), and (c)
(a)
-continued
Seventh layer (Protective layer PC-1)
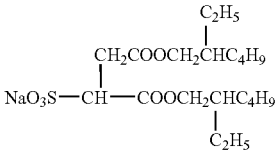
(b)
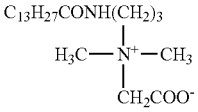
(c)
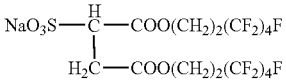
(Cpd-14)
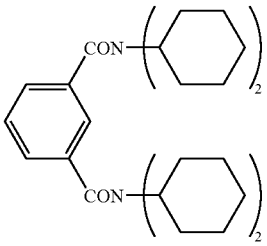
(Cpd-15)
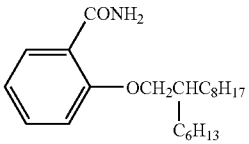
(Cpd-16)
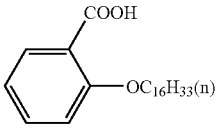
(Cpd-17)
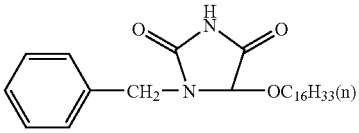
(Cpd-18)
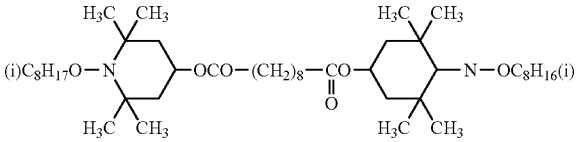
(Cpd-19)
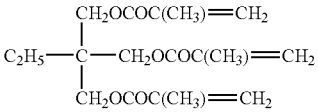
(Cpd-20)

-continued

Seventh layer (Protective layer PC-1)

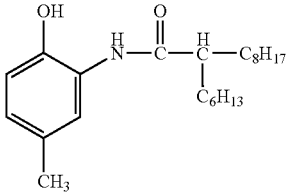

(Cpd-21)

$C(CH_2COCH_2CH_2SC_{12}H_{25})_4$ (=O)

(Cpd-22)

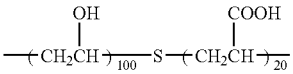

(Mass ratio)

(Cpd-23)

KAYARAD DPCA-30

(trade name, manufactured by Nippon Kayaku Co., Ltd.)

(Solv-1)

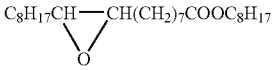

(Solv-2)

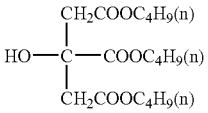

(Solv-3)

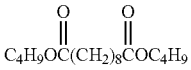

(Solv-4)

$O{=}P(OC_6H_{13}(n))_3$ (Solv-5)

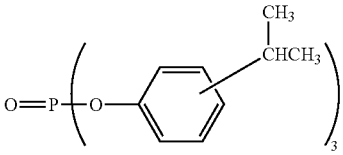

(Solv-6)

$C_8H_{17}CH{=}CH(CH_2)_8OH$ (Solv-7)

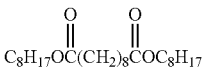

(Solv-8)

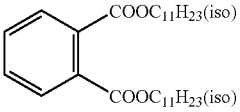

(Solv-9)

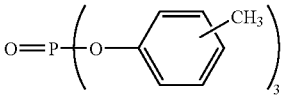

(S1-4)

-continued

Seventh layer (Protective layer PC-1)

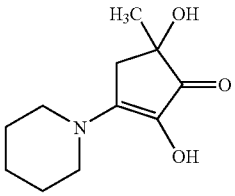

UV-A: A mixture of (UV-1) / (UV-4) / (UV-5) = 1 / 7 / 2 (mass ratio)

UV-B: A mixture of (UV-1) / (UV-2) / (UV-3) / (UV-4) / UV-5) = 1 / 1 / 2 / 3 / 3 (mass ratio)

(UV-1)

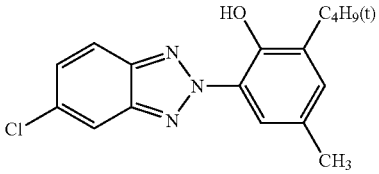

(UV-2)

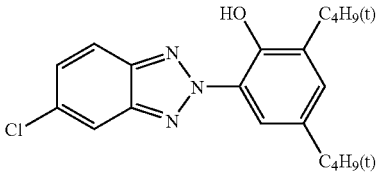

(UV-3)

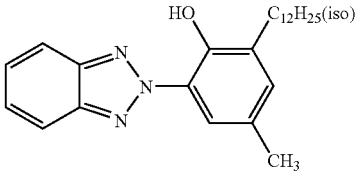

(UV-4)

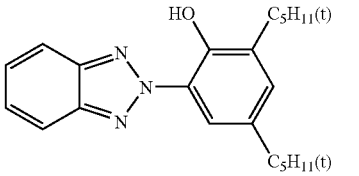

(UV-5)

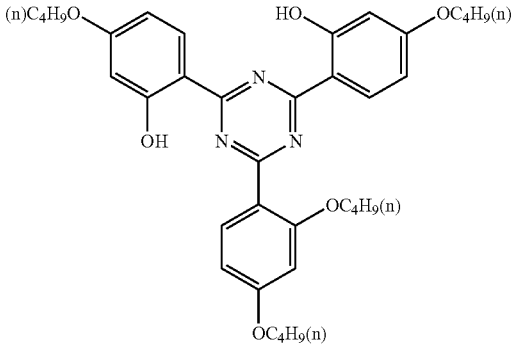

The thus prepared sample is referred to as Sample 801.

Sample 801 had a total coating amount of gelatin of 5.97 $g/m^2$ and a total coating amount of silver of 0.38 $g/m^2$.

In the following, the composition of each layer of the samples, which explain the present invention, is shown below. The numbers show coating amounts ($g/m^2$). In the case of the silver halide emulsion, the coating amount is in terms of silver.

1st Color-mixing-inhibiting layer MCS1-2

The same as MCS1-1 in Sample 801, except that the amount of Color-mixing inhibitor Cpd-4 was changed to 0.04 g/m$^2$.

| 1st Color-mixing-inhibiting layer MCS1-3 | |
|---|---|
| Gelatin | 0.39 |
| Color-mixing inhibitor (Cpd-4) | 0.04 |
| Color image stabilizer (Cpd-5) | 0.006 |
| Color image stabilizer (Cpd-6) | 0.05 |
| Color image stabilizer (Cpd-7) | 0.006 |
| Antiseptic (Ab-2) | 0.004 |
| Color image stabilizer (UV-A) | 0.06 |
| Solvent (Solv-1) | 0.03 |
| Solvent (Solv-2) | 0.03 |
| Solvent (Solv-5) | 0.04 |
| Solvent (Solv-8) | 0.04 |

1st Color-Mixing-Inhibiting layer MCS1-4

The same as MCS1-1 in Sample 801, except that the amount of Color-mixing inhibitor Cpd-4 was changed to 0.02 g/m$^2$.

2nd Color-mixing-inhibiting Layer MCS2-2

The same as MCS2-1 in Sample 801, except that the amount of Color-mixing inhibitor Cpd-4 was changed to 0.03 g/m$^2$.

| 2nd Color-mixing-inhibiting layer MCS2-3 | |
|---|---|
| Gelatin | 0.33 |
| Color-mixing inhibitor (Cpd-4) | 0.03 |
| Color image stabilizer (Cpd-5) | 0.005 |
| Color image stabilizer (Cpd-6) | 0.04 |
| Color image stabilizer (Cpd-7) | 0.005 |
| Antiseptic (Ab-2) | 0.004 |
| Color image stabilizer (UV-A) | 0.05 |
| Solvent (Solv-1) | 0.03 |
| Solvent (Solv-2) | 0.03 |
| Solvent (Solv-5) | 0.03 |
| Solvent (Solv-8) | 0.03 |

| 1st Non-color-forming intermediate layer MCN1-1 | |
|---|---|
| Gelatin | 0.195 |
| Antiseptic (Ab-2) | 0.002 |

| 2nd Non-color-forming intermediate layer MCN2-1 | |
|---|---|
| Gelatin | 0.16 |
| Antiseptic (Ab-2) | 0.002 |

Blue-sensitive emulsion Layer BL-2

The same as BL-1, except that the coating amount of silver of BL-1 was changed to 0.13 g/m$^2$.

| Blue-sensitive emulsion layer BL-3 | |
|---|---|
| Emulsion (Bm-1) | 0.13 |
| Gelatin | 0.66 |
| Yellow coupler (Ex-Y) | 0.17 |
| Color image stabilizer (Cpd-1) | 0.005 |
| Color image stabilizer (Cpd-2) | 0.005 |
| Color image stabilizer (Cpd-8) | 0.004 |
| Color image stabilizer (Cpd-18) | 0.005 |
| Color image stabilizer (Cpd-19) | 0.01 |
| Color image stabilizer (Cpd-20) | 0.08 |
| Color image stabilizer (Cpd-21) | 0.005 |
| Color image stabilizer (Cpd-23) | 0.08 |
| Additive (ExC-1) | 0.0005 |
| Color image stabilizer (UV-A) | 0.005 |
| Solvent (Solv-4) | 0.06 |
| Solvent (Solv-6) | 0.01 |
| Solvent (Solv-9) | 0.06 |

| Yellow-coupler layer YL-1 | |
|---|---|
| Gelatin | 0.66 |
| Yellow coupler (Ex-Y) | 0.17 |
| Color image stabilizer (Cpd-1) | 0.005 |
| Color image stabilizer (Cpd-2) | 0.005 |
| Color image stabilizer (Cpd-8) | 0.004 |
| Color image stabilizer (Cpd-18) | 0.005 |
| Color image stabilizer (Cpd-19) | 0.01 |
| Color image stabilizer (Cpd-20) | 0.08 |
| Color image stabilizer (Cpd-21) | 0.005 |
| Color image stabilizer (Cpd-23) | 0.08 |
| Additive (ExC-1) | 0.0005 |
| Color image stabilizer (UV-A) | 0.005 |
| Solvent (Solv-4) | 0.06 |
| Solvent (Solv-6) | 0.01 |
| Solvent (Solv-9) | 0.06 |

Green-sensitive emulsion Layer GL-2

The same as GL-1, except that the coating amount of silver of GL-1 was changed to 0.10 g/m$^2$.

| Green-sensitive emulsion layer GL-3 | |
|---|---|
| Emulsion (Gm-1) | 0.10 |
| Gelatin | 0.31 |
| Magenta coupler (Ex-M) | 0.04 |
| Ultraviolet absorber (UV-A) | 0.01 |
| Color image stabilizer (Cpd-2) | 0.0033 |
| Color image stabilizer (Cpd-6) | 0.027 |
| Color image stabilizer (Cpd-7) | 0.0017 |
| Color image stabilizer (Cpd-8) | 0.0033 |
| Color image stabilizer (Cpd-9) | 0.0033 |
| Color image stabilizer (Cpd-10) | 0.0017 |
| Color image stabilizer (Cpd-11) | 0.000033 |
| Color image stabilizer (Cpd-20) | 0.033 |
| Solvent (Solv-3) | 0.02 |
| Solvent (Solv-4) | 0.04 |
| Solvent (Solv-6) | 0.017 |

| Magenta-coupler layer ML-1 | |
|---|---|
| Gelatin | 0.32 |
| Magenta coupler (Ex-M) | 0.04 |
| Ultraviolet absorber (UV-A) | 0.01 |
| Color image stabilizer (Cpd-2) | 0.0033 |

-continued

| Magenta-coupler layer ML-1 | |
|---|---|
| Color image stabilizer (Cpd-6) | 0.027 |
| Color image stabilizer (Cpd-7) | 0.0017 |
| Color image stabilizer (Cpd-8) | 0.0033 |
| Color image stabilizer (Cpd-9) | 0.0033 |
| Color image stabilizer (Cpd-10) | 0.0017 |
| Color image stabilizer (Cpd-11) | 0.000033 |
| Color image stabilizer (Cpd-20) | 0.033 |
| Solvent (Solv-3) | 0.02 |
| Solvent (Solv-4) | 0.04 |
| Solvent (Solv-6) | 0.017 |
| Solvent (Solv-9) | 0.027 |

Red-sensitive emulsion Layer RL-2

The same as RL-1, except that the coating amount of silver of RL-1 was changed to 0.08 g/m$^2$.

In the following, the layer constitutions of Samples 802 to 805 are shown below, respectively, with that of Sample 801.

TABLE 8

| | Kind of layer constitution | | | | |
|---|---|---|---|---|---|
| | Layer constitution A Sample 801 | Layer constitution B Sample 802 | Layer constitution C1 Sample 803 | Layer constitution C2 Sample 804 | Layer constitution D1 Sample 805 |
| First layer | BL-1 | BL-2 | BL-2 | BL-2 | BL-3 |
| Second layer | MCS1-1 | MCS1-2 | MCN1-1 | MCS1-4 | YL-1 |
| Third layer | GL-1 | GL-2 | MCS1-3 | MCS1-3 | MCS1-2 |
| Forth layer | MCS2-1 | MCS2-2 | MCN1-1 | GL-2 | GL-2 |
| Fifth layer | RL-1 | RL-2 | GL-2 | MCS2-2 | MCS2-2 |
| Sixth layer | UV-1 | UV-1 | MCS2-2 | RL-2 | RL-2 |
| Seventh layer | PC-1 | PC-1 | RL-2 | UV-1 | UV-1 |
| Eighth layer | — | — | UV-1 | PC-1 | PC-1 |
| Ninth layer | — | — | PC-1 | — | — |
| Coating amount of silver(g/m$^2$) | 0.38 | 0.31 | 0.31 | 0.31 | 0.31 |
| Coating amount of gelatin(g/m$^2$) | 5.97 | 5.97 | 5.97 | 6.36 | 5.97 |

(Preparation of Samples 806 to 822)

Each of Samples 806 to 822 was prepared in the same manner as Sample 802, except that the layer structure, the emulsion and the emulsified dispersion shown in Table 9 were used.

Each of the emulsions used therein was replaced by Emulsion Bm-1 so as to have the same silver content, while the replacement of each of the emulsified dispersions was carried out in the same weight. All the samples thus prepared are shown in Table 9.

Sample 801 was made into a roll with a width of 127 mm; the resultant sample was exposed to light with a standard photographic image, using Digital Minilab Frontier 350 (trade name, manufactured by Fuji Photo Film Co., Ltd.); and then, the exposed sample was continuously processed (running test) in the following processing steps, respectively, until an accumulated replenisher amount of the color developing solution reached to be equal to twice the color developer tank volume. The following two processings, which were different in the composition of processing solutions and processing time, were carried out, to evaluate the light-sensitive material.

| Processing step | Temperature | Time | Replenisher amount* |
|---|---|---|---|
| Color development | 45.0° C. | 17 sec | 35 ml |
| Bleach-fixing | 40.0° C. | 17 sec | 30 ml |
| Rinse (1) | 45.0° C. | 4 sec | — |
| Rinse (2) | 45.0° C. | 4 sec | — |
| Rinse (3)** | 45.0° C. | 3 sec | — |

-continued

| Processing step | Temperature | Time | Replenisher amount* |
|---|---|---|---|
| Rinse (4)** | 45.0° C. | 5 sec | 121 ml |
| Drying | 80° C. | 15 sec | |

The time from the start of the developement to the drying was 65 seconds.

(Note)

*Replenisher amount per m$^2$ of the light-sensitive material to be processed.

**A rinse cleaning system RC50D (trade name), manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day. The rinse was made in a four-tank counter-current system from Rinse (1) to (4).

The composition of each processing solution was as follows.

| (Color developer) | (Tank solution) | (Replenisher) |
|---|---|---|
| Water | 800 ml | 800 ml |
| Fluorescent whitening agent (FL-3) | 4.0 g | 8.0 g |
| Residual color reducing agent (SR-1) | 3.0 g | 5.5 g |
| Triisopropanolamine | 8.8 g | 8.8 g |
| Sodium p-toluenesulfonate | 10.0 g | 10.0 g |
| Ethylenediamine tetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl) hydroxylamine | 8.5 g | 14.0 g |
| 4-Amino-3-methyl-N-ethyl-N-(β-methanesulfonamidoethyl) aniline·3/2 sulfate·monohydrate | 7.0 g | 19.0 g |
| Potassium carbonate | 26.3 g | 26.3 g |
| Water to make | 1,000 ml | 1,000 ml |
| pH (25° C./adjusted using sulfuric acid and KOH) | 10.25 | 12.6 |

| (Bleach-fixing solution) | (Tank solution) | (Replenisher) |
|---|---|---|
| Water | 800 ml | 800 ml |
| Ammonium thiosulfate (750 g/l) | 107 ml | 214 ml |
| Succinic acid | 29.5 g | 59.0 g |
| Ammonium iron (III) ethylenediaminetetraacetate | 47.0 g | 94.0 g |
| Ethylenediamine tetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1,000 ml | 1,000 ml |
| pH (25° C./adjusted using nitric acid and aqua ammonia) | 6.00 | 6.00 |

| (Rinse solution) | (Tank solution) | (Replenisher) |
|---|---|---|
| Sodium chlorinated-isocyanurate | 0.02 g | 0.02 g |
| Deionized water (conductivity: 5 μS/cm or less) | 1,000 ml | 1,000 ml |
| PH (25° C.) | 6.5 | 6.5 |

FL-1

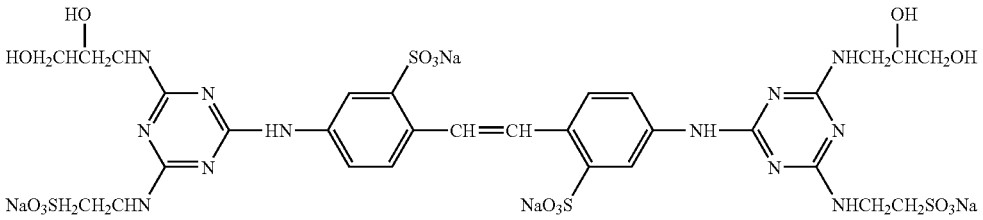

FL-2

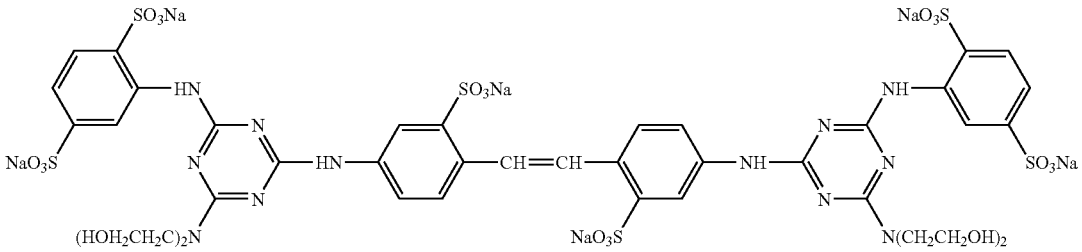

FL-3

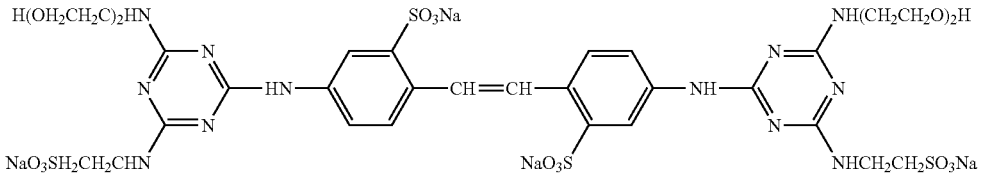

SR-1

-continued

| (Rinse solution) | (Tank solution) | (Replenisher) |
|---|---|---|

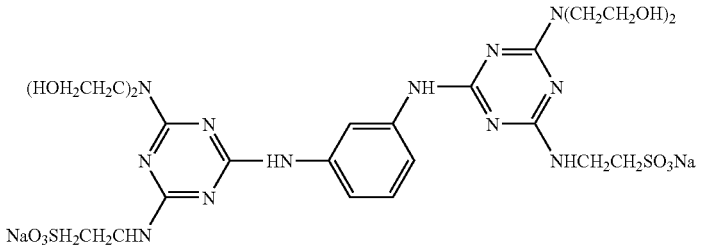

Evaluation of Samples

After keeping the light-sensitive material samples 801 to 822 under conditions of 25° C. and 55% RH for 7 days after coating, the following evaluations were performed.

(Color Formation Efficiency)

Each sample was subjected to blue-light gradation exposure by means of the following exposure apparatus, and further to the foregoing three kinds of processing, after a 5-second lapse from the conclusion of exposure. As light sources, a blue laser at a wavelength of about 470 nm pulled out by performing a wavelength conversion of a semiconductor laser (an oscillation wavelength of about 940 nm) using a SHG crystal of $LiNbO_3$ having a waveguide-like reverse domain structure, a green laser at a wavelength of about 530 nm pulled out by performing a wavelength conversion of a semiconductor laser (an oscillation wavelength of about 1060 nm) using a SHG crystal of $LiNbO_3$ having a waveguide-like reverse domain structure, and a red semiconductor laser at a wave length of about 650 nm (Hitachi Type No. HL6501MG), were used. Each laser light of three colors moved perpendicularly to a scanning direction by a polygon mirror, and could be made to carry out sequential-scanning exposure on the sample. The change of light quantity caused by the temperature of the semiconductor is prevented by keeping the temperature constant using a Peltier device. An effectual beam diameter is 80 μm, a scanning pitch is 42.3 μm (600 dpi), and the average exposure time per pixel was $1.7\times10^{-7}$ sec. The temperature of the semiconductor laser was kept constant by using a Peltier device to prevent the quantity of light from being changed by temperature.

The exposed Samples 801 to 822 were each subjected to the above processing.

After the processing, the yellow reflection density of each sample was measured, and the maximum developed-color density Dmax of yellow densities was determined.

(Processing Unevenness Caused by Processing After Storage)

Each sample was stored at a temperature of 25° C. and a relative humidity of 55% for 7 days after coating, and further stored at a temperature of 30° C. and a relative humidity of 50% for 30 days. The thus stored samples were each subjected to the aforementioned exposure using a digital information recorded with a digital camera. In addition to the foregoing processing, the processing with a running processing solution newly prepared at a color developing bath replenishment rate of 45 mL/$m^2$ was performed under two different conditions (color developing bath replenishment rates of 45 mL/$m^2$ and 35 mL/$m^2$). Under each of the conditions, 10 sheets of color print were produced, and a visual observation of unevenness of each print was made and evaluated according to the following criterion.

A: Uneven density was hardly observed, so the print quality was rated as excellent.

B: Uneven density was observed to a slight extent on 1 to 3 of 10 sheets.

C: Uneven density was observed clearly on 1 to 3 of 10 sheets, so the print quality was rated as poor.

D: Uneven density was observed clearly on almost all of 10 sheets, so the print quality was rated as unacceptable.

(Silver Removal Characteristics)

After uniform exposure under a condition to develop gray color, each sample was subjected to the above processing, with adjusting the time in the bleach-fixing bath to be 10 seconds. In order to remove organic dyes and colored matter from the processed samples, the samples were allowed to stand in an 85:15 mixture of dimethylformamide and water for 12 hours at room temperature. Then, stain derived from silver remaining in each sample was observed, and a sensory evaluation was made by grading the extent of stain in accordance with the criterion described below:

Grade Criterion of Evaluation

○ Practically no residual silver stain was observed

Δ Slight stain was observed

× Stain observed was noticeable, so unacceptable

Sample 801 was the grade Δ in silver removal characteristics, while all of Samples 802 to 822 having lower silver coating amount were the grade ○ in silver removal characteristics.

Thus, a further reduction in processing time is achievable by lowering silver coating amount.

Evaluation results of color formation efficiency and processing unevenness after storage are shown in Table 9.

TABLE 9

| Sample No. | Kind of layer constitution | Emulsion of first layer (Average size, μm) | Yellow-coupler emulsified dispersion (Average size, nm) | Coating amount of silver(g/m$^2$) | Color formation efficiency | Unevenness after Storage: Replenisher amount (45 mL/m$^2$) | Unevenness after Storage: Replenisher amount (35 mL/m$^2$) |
|---|---|---|---|---|---|---|---|
| 801 | A | Bm-1 (0.54) | Bv-1 (140) | 0.38 | 2.22 | A | B |
| 802 | B | Bm-1 (0.54) | Bv-1 (140) | 0.31 | 1.99 | B | C |
| 803 | C1 | Bm-1 (0.54) | Bv-1 (140) | 0.31 | 2.04 | B | C |
| 804 | C2 | Bm-1 (0.54) | Bv-1 (140) | 0.31 | 2.03 | B | C |
| 805 | D1 | Bm-1 (0.54) | Bv-1 (140) | 0.31 | 2.03 | B | C |
| 806 | B | Bm-2 (0.44) | Bv-1 (140) | 0.31 | 2.01 | B | C |
| 807 | B | Bm-3 (0.35) | Bv-1 (140) | 0.31 | 2.03 | B | D |
| 808 | B | Bm-1 (0.54) | Bv-2 (100) | 0.31 | 2.00 | B | C |
| 809 | B | Bm-1 (0.54) | Bv-3 (80) | 0.31 | 2.02 | B | C |
| 810 | B | Bm-1 (0.54) | Bv-4 (60) | 0.31 | 2.04 | B | C |
| 811 | B | Bm-3 (0.35) | Bv-4 (60) | 0.31 | 2.06 | B | D |
| 812 | C1 | Bm-2 (0.44) | Bv-1 (140) | 0.31 | 2.12 | A | B |
| 813 | C1 | Bm-3 (0.35) | Bv-1 (140) | 0.31 | 2.16 | A | B |
| 814 | C1 | Bm-1 (0.54) | Bv-2 (100) | 0.31 | 2.12 | A | B |
| 815 | C1 | Bm-1 (0.54) | Bv-3 (80) | 0.31 | 2.17 | A | B |
| 816 | C1 | Bm-1 (0.54) | Bv-4 (60) | 0.31 | 2.19 | A | B |
| 817 | C1 | Bm-3 (0.35) | Bv-4 (60) | 0.31 | 2.22 | A | A |
| 818 | C2 | Bm-3 (0.35) | Bv-1 (140) | 0.31 | 2.06 | B | C |
| 819 | C2 | Bm-1 (0.54) | Bv-4 (60) | 0.31 | 2.07 | B | C |
| 820 | D1 | Bm-3 (0.35) | Bv-1 (140) | 0.31 | 2.17 | A | B |
| 821 | D1 | Bm-1 (0.54) | Bv-4 (60) | 0.31 | 2.17 | A | B |
| 822 | D1 | Bm-3 (0.35) | Bv-4 (60) | 0.31 | 2.20 | A | A |

As compared with Sample 801, Sample 802 having a lower silver coating amount was inferior in color formation efficiency and processing unevenness. When the samples had the layer structure C1 or D1, or were reduced in the grain size of the silver halide emulsion or the particle size of the yellow coupler emulsified dispersion, they individually had appreciable effects on color formation efficiency. However, they had no improving effect in preventing the processing unevenness. It can be seen that the color formation efficiency enhancing effect by reduction in grain size of the emulsion or in particle size of the emulsified dispersion was much greater in the case of the layer structure C1 or D1 than the case of the layer structure B. Further, the samples according to the combinations defined in the present invention had considerable effects in preventing processing unevenness. What brought about such a considerable effect in preventing processing unevenness is unclear, but it is considered that a leap upward in utilization efficiency of oxidized developing agent, owing to the above combinations, participated the foregoing considerable effect. When both the grain size of the emulsion and the particle size of the emulsified dispersion were reduced, the greatest improving effect was produced on not only color formation efficiency but also prevention of processing unevenness.

The color-mixing-inhibiting layer having a multilayered form as disclosed in JP-A-4-110844 had some effect by arranging the layer containing a color-mixing inhibitor in a smaller amount so as to adjoin an emulsion layer. However, the samples having such a color-mixing-inhibiting layer could not provide such dramatic density improvement as made by use of the emulsion/emulsified dispersion combination defined in the present invention, and besides, they had no effect in preventing processing unevenness. Therefore, arranging an intermediate layer free of color-mixing inhibitor in a position adjacent to an emulsion layer as in the present invention has proved to be effective.

Example 9

(Preparation of Emulsion and Emulsified Dispersion)

Emulsion grains Gm-2 and Gm-3 were prepared in the same manner as in the preparation of Emulsion Gm-1 in Example 8, except that the temperature and the addition rate at the step of mixing the silver nitrate and sodium chloride by simultaneous addition were changed, and the amounts of respective metal complexes that were to be added during the addition of the silver nitrate and sodium chloride were changed. The sizes of these emulsion grains are shown in Table 10.

TABLE 10

| Emulsion | Average size (Side length, μm) | Coefficient of variation (%) |
|---|---|---|
| Gm-1 | 0.40 | 7.7 |
| Gm-2 | 0.55 | 8.2 |
| Gm-3 | 0.31 | 9.3 |

In conformity with Solution 1 for the emulsified dispersion Bv-1 prepared in Example 8, an ethyl acetate solution in which Magenta coupler (Ex-M), Color-image stabilizers (Cpd-2, Cpd-6, Cpd-7, Cpd-8, Cpd-9, Cpd-10, Cpd-11, and Cpd-20), Ultraviolet absorber (UV-A), and Solvents (Solv-3, Solv-4, Solv-6, and Solv-9) were mixed in proper amounts, respectively, was prepared. This solution was emulsified and dispersed in a gelatin solution containing sodium dodecylbenzenesulfonate in the same manner as in the case of the emulsified dispersion Bv-1, thereby preparing an emulsified dispersion Gv-1. Similarly to the emulsified dispersions Bv-3 and Bv-4, emulsified dispersions Gv-2 and Gv-3 having the same composition as the foregoing magenta-coupler emulsified dispersion Gv-1 were prepared by use of the Ultimaizer System.

With respect to the emulsified dispersions Gv-1 to Gv-3, their average particle sizes and pressure conditions adopted in the Ultimaizer System are shown in Table 11.

TABLE 11

| Emulsified dispersion | Average size (nm) | Emulsifying device (Pressure) |
|---|---|---|
| Gv-1 | 120 | Dissolver |
| Gv-2 | 80 | Ultimaizer system (210 MPa) |
| Gv-3 | 55 | Ultimaizer system (245 MPa) |

(Preparation of Samples 901 to 914)

Coating solutions for each layers were prepared using the foregoing emulsions and emulsified dispersions. Each of Samples 901 to 914 was prepared by using the same layers as described in Example 8 in the same manner as Sample 802. Herein, the emulsion replacement was made in the same amount on a silver basis and the emulsified dispersion replacement was made in the same amount on a coupler basis. In addition to the layer structure adopted in Example 8, the layer structures C3 and D2 shown in the following Table 12 were newly used. The emulsions used, the emulsified dispersions used, and the layer constitutions are shown in Table 12.

TABLE 12

| Kind of layer constitution | Layer constitution C3 | Layer constitution D2 |
|---|---|---|
| First layer | BL-2 | BL-2 |
| Second layer | MCN1-1 | MCS1-2 |
| Third layer | MCS1-3 | ML-1 |
| Fourth layer | MCN1-1 | GL-3 |
| Fifth layer | GL-2 | ML-1 |
| Sixth layer | MCN2-1 | MCS2-2 |
| Seventh layer | MCS2-3 | RL-2 |
| Eighth layer | MCN2-1 | UV-1 |
| Ninth layer | RL-2 | PC-1 |
| Tenth layer | UV-1 | — |
| Eleventh layer | PC-1 | — |
| Coating amount of silver ($g/m^2$) | 0.31 | 0.31 |
| Coating amount of gelatin ($g/m^2$) | 5.97 | 5.97 |

(Evaluation of Light-sensitive Materials)

In accordance with Example 8, magenta reflection densities of the samples having undergone the exposure to green light and the processing were measured. And processing unevenness after the storage was also evaluated by the same method as adopted in Example 8.

As can be clearly seen from Table 13, not only great enhancement in color formation efficiency but also appreciable improvement in processing unevenness after storage was achieved by combining the size reduction in emulsions and/or emulsified dispersions with the layer constitution C3 or D2.

Therefore, it can be said that the present invention had great effect on the magenta-color-forming layer also.

TABLE 13

| Sample No. | Kind of layer constitution | Emulsion of green-sensitive layer (Average size, μm) | Magenta-coupler emulsified dispersion (Average size, nm) | Coating amount of silver($g/m^2$) | Color forming efficiency | Unevenness after Storage: Replenisher amount (45 $mL/m^2$) | Unevenness after Storage: Replenisher amount (35 $mL/m^2$) |
|---|---|---|---|---|---|---|---|
| 802 | B | Gm-1 (0.40) | Gv-1 (120) | 0.31 | 1.85 | B | C |
| 901 | C3 | Gm-1 (0.40) | Gv-1 (120) | 0.31 | 1.90 | B | B |
| 902 | D2 | Gm-1 (0.40) | Gv-1 (120) | 0.31 | 1.88 | B | C |
| 903 | B | Gm-2 (0.55) | Gv-1 (120) | 0.31 | 1.81 | B | C |
| 904 | B | Gm-3 (0.31) | Gv-1 (120) | 0.31 | 1.88 | B | D |
| 905 | B | Gm-1 (0.40) | Gv-2 (80) | 0.31 | 1.87 | B | C |
| 906 | B | Gm-1 (0.40) | Gv-3 (55) | 0.31 | 1.88 | B | C |
| 907 | C3 | Gm-2 (0.55) | Gv-1 (120) | 0.31 | 1.82 | B | C |
| 908 | C3 | Gm-3 (0.31) | Gv-1 (120) | 0.31 | 1.94 | B | B |
| 909 | C3 | Gm-1 (0.40) | Gv-2 (80) | 0.31 | 1.93 | A | B |
| 910 | C3 | Gm-1 (0.40) | Gv-3 (55) | 0.31 | 1.99 | A | B |
| 911 | C3 | Gm-3 (0.31) | Gv-3 (55) | 0.31 | 2.15 | A | A |
| 912 | D2 | Gm-3 (0.31) | Gv-1 (120) | 0.31 | 1.93 | A | B |
| 913 | D2 | Gm-1 (0.40) | Gv-3 (55) | 0.31 | 1.93 | A | B |
| 914 | D2 | Gm-3 (0.31) | Gv-3 (55) | 0.31 | 2.12 | A | A |

Example 10

Effects of the invention related to the second embodiment of the present invention are explained below.

(Preparation of Red-sensitive Layer Emulsion Rm-2)

Emulsion grains were prepared in the same manner as in the preparation of Emulsion Rm-1, except that the temperature and the addition rate at the step of mixing silver nitrate and sodium chloride by simultaneous addition were changed, and the amounts of respective metal complexes that were to be added during the addition of silver nitrate and sodium chloride were changed. The thus-obtained emulsion grains were monodisperse cubic silver iodobromochloride grains having a side length of 0.29 μm and a variation coefficient of 9.9%. After re-dispersion of this emulsion, Emulsion Rm-2 was prepared in the same manner as Emulsion Rm-1, except that the amounts of compounds to be added in the preparation of Rm-1 were changed.

(Preparation of Emulsified Dispersion Rv-1)

In conformity with Solution 1 for the emulsified dispersion Bv-1 prepared in Example 8, an ethyl acetate solution in which Cyan couplers (ExC-1, ExC-2 and ExC-3), Color image stabilizers (Cpd-1, Cpd-7, Cpd-9, Cpd-10, Cpd-14, Cpd-15, Cpd-16, Cpd-17, Cpd-18, Cpd-19 and UV-5) and Solvent (Solv-5) were mixed in proper amounts, respectively, was prepared. This solution was emulsified and dispersed in a gelatin solution containing sodium dodecylbenzenesulfonate in the same manner as in the case of the emulsified dispersion Bv-1, thereby preparing an emulsified dispersion Rv-1. The average particle size of the emulsified dispersion Rv-1 was 150 nm. The RL-1 and the RL-2 in Example 8 utilized this emulsified dispersion Rv-1.

(Preparation of Emulsified Dispersion Rv-2)

Similarly to the emulsified dispersion Bv-4, an emulsified dispersion Rv-2 having the same composition as the foregoing cyan-coupler emulsified dispersion Rv-1 was prepared under a pressure of 245 MPa by use of the Ultimaizer System. The average particle size of the emulsified dispersion RV-2 was 60 nm.

(Preparation of Sample 1001)

Sample 1001 was prepared in the same manner as Sample 802, except that the layer constitution, the emulsions and the emulsified dispersions shown in the following Table 14 were used.

TABLE 14

| | Layer constitution | Emulsion (Average size, μm) | Emulsified dispersion (average size, nm) |
|---|---|---|---|
| First layer | BL-3 | Bm-3 (0.35) | Bv-4 (60) |
| Second layer | YL-1 | — | Bv-4 (60) |
| Third layer | MCN1-1 | — | — |
| Fourth layer | MCS1-3 | — | — |
| Fifth layer | MCN1-1 | — | — |
| Sixth layer | CL-1 | — | Rv-2 (60) |
| Seventh layer | RL-3 | Rm-2 (0.29) | Rv-2 (60) |
| Eighth layer | CL-1 | — | Rv-2 (60) |
| Ninth layer | MCN2-1 | — | — |
| Tenth layer | MCS2-3 | — | — |
| Eleventh layer | MCN2-1 | — | — |
| Twelfth layer | ML-1 | — | Gv-3 (55) |
| Thirteenth layer | GL-4 | Gm-3 (0.31) | Gv-3 (55) |
| Fourteenth layer | ML-1 | — | Gv-3 (55) |
| Fifteenth layer | UV-1 | — | — |
| Sixteenth layer | PC-1 | — | — |
| Coating amount of Silver ($g/m^2$) | 0.31 | — | — |
| Coating amount of Gelatin ($g/m^2$) | 5.97 | — | — |

The constitution of each new layer is as follows.

Green-sensitive emulsion layer GL-4

The same as GL-3, except that the coating amount of silver in GL-3 was changed to 0.10 $g/m^2$.

| Red-sensitive emulsion layer RL-3 | |
|---|---|
| Emulsion (Rm-2) | 0.08 |
| Gelatin | 0.32 |
| Cyan coupler (ExC-1) | 0.038 |
| Cyan coupler (ExC-2) | 0.004 |
| Cyan coupler (ExC-3) | 0.014 |
| Color image stabilizer (Cpd-1) | 0.01 |
| Color image stabilizer (Cpd-7) | 0.004 |
| Color image stabilizer (Cpd-9) | 0.014 |
| Color image stabilizer (Cpd-10) | 0.0004 |
| Color image stabilizer (Cpd-14) | 0.0004 |
| Color image stabilizer (Cpd-15) | 0.062 |
| Color image stabilizer (Cpd-16) | 0.0008 |
| Color image stabilizer (Cpd-17) | 0.0004 |
| Color image stabilizer (Cpd-18) | 0.018 |
| Color image stabilizer (Cpd-19) | 0.014 |
| Color image stabilizer (UV-5) | 0.04 |
| Solvent (Solv-5) | 0.04 |

| Cyan coupler layer CL-1 | |
|---|---|
| Gelatin | 0.29 |
| Cyan coupler (ExC-1) | 0.014 |
| Cyan coupler (ExC-2) | 0.002 |
| Cyan coupler (ExC-3) | 0.005 |
| Color image stabilizer (Cpd-1) | 0.01 |
| Color image stabilizer (Cpd-7) | 0.003 |
| Color image stabilizer (Cpd-9) | 0.013 |
| Color image stabilizer (Cpd-10) | 0.0003 |
| Color image stabilizer (Cpd-14) | 0.0003 |
| Color image stabilizer (Cpd-15) | 0.059 |
| Color image stabilizer (Cpd-16) | 0.0006 |
| Color image stabilizer (Cpd-17) | 0.0003 |
| Color image stabilizer (Cpd-18) | 0.016 |
| Color image stabilizer (Cpd-19) | 0.013 |
| Color image stabilizer (UV-5) | 0.03 |
| Solvent (Solv-5) | 0.03 |

In conformity with Example 8, color formation efficiency (yellow, cyan, and magenta densities) and processing unevenness after storage of Sample 1001 were evaluated. Sample 1001 was excellent in each evaluation items.

TABLE 15

| Sample | Color forming efficiency | | | Processing unevenness after storage | |
|---|---|---|---|---|---|
| | | | | Replenisher amount | Replenisher amount |
| No. | Yellow | Magenta | Cyan | (45 $mL/m^2$) | (35 $mL/m^2$) |
| 1001 | 2.22 | 2.21 | 2.32 | A | A |

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic light-sensitive material comprising, on a reflective support, at least one silver halide emulsion layer which contains a silver halide emulsion having a silver chloride content of 90 mol % or more in terms of silver halide constituting the silver halide emulsion, and one or both of:

(1) at least one substantially light-insensitive dye-forming-coupler-containing layer, and (2) at least one non-color-forming intermediate layer containing a color-mixing inhibitor and at least one non-color-forming intermediate layer substantially free of color-mixing inhibitor, wherein (i) when a substantially light-insensitive dye-forming-coupler-containing layer is present, the layer is positioned adjacent to the silver halide emulsion layer, and (ii) when both a non-color-forming intermediate layer containing a color-mixing inhibitor and a non-color-forming intermediate layer substantially free of color-mixing inhibitor are present, the non-color-forming intermediate layer containing a color-mixing inhibitor is positioned adjacent to the non-color-forming intermediate layer substantially free of color-mixing inhibitor.

2. A silver halide color photographic light-sensitive material, comprising:

at least one silver halide emulsion layer, at least one substantially light-insensitive dye-forming-coupler-containing layer, at least one non-color-forming intermediate layer containing a color-mixing inhibitor, and at least one non-color-forming intermediate layer substantially free of color-mixing inhibitor, wherein the light-insensitive dye-forming-coupler-containing layer is positioned adjacent to the silver halide emulsion layer, and the non-color-forming intermediate layer containing a color-mixing inhibitor is positioned adjacent to the non-color-forming intermediate layer substantially free of color-mixing inhibitor.

3. A silver halide color photographic light-sensitive material, comprising:

at least one silver halide emulsion layer, at least one substantially light-insensitive dye-forming-coupler-containing layer, and at least one non-color-forming intermediate layer containing a color-mixing inhibitor, wherein the light-insensitive dye-forming-coupler-containing layer is positioned adjacent to the silver halide emulsion layer, and a total coating amount of silver in the silver halide color photographic light-sensitive material is 0.5 $g/m^2$ or below.

4. The silver halide color photographic light-sensitive material as claimed in claim 1, comprising:

at least one silver halide emulsion layer, at least one non-color-forming intermediate layer containing a color-mixing inhibitor, and at least one non-color-forming intermediate layer substantially free of color-mixing inhibitor, wherein the non-color-forming intermediate layer containing a color-mixing inhibitor is positioned adjacent to the non-color-forming intermediate layer substantially free of color-mixing inhibitor, and a total coating amount of silver in the silver halide color photographic light-sensitive material is 0.5 $g/m^2$ or below.

5. The silver halide color photographic light-sensitive material as claimed in claim 1, comprising:

at least one silver halide emulsion layer, and at least one substantially light-insensitive dye-forming-coupler-containing layer, wherein the substantially light-insensitive dye-forming-coupler-containing layer is positioned adjacent to the silver halide emulsion layer, and the silver halide emulsion layer has a coating amount of silver of 0.2 $g/m^2$ or below and has a silver/hydrophilic binder ratio of 0.2 or above on a coating mass basis.

6. The silver halide color photographic light-sensitive material as claimed in claim 1, comprising:

a hydrophilic binder, a color-mixing inhibitor, at least one silver halide emulsion layer, and at least one substantially light-insensitive dye-forming-coupler-containing layer, wherein the substantially light-insensitive dye-forming-coupler-containing layer is positioned adjacent to the silver halide emulsion layer, and a total coating amount of hydrophilic binder in the silver halide color photographic light-sensitive material is 6.0 $g/m^2$ or below, and a content of a color-mixing inhibitor is $5\times10^{-5}$ $mol/m^2$ or above.

7. The silver halide color photographic light-sensitive material as claimed in claim 1, comprising:

at least one silver halide emulsion layer, and at least one substantially light-insensitive dye-forming-coupler-containing layer, wherein the substantially light-insensitive dye-forming-coupler-containing layer is positioned adjacent to the silver halide emulsion layer, and the silver halide emulsion layer has a hydrophilic binder coating amount of 0.6 $g/m^2$ or below, and a ratio of a hydrophilic binder coating amount in the substantially light-insensitive dye-forming-coupler-containing layer to the hydrophilic binder coating amount in the silver halide emulsion layer is 1.0 or above.

8. The silver halide color photographic light-sensitive material as claimed in claim 1, comprising:

at least one silver halide emulsion layer, at least one non-color-forming intermediate layer containing a color-mixing inhibitor, and at least one non-color-forming intermediate layer substantially free of color-mixing inhibitor, wherein the non-color-forming intermediate layer containing a color-mixing inhibitor is positioned adjacent to the non-color-forming intermediate layer substantially free of color-mixing inhibitor, and a total hydrophilic-binder coating amount in the silver halide color photographic light-sensitive material is 6.0 $g/m^2$ or below.

9. A silver halide color photographic light-sensitive material, comprising:

at least one silver halide emulsion layer, at least one substantially light-insensitive dye-forming-coupler-containing layer, at least one non-color-forming intermediate layer containing a color-mixing inhibitor, and at least one non-color-forming intermediate layer substantially free of color-mixing inhibitor, wherein the substantially light-insensitive dye-forming-coupler-containing layer is positioned adjacent to the silver halide emulsion layer, and the non-color-forming intermediate layer containing a color-mixing inhibitor is positioned adjacent to the non-color-forming intermediate layer substantially free of color-mixing inhibitor, and wherein the silver halide color photographic light-sensitive material has a total coating amount of silver of 0.5 $g/m^2$ or below, and a total hydrophilic-binder coating amount of 6.0 $g/m^2$ or below.

10. The silver halide color photographic light-sensitive material as claimed in claim 1, comprising:

a silver halide emulsion layer and a substantially light-insensitive dye-forming-coupler-containing layer, wherein the silver halide emulsion layer is positioned adjacent to the substantially light-insensitive dye-forming-coupler-containing layer, the silver halide emulsion layer having a coating amount of silver of 0.2 $g/m^2$ or below and a silver/hydrophilic binder ratio of 0.2 or above on a coating mass basis.

11. The silver halide color photographic light-sensitive material as claimed in claim 1, containing a color-mixing inhibitor in a total coating amount of $5\times10^{-5}$ $mol/m^2$ or above.

12. The silver halide color photographic light-sensitive material as claimed in claim 1, comprising:

a silver halide emulsion layer and a substantially light-insensitive dye-forming-coupler-containing layer, wherein the silver halide emulsion layer is positioned adjacent to the substantially light-insensitive dye-forming-coupler-containing layer, the silver halide emulsion layer having a hydrophilic binder coating amount of 0.6 $g/m^2$ or below, and a ratio of a hydrophilic binder coating amount in the substantially light-insensitive dye-forming-coupler-containing layer to the hydrophilic binder coating amount in the silver halide emulsion layer is 1.0 or above.

13. The silver halide color photographic light-sensitive material as claimed in claim 1, comprising:

at least one silver halide emulsion layer, at least one non-color-forming intermediate layer containing a color-mixing inhibitor, and at least one non-color-forming intermediate layer substantially free of color-mixing inhibitor, wherein the non-color-forming intermediate layer substantially free of color-mixing inhibitor is adjacently disposed between the non-color-forming intermediate layer containing a color-mixing inhibitor and the silver halide emulsion layer, and at least one of the following conditions 1) and 2) is satisfied:

1) the silver halide emulsion layer contains silver halide grains having an average grain size of 0.50 μm or below, and 2) at least one aqueous dispersion of a water-insoluble photographically-useful compound is incorporated in the silver halide color photographic light-sensitive material and the dispersion has an average particle size of 100 nm or below.

14. The silver halide color photographic light-sensitive material as claimed in claim 1, comprising:

at least one silver halide emulsion layer, and at least one substantially light-insensitive dye-forming-coupler-containing layer, wherein the at least one silver halide layer contains a dye-forming coupler, wherein the at least one substantially light-insensitive dye-forming-coupler-containing layer is positioned adjacent to the silver halide emulsion layer, and wherein at least one of the following conditions 1A) and 2) is satisfied:

1A) the silver halide emulsion layer contains silver halide grains having an average grain size of 0.35 μm or below, and 2) an aqueous dispersion of a water-insoluble photographically-useful compound is incorporated in the silver halide color photographic light-sensitive material and the dispersion has an average particle size of 100 nm or below.

15. The silver halide color photographic light-sensitive material as claimed in claim 1, comprising:

at least one silver halide emulsion layer, and at least two non-color-forming intermediate layers, wherein the at least two non-color-forming intermediate layers are positioned adjacent to each other; one of the non-color-forming intermediate layers is substantially free of color-mixing inhibitor, and another of the non-color-forming intermediate layers contains a color-mixing inhibitor; and at least one of the following conditions 1B) and 2) is satisfied:

1B) the silver halide emulsion layer contains silver halide grains having an average grain size of 0.45 μm or below, and 2) an aqueous dispersion of a water-insoluble photographically-useful compound is incorporated in the silver halide color photographic light-sensitive material and the dispersion has an average particle size of 100 nm or below.

16. The silver halide color photographic light-sensitive material as claimed in claim 13, wherein the average grain size of the silver halide grains is 0.35 μm or below.

17. The silver halide color photographic light-sensitive material as claimed in claim 14, wherein the average grain size of the silver halide grains is 0.35 μm or below.

18. The silver halide color photographic light-sensitive material as claimed in claim 13, wherein the average particle size of the aqueous dispersion is 70 nm or less.

19. The silver halide color photographic light-sensitive material as claimed in claim 14, wherein the average particle size of the aqueous dispersion is 70 nm or less.

20. The silver halide color photographic light-sensitive material as claimed in claim 15, wherein the average particle size of the aqueous dispersion is 70 nm or less.

21. The silver halide color photographic light-5 sensitive material as claimed in claim 13, wherein the aqueous dispersion has been prepared by dispersing under a pressure of at least 200 MPa by use of an ultrahigh-pressure homogenizer.

22. The silver halide color photographic light-sensitive material as claimed in claim 14, wherein the aqueous dispersion has been prepared by dispersing under a pressure of at least 200 MPa by use of an ultrahigh-pressure homogenizer.

23. The silver halide color photographic light-sensitive material as claimed in claim 15, wherein the aqueous dispersion has been prepared by dispersing under a pressure of at least 200 MPa by use of an ultrahigh-pressure homogenizer.

24. The silver halide color photographic light-sensitive material as claimed in claim 13, wherein the aqueous dispersion has been prepared by dispersing under a 25 pressure of at least 240 MPa by use of an ultrahigh-pressure homogenizer.

25. The silver halide color photographic light-sensitive material as claimed in claim 14, wherein the aqueous dispersion has been prepared by dispersing under a pressure of at least 240 MPa by use of an ultrahigh-pressure homogenizer.

26. The silver halide color photographic light-sensitive material as claimed in claim 15, wherein the aqueous dispersion has been prepared by dispersing under a pressure of at least 240 MPa by use of an ultrahigh-pressure homogenizer.

27. The silver halide color photographic light-sensitive material as claimed in claim 13, wherein both the conditions 1) and 2) are satisfied.

28. The silver halide color photographic light-sensitive material as claimed in claim 14, wherein both the conditions 1A) and 2) are satisfied.

29. The silver halide color photographic light-sensitive material as claimed in claim 15, wherein both the conditions 1B) and 2) are satisfied.

30. The silver halide color photographic light-sensitive material as claimed in claim 13, wherein the aqueous dispersion contains a dye-forming coupler.

31. The silver halide color photographic light-sensitive material as claimed in claim 14, wherein the aqueous dispersion contains a dye-forming coupler.

32. The silver halide color photographic light-sensitive material as claimed in claim 15, wherein the aqueous dispersion contains a dye-forming coupler.

33. A silver halide color photographic light-sensitive material, comprising:

at least one silver halide emulsion layer, at least one substantially light-insensitive dye-forming-coupler-containing layer, and at least two non-color-forming intermediate layers, wherein the at least one silver halide emulsion layer contains a dye-forming coupler, wherein the at least one substantially light-insensitive dye-forming-coupler-containing layer is positioned adjacent to the silver halide emulsion layer;

the at least two non-color-forming intermediate layers are positioned adjacent to each other, one of the non-color-forming intermediate layers is substantially free of color-mixing inhibitor, and another of the non-color-forming intermediate layers contains a color-mixing inhibitor; and at least one of the following conditions 1C) and 2) is satisfied:

1C) the silver halide emulsion layer contains silver halide grains having an average grain size of 0.40 μm or below, and 2) an aqueous dispersion of a water-insoluble photographically-useful compound is incorporated in the silver halide color photographic light-sensitive material and the dispersion has an average particle size of 100 nm or below.

* * * * *